US009663969B2

(12) United States Patent
Lila

(10) Patent No.: US 9,663,969 B2
(45) Date of Patent: May 30, 2017

(54) ENERGY ABSORBING LATCH SYSTEMS AND METHODS

(71) Applicant: Flexible Security LLC, Hudson, WI (US)

(72) Inventor: Bradley A. Lila, Hudson, WI (US)

(73) Assignee: Flexible Security LLC, Hudson, WI (US)

( * ) Notice: Subject to any disclaimer, the term of this patent is extended or adjusted under 35 U.S.C. 154(b) by 292 days.

(21) Appl. No.: 14/211,738

(22) Filed: Mar. 14, 2014

(65) Prior Publication Data

US 2014/0265367 A1 Sep. 18, 2014

Related U.S. Application Data

(60) Provisional application No. 61/782,708, filed on Mar. 14, 2013, provisional application No. 61/880,977, filed on Sep. 22, 2013.

(51) Int. Cl.
*E05C 19/10* (2006.01)
*E05B 17/20* (2006.01)
(Continued)

(52) U.S. Cl.
CPC ..... *E05B 17/2084* (2013.01); *E05B 17/0058* (2013.01); *E05C 19/12* (2013.01);
(Continued)

(58) Field of Classification Search
CPC ..... E05C 19/12; E05C 19/14; E05C 17/00; E05C 17/02; E05C 17/04; E05C 17/36;
(Continued)

(56) References Cited

U.S. PATENT DOCUMENTS 2,093,039 A * 9/1937 Eamon ..... E05C 17/14 292/262
2,770,482 A 11/1956 Kusiek
(Continued)

FOREIGN PATENT DOCUMENTS

CN 1144298 A 3/1997
CN 201963049 U 9/2011
(Continued)

OTHER PUBLICATIONS

International Search Report and Written Opinion for PCT/US2014/029119 mailed Jul. 21, 2014.
(Continued)

*Primary Examiner* — Alyson M Merlino
(74) *Attorney, Agent, or Firm* — Merchant & Gould P.C.

(57) ABSTRACT

A door latch (100, 400, 500, 600, 1200, 1300, 1400, 1500, 1600, 1700, 1800, 1900) resists opening of a door (200) beyond a predetermined amount when it is engaged and also allows the opening of the door when it is disengaged. The door latch includes a catch (220, 220', 3220) and a base (191) that is connected to a deformable member (140, 3140, 4140, 5140, 6140) at a joint (90). The joint configures the door latch and may include a pin (190). The catch (e.g., a hook) engages a catching portion (e.g., a loop 148, 3148, 6148) of the deformable member when engaged. The deformable member may stretch at least five percent when resisting an intrusion load (F) on the door. The base may mount to a door frame (300), and the catch may mount to the door. A spring (180) may urge the deformable member toward engagement. A shield (280, 2280, 4280, 5280, 6280) may protect the deformable member and resist cutting and may pivot with the deformable member urged by the spring. A finger pocket (296) may be used to overcome the spring. A detent (187) may retain a disengaged configuration (70), and a button (130) on the pin may be depressed to release the
(Continued)

detent. A keeper (260) may retain an engaged configuration (50), even when the intrusion load alternates. An armed configuration (40) may automatically transition to the engaged configuration upon the door reaching the predetermined amount and may be manually transitioned to the disengaged configuration upon operator manipulation. The deformable member may hyperelastically deform.

23 Claims, 45 Drawing Sheets

(51) Int. Cl.

| | |
|---|---|
| ***E05C 19/12*** | (2006.01) |
| ***E05B 17/00*** | (2006.01) |
| *E05C 5/00* | (2006.01) |
| *E05B 15/02* | (2006.01) |

(52) U.S. Cl.
CPC ..... *E05B 15/0205* (2013.01); *Y10T 292/17* (2015.04); *Y10T 292/79* (2015.04)

(58) Field of Classification Search
CPC ..... E05C 17/16; E05C 17/163; E05C 17/166; E05C 17/30; E05B 17/2084; E05B 17/0058; E05B 15/0205
USPC ..... 292/253, 262, 278, 288, 289, 290, 297, 292/298, 304, 272, 271, 341.15, 341.17, 292/247, 250, 63, 66, 100, 225, 226, 125, 292/126, 200, 256, 256.65, 256.69, 292/265–275, DIG. 15, DIG. 49, DIG. 38, 292/246, 249, DIG. 44, DIG. 16; 70/93, 70/83, 84, 125, 128, 130, 144, DIG. 12, 70/DIG. 79
See application file for complete search history.

(56) References Cited

U.S. PATENT DOCUMENTS

| | | | | |
|---|---|---|---|---|
| 3,152,825 | A | 10/1964 | Schlage | |
| 3,985,380 | A * | 10/1976 | Raivio | E05C 19/14 292/120 |
| 4,049,301 | A * | 9/1977 | Schenk | A44B 11/125 24/68 R |
| 4,109,948 | A | 8/1978 | Potter et al. | |
| 4,169,618 | A | 10/1979 | Potter et al. | |
| 4,333,324 | A | 6/1982 | Dietrich et al. | |
| 4,474,393 | A | 10/1984 | Kimura | |
| 4,605,251 | A | 8/1986 | Finlay | |
| 4,629,229 | A | 12/1986 | Correnti et al. | |
| 4,671,014 | A * | 6/1987 | Lack | E05C 19/003 16/223 |
| 4,801,165 | A * | 1/1989 | Pyle | E05C 19/14 292/249 |
| 5,607,195 | A * | 3/1997 | Antonucci | E05B 63/0056 292/247 |
| 5,624,142 | A * | 4/1997 | Watson | E05B 83/243 292/241 |
| 5,742,990 | A * | 4/1998 | Antonucci | E05B 63/0056 29/434 |
| 6,481,252 | B2 | 11/2002 | Calle et al. | |
| 6,641,185 | B2 | 11/2003 | Hale et al. | |
| 7,017,955 | B1 * | 3/2006 | Chiang | E05C 19/14 292/113 |
| 7,350,838 | B2 | 4/2008 | Schlattl et al. | |
| 2008/0042451 | A1 | 2/2008 | Moore et al. | |
| 2012/0139296 | A1 * | 6/2012 | Wilkens | E05B 83/243 296/193.11 |

FOREIGN PATENT DOCUMENTS

| | | | | |
|---|---|---|---|---|
| DE | 19804525 | A1 * | 8/1999 | E05C 19/14 |
| EP | 0 104 126 | B1 | 4/1986 | |
| GB | 191103861 | A * | 0/1912 | E05C 17/166 |
| JP | 5-202663 | | 8/1993 | |
| JP | 6-307145 | | 11/1994 | |
| JP | 2007-63902 | | 3/2007 | |

OTHER PUBLICATIONS

Munchkin XTRAGUARD 2 Count Dual Action Multi Use Latches, Amazon.com, 7 pages (Apr. 11, 2014).
Solid Brass 4 Inch Security Door Guard, Deltana DG425—Doorware.com, http://www.dooreware.com/site/product.cfm?id=7684, 2 pages (Copyright 2013).
The Ultimate Lock™ 3000 Series Installation Guide,8 pages (Feb. 3, 2013).
U.S. Appl. No. 14/211,153, filed Mar. 14, 2014 entitled "Engery Absorbing Lock Systems and Methods".

* cited by examiner

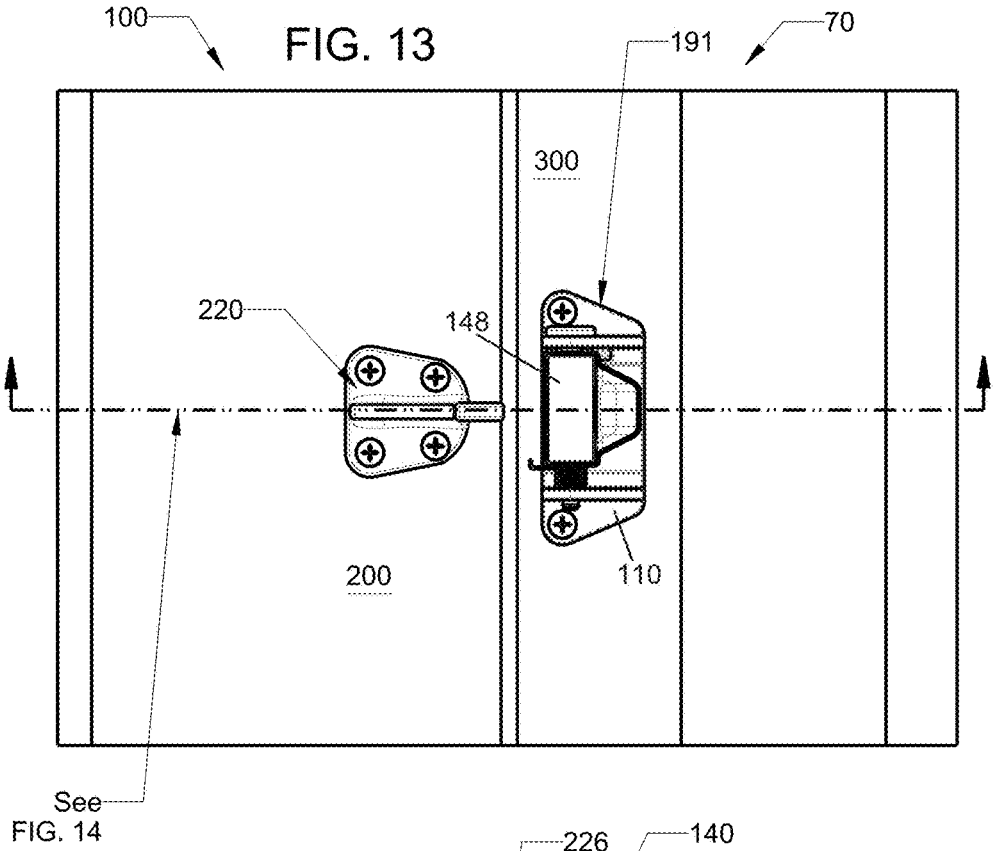
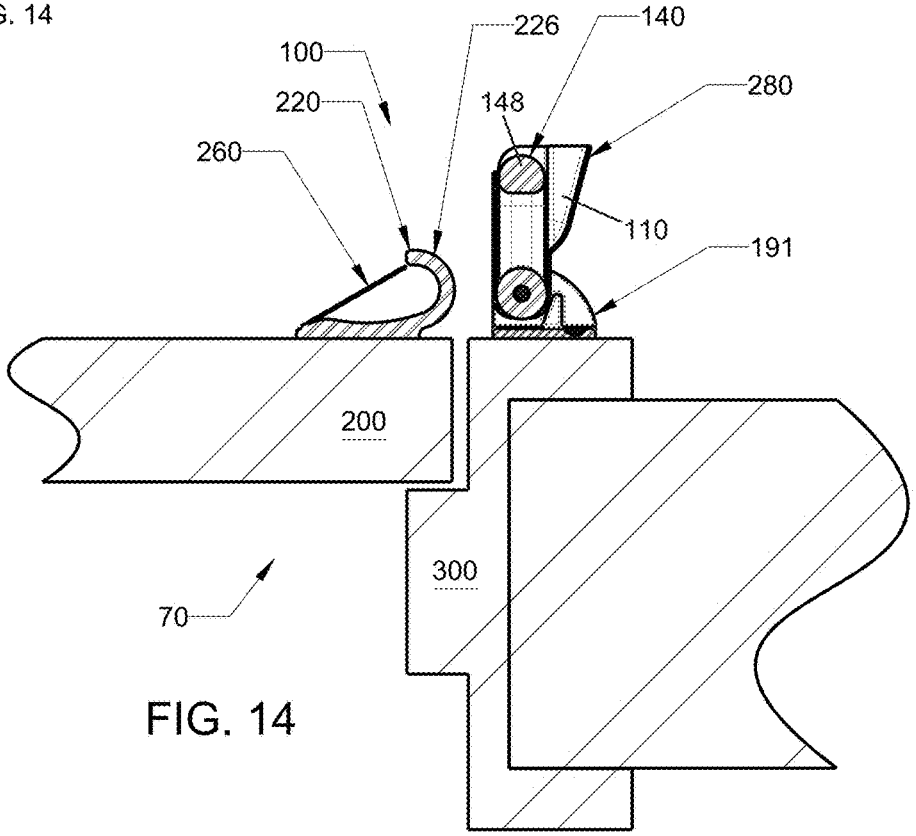
FIG. 14

FIG. 15
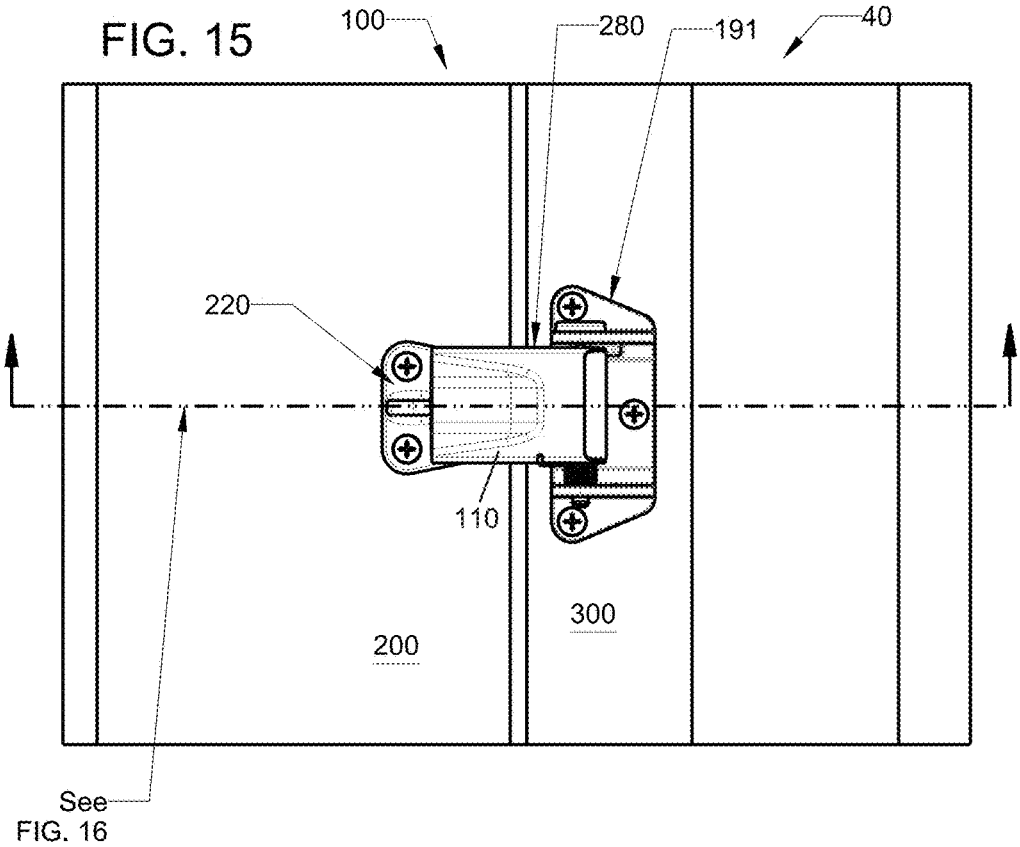
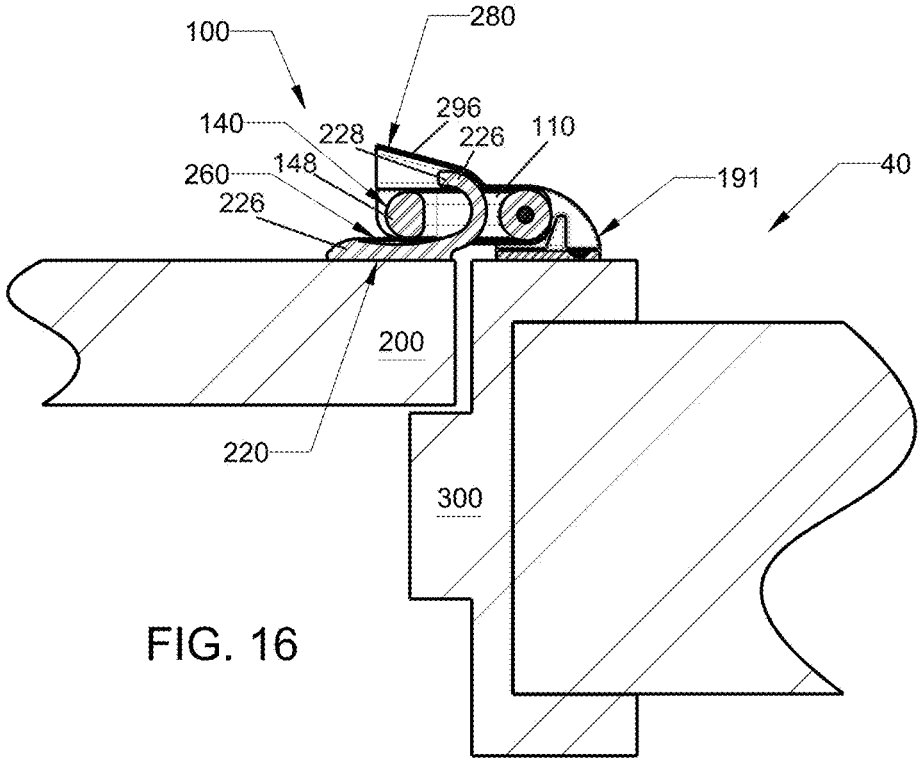
FIG. 16

FIG. 19
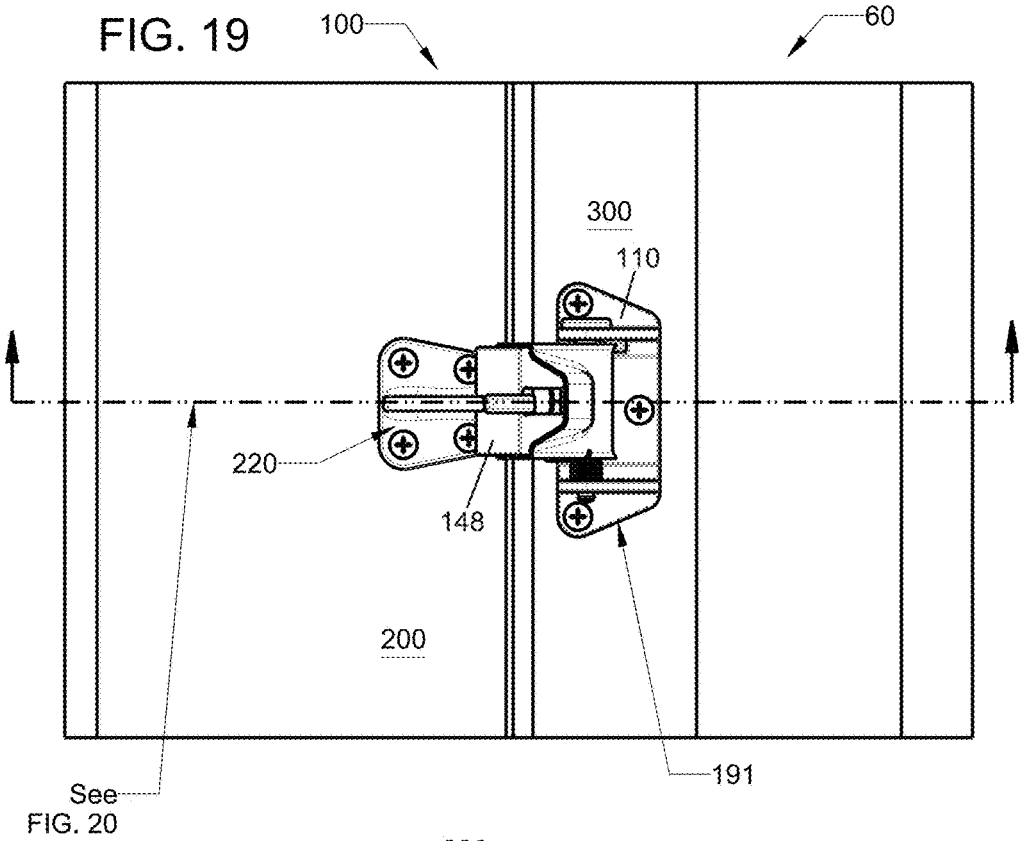
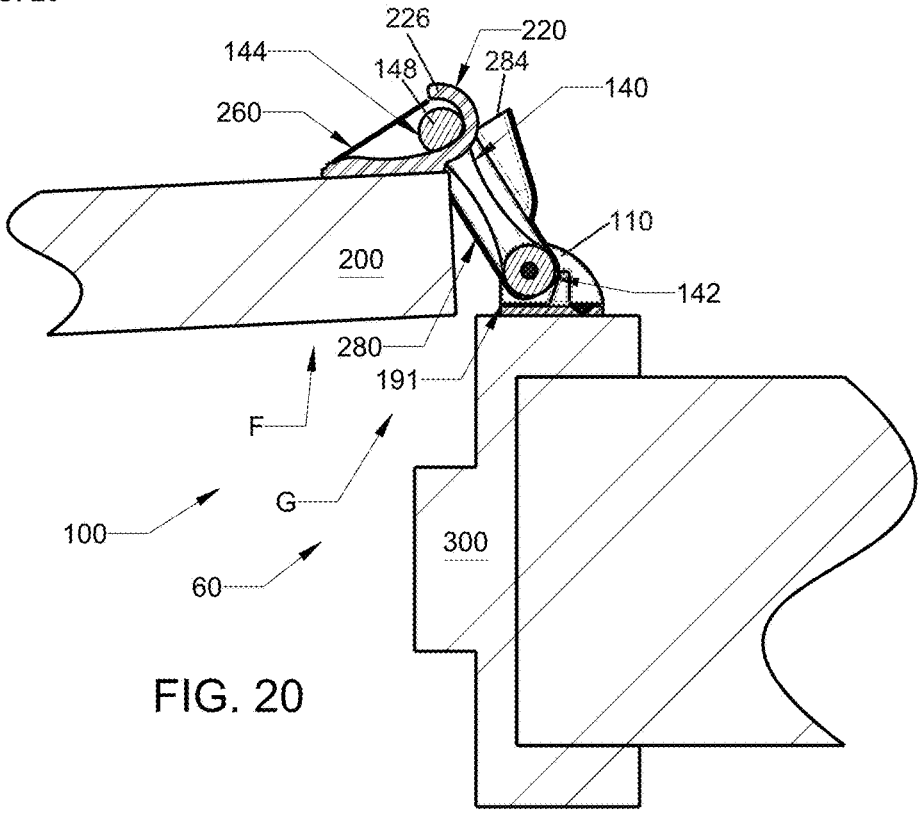
FIG. 20

FIG. 23
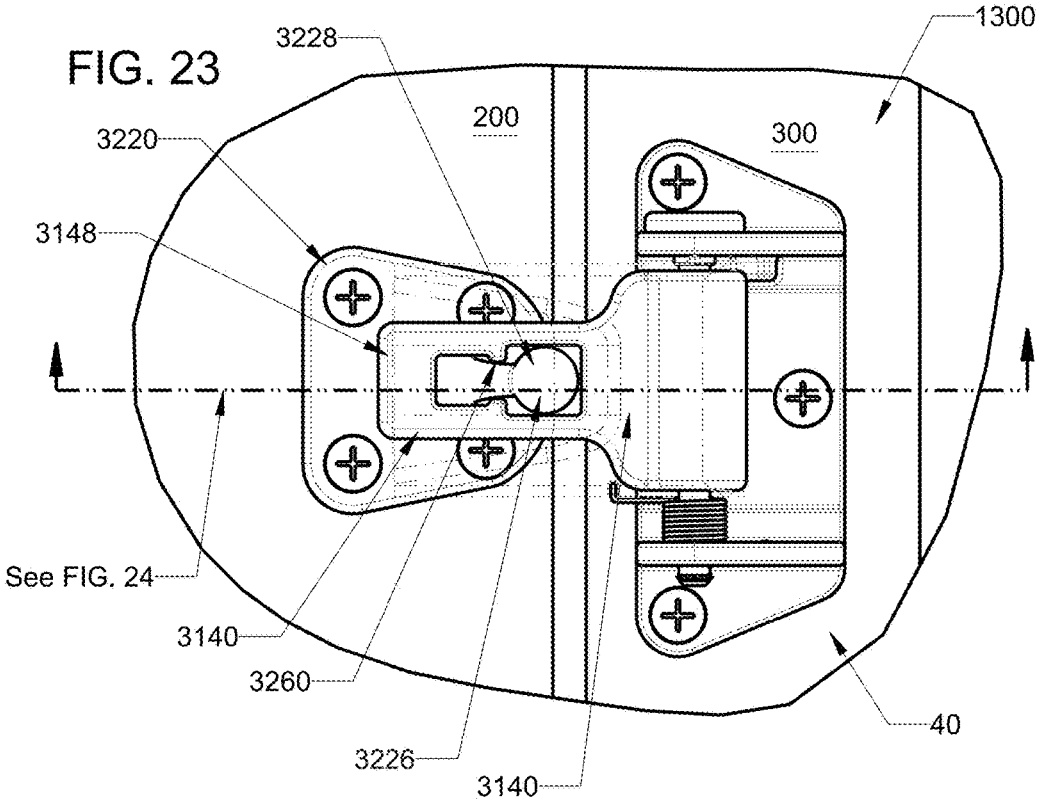
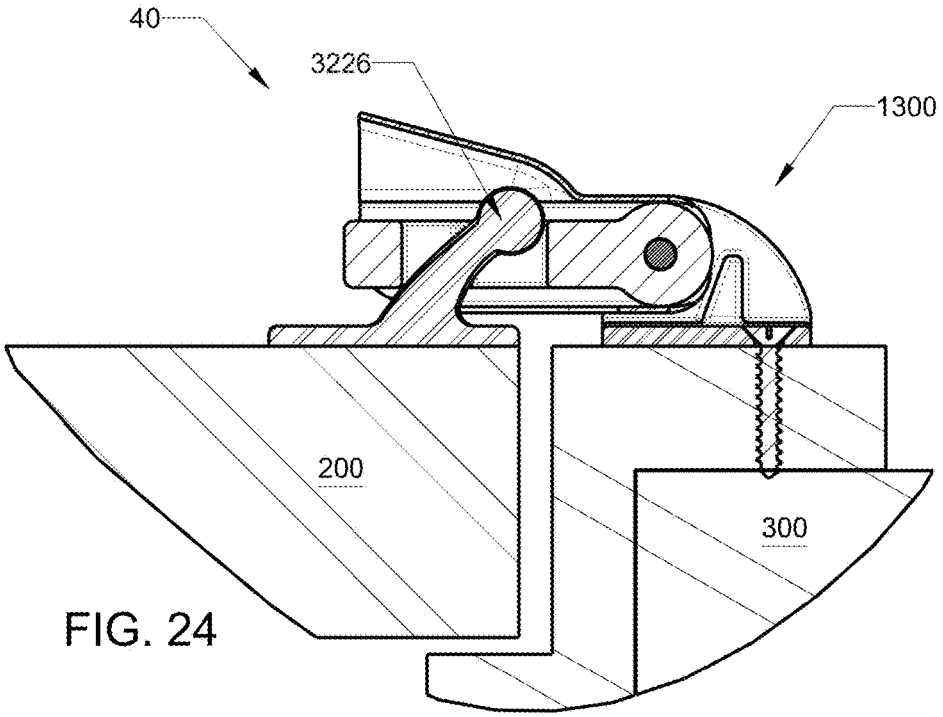
FIG. 24

FIG. 36
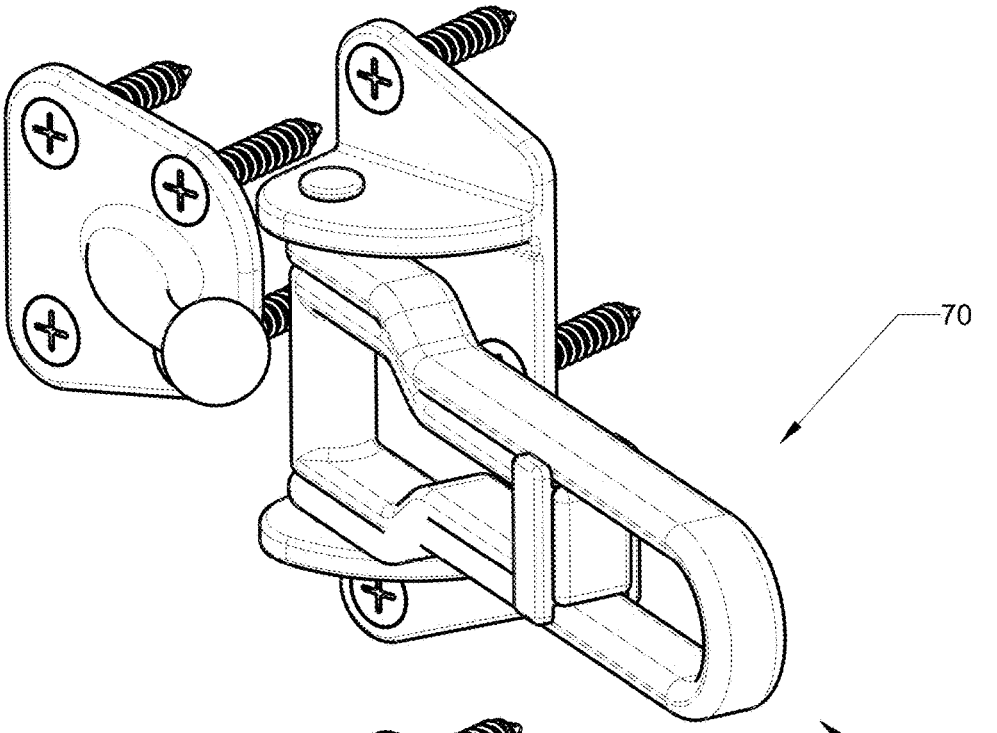
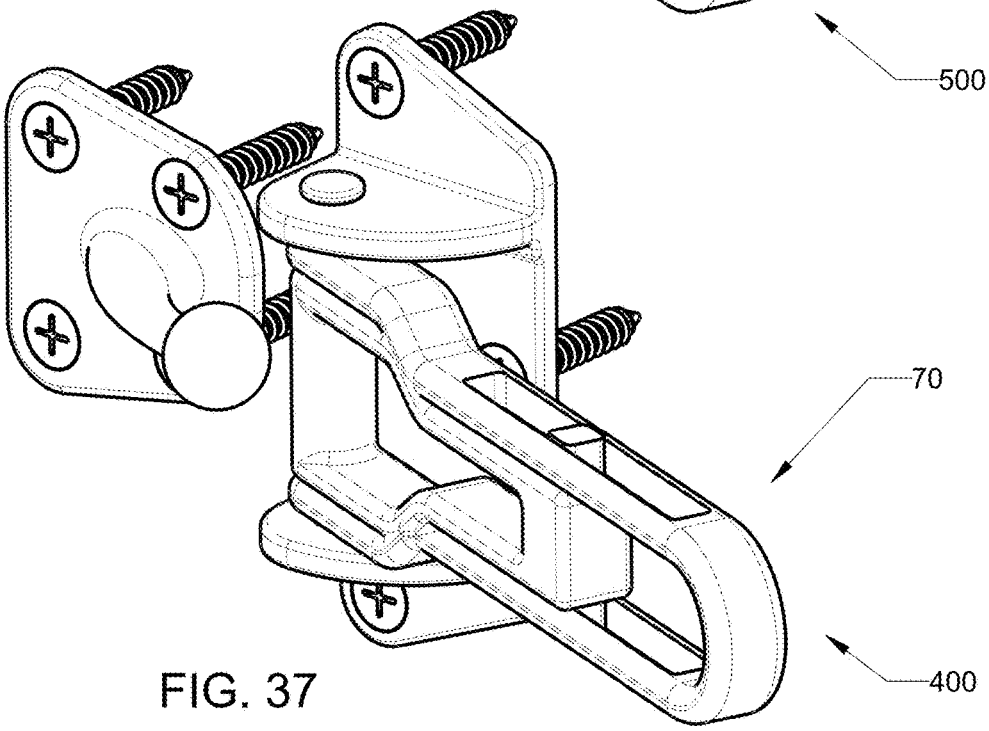
FIG. 37

FIG. 39
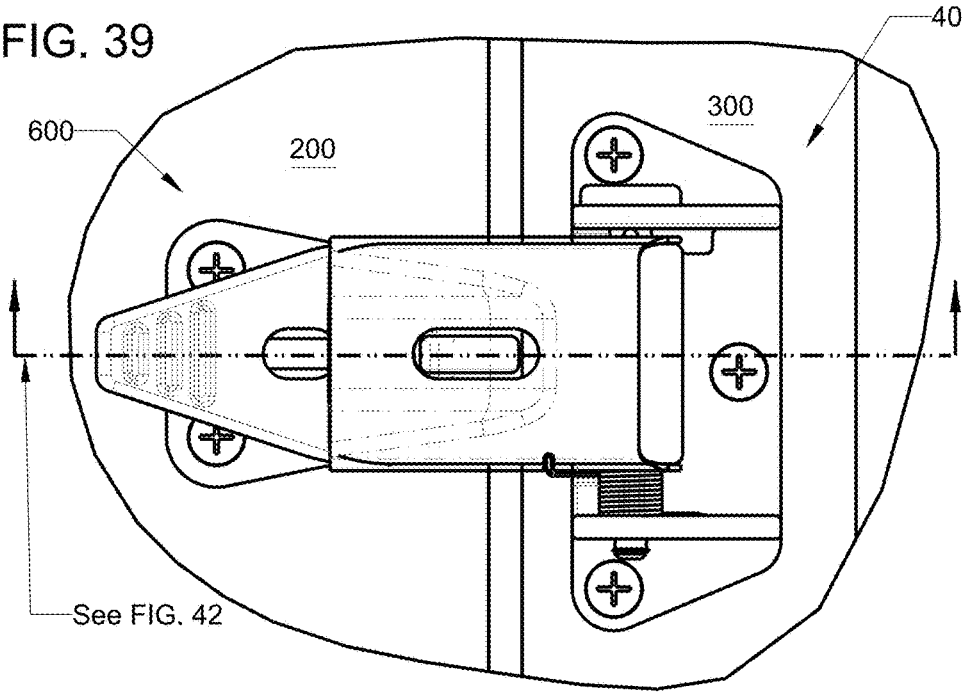
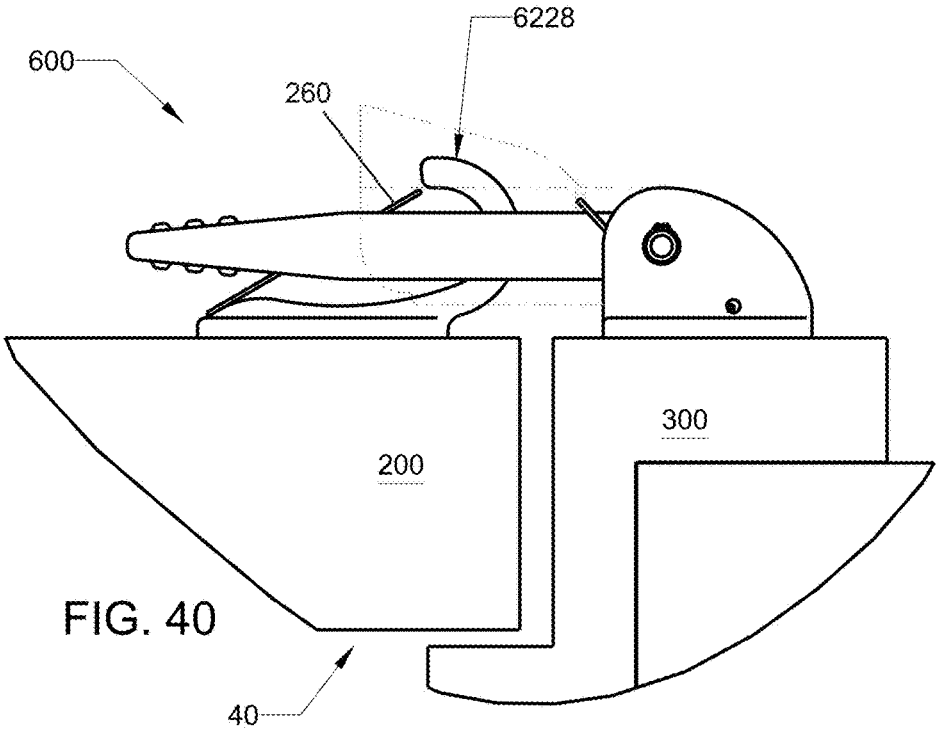
FIG. 40

FIG. 41
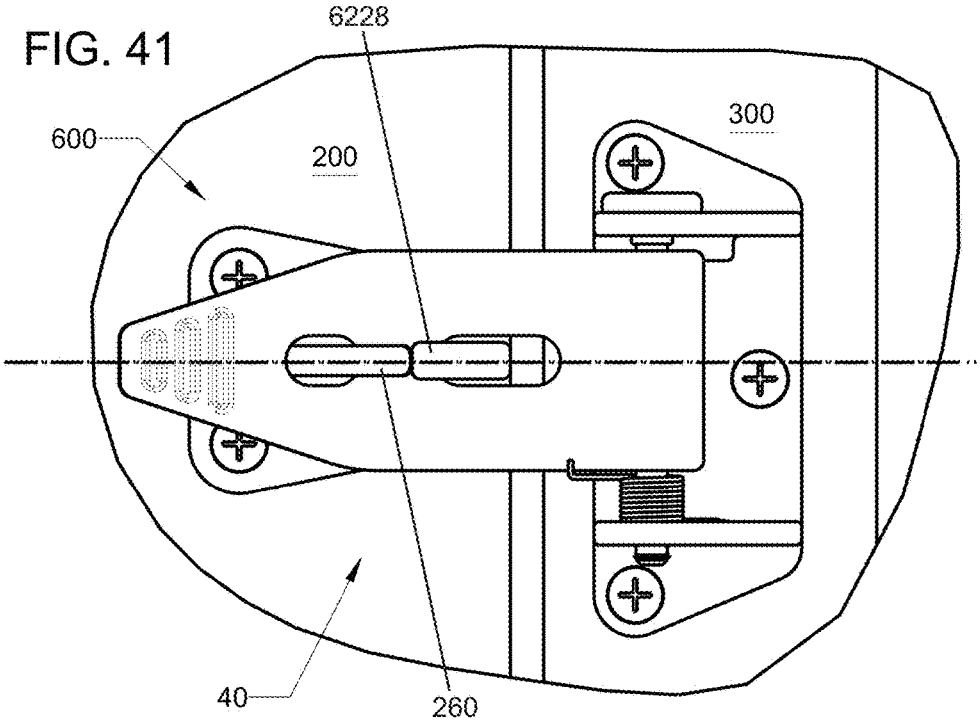
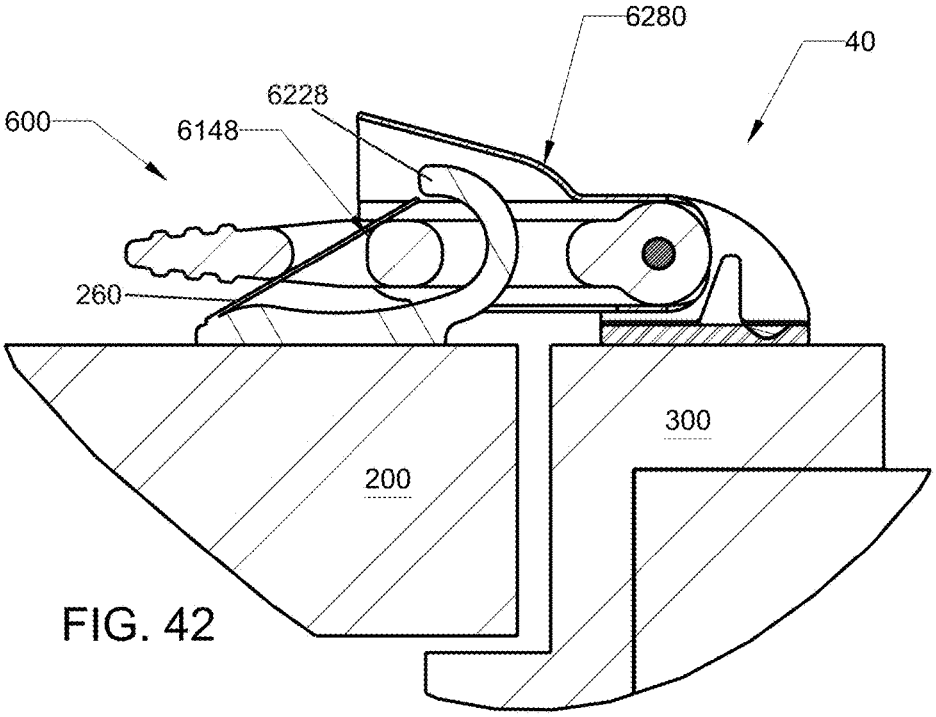
FIG. 42

FIG. 68
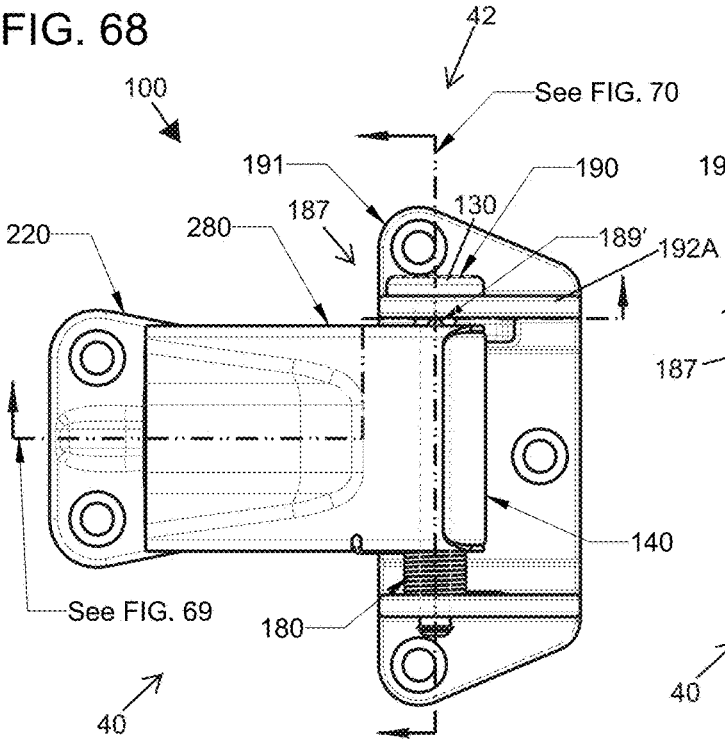
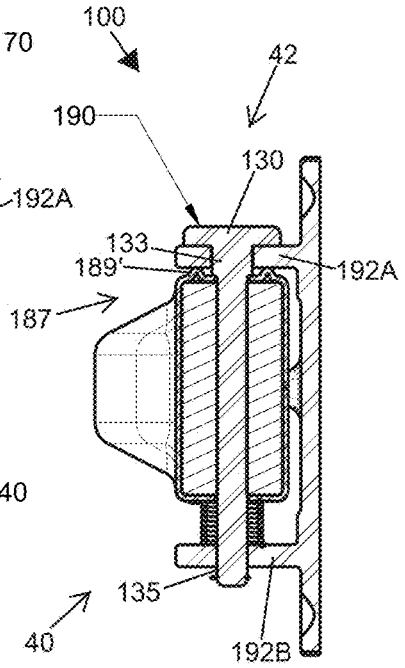
FIG. 70
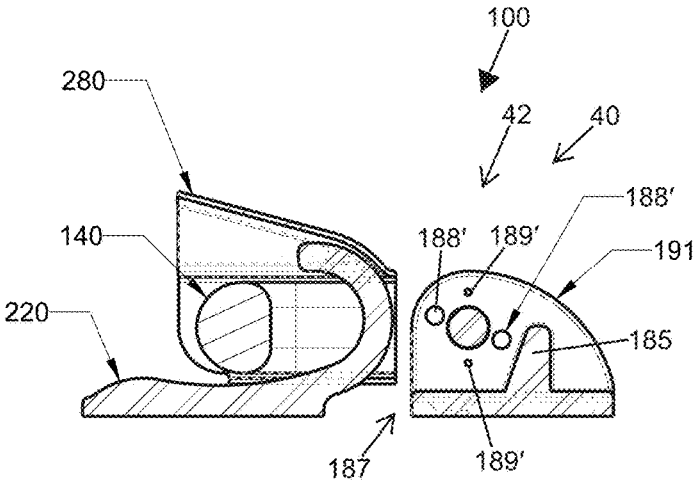
FIG. 69

FIG. 71
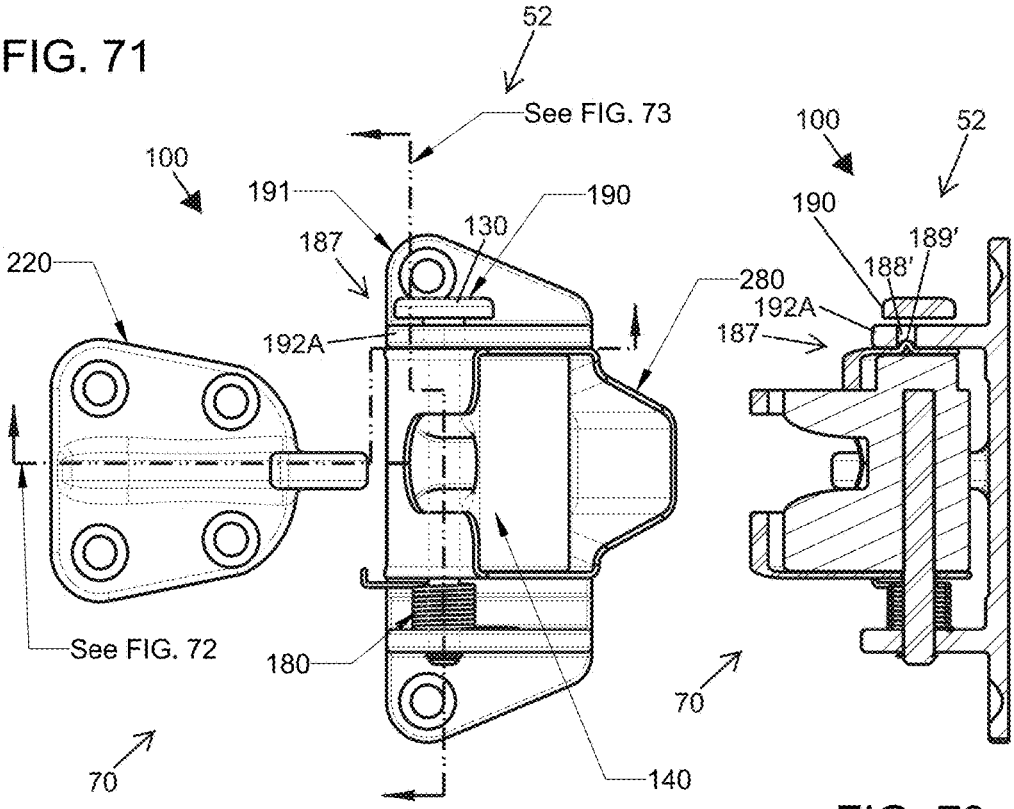
FIG. 73
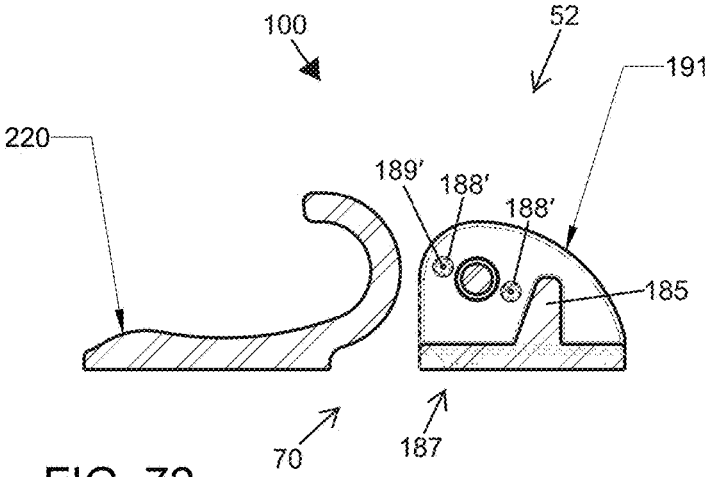
FIG. 72

FIG. 76
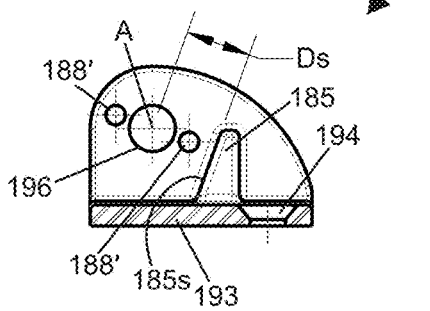
FIG. 78
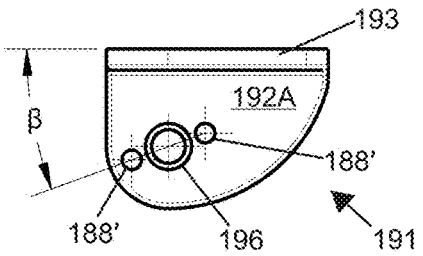
FIG. 74
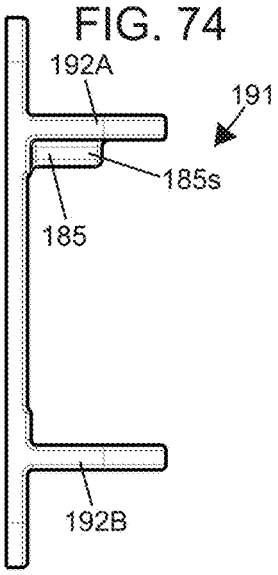
FIG. 75
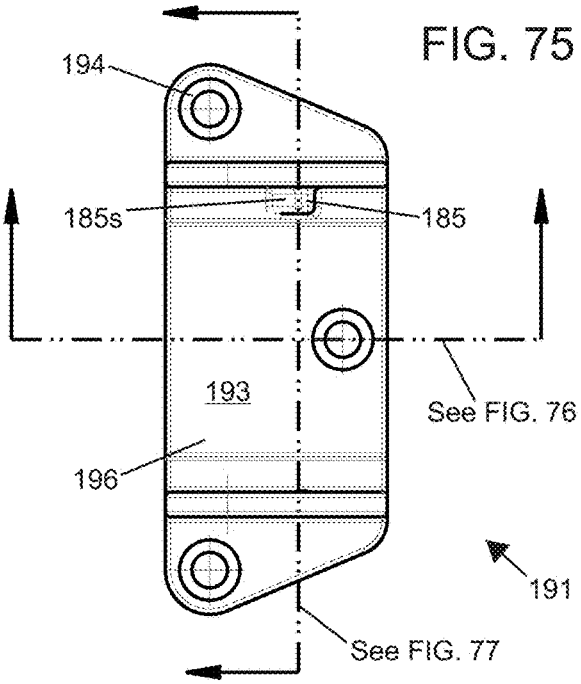
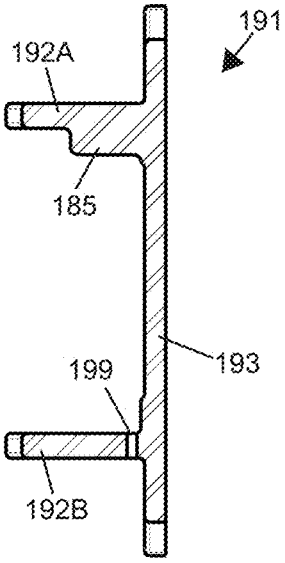
FIG. 77
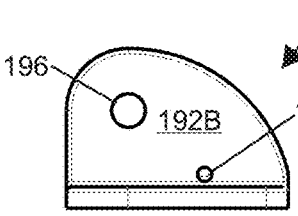
FIG. 79
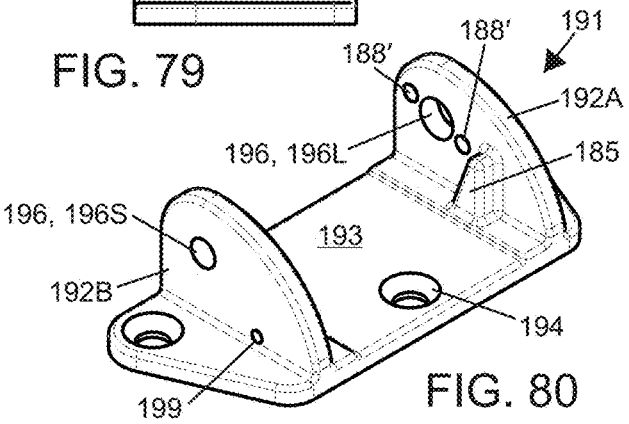
FIG. 80

FIG. 89
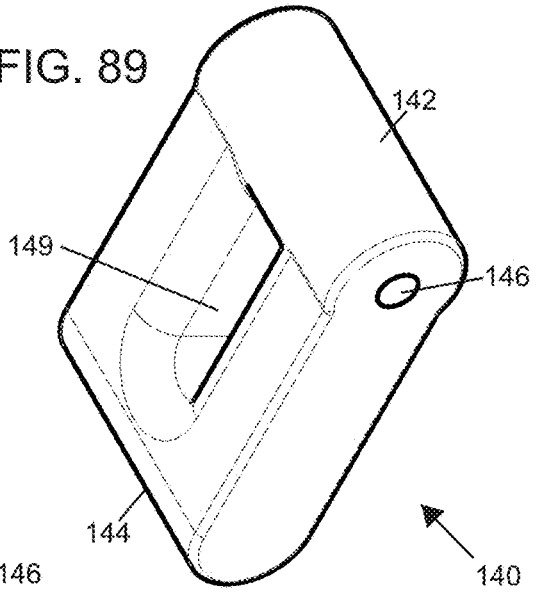
FIG. 86
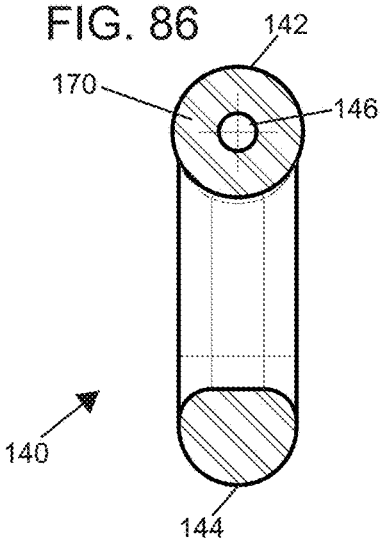
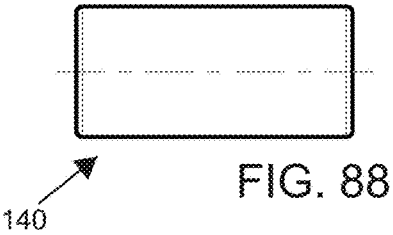
FIG. 88
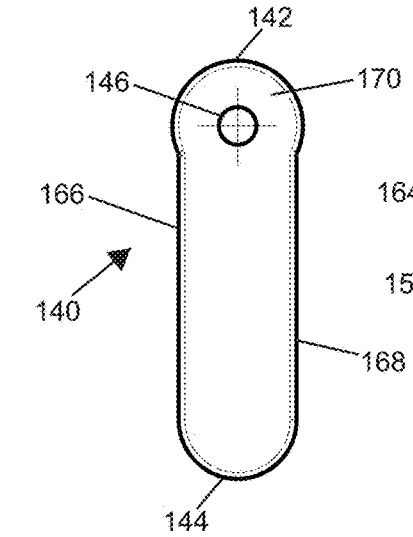
FIG. 87
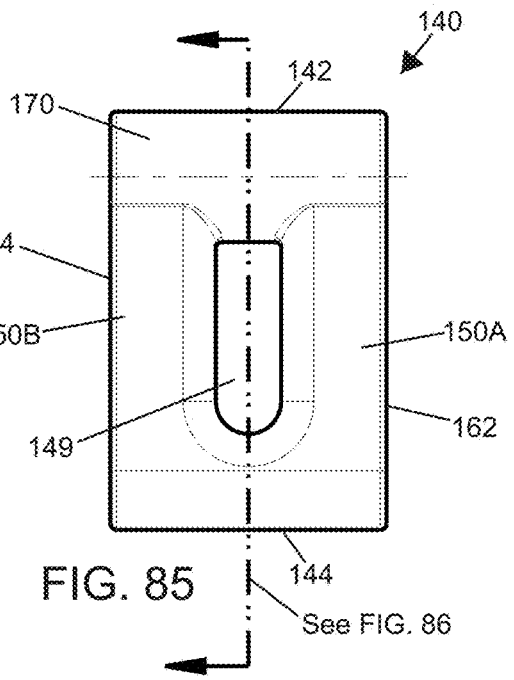
FIG. 85

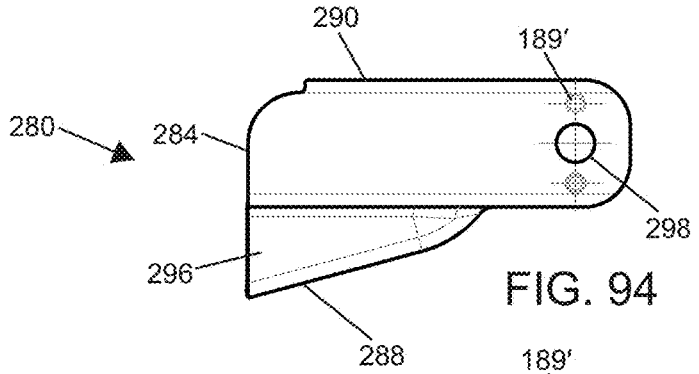
FIG. 94
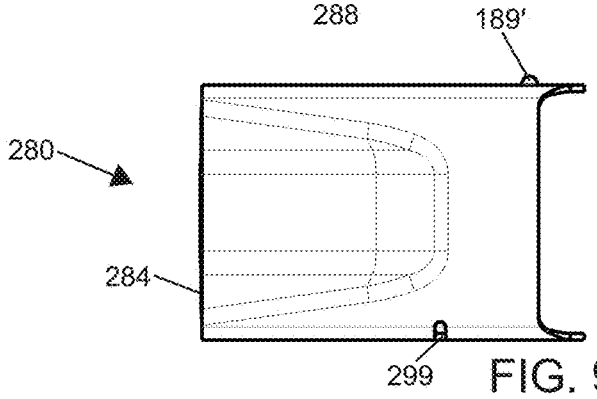
FIG. 93
FIG. 91
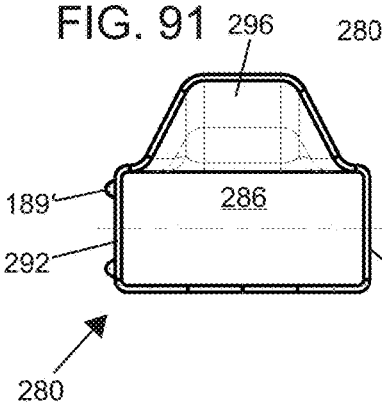
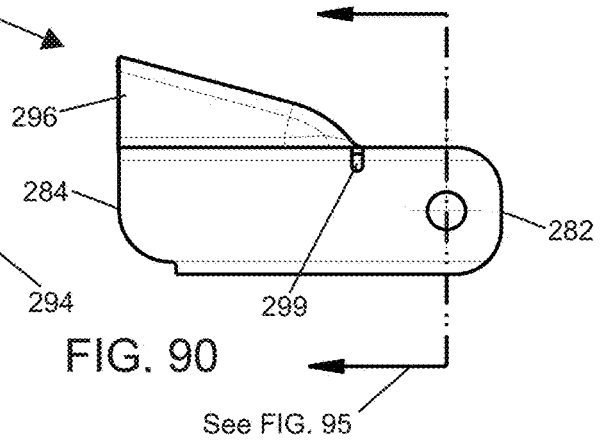
FIG. 90
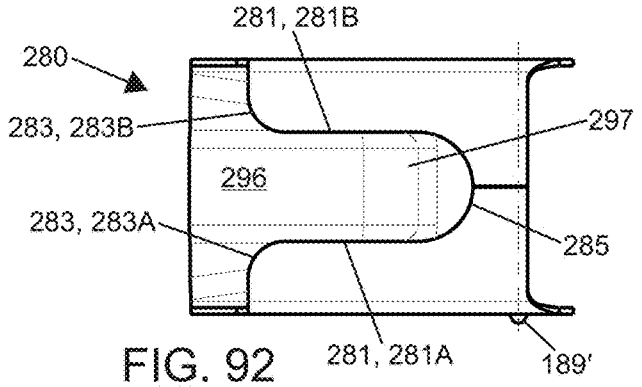
FIG. 92

ENERGY ABSORBING LATCH SYSTEMS AND METHODS

CROSS REFERENCE TO RELATED APPLICATIONS

The present application claims the benefit of U.S. Provisional Patent Application Ser. No. 61/782,708, filed Mar. 14, 2013, and Ser. No. 61/880,977, filed Sep. 22, 2013, both entitled ENERGY ABSORBING LATCH SYSTEMS AND METHODS, the disclosures of which are hereby incorporated by reference in their entireties.

BACKGROUND

Exterior doors of homes, office buildings, hotels, apartment buildings, etc. are typically equipped with some means (e.g., a door lock) of securing entry into the building. Interior doors of such buildings may also be equipped with some means of securing the door. Such door lock apparatuses are typically rigid and mechanical and to some extent easily defeated by a sudden and forceful action, such as kicking or shouldering. An average adult male is capable of generating a significant amount of force over an effective area of the door lock while using a violent swift action directed at the door lock. In instances of forced entry through the door, the more direct a strike is directed to the door lock, the more successful a perpetrator is at defeating the door lock, typically.

SUMMARY

According to certain aspects of the present disclosure, a door securing device is adapted to resist significant opening of a door when set to an engaged configuration and is also adapted to allow opening of the door when set to a disengaged configuration. The door securing device includes a base member, a deformable member, a configuration joint, and a catch member. The base member includes a base end and a first joint portion. The deformable member extends along a length between a first end and a second end. The first end includes a second joint portion, and the second end includes a catching portion. The configuration joint is adapted to configure the door securing device in the engaged configuration and is also adapted to configure the door securing device in the disengaged configuration. The configuration joint includes the first joint portion of the base member and the second joint portion of the deformable member. The catch member includes a base end and a catch. The catch is adapted to engage the catching portion of the deformable member, at least when the door securing device is resisting the significant opening of the door. The deformable member is adapted to deform and thereby increase the length of the deformable member at least five percent when resisting the significant opening of the door.

In certain embodiments, the base end of the base member is adapted to mount to a door frame and the base end of the catch member is adapted to mount to a door. The base end of the base member may include at least one fastener hole, and the base end of the catch member may include at least one fastener hole. The base end of the base member may be adapted to be mounted to the door frame with door frame fasteners positioned through the fastener holes of the base member. The base end of the catch member may be adapted to be mounted to the door with door fasteners positioned through the fastener holes of the catch member.

In certain embodiments, the configuration joint is a rotatable joint. The rotatable joint may include at least one hole in the first joint portion of the base member, at least one hole in the second joint portion of the deformable member, and a pin positioned within the holes. The door securing device may further include a spring that urges the deformable member to rotate about an axis of the pin and thereby urges the door securing device toward the engaged configuration. The catch may include a hook. The catching portion may include a loop.

In certain embodiments, the door securing device further includes a shield that is positioned at least partly around the deformable member at least when the door securing device is in the engaged configuration. The shield is adapted to resist cutting and thereby protects the deformable member from the cutting. The length of the deformable member may be free to increase with respect to the shield. The shield may or may not substantially resist the significant opening of the door. The shield may be pivotally mounted to the base member. The rotatable joint may define an axis. The shield may be pivotally mounted to the base member at a pivoting joint that is co-axial with the axis of the rotatable joint. The door securing device may further include a torsion spring that is adapted to urge the deformable member and/or the shield to rotate about the axis of the rotatable joint and thereby urge the door securing device toward the engaged configuration. In certain embodiments, the shield includes a finger pocket that is adapted to facilitate a finger to overcome the torsion spring and thereby position the door securing device in the disengaged configuration. The door securing device may further include a detent that is adapted to resist the torsion spring and thereby retain the door securing device in the disengaged configuration when the detent is engaged.

In certain embodiments, the door securing device further includes a keeper that is adapted to retain the door securing device in the engaged configuration when the door is exposed to alternating loads.

According to other aspects of the present disclosure, a door securing device includes a disengaged configuration, an engaged configuration, an armed configuration, a base member, a deformable member, a configuration joint, and a catch member. The disengaged configuration is adapted to allow opening of a door. The engaged configuration is adapted to resist the opening of the door beyond a predetermined opening of the door. The armed configuration is adapted to automatically transition to the engaged configuration upon the opening of the door reaching the predetermined opening and is adapted to manually transition to the disengaged configuration upon operator manipulation. The base member includes a base end and a first joint portion. The deformable member extends along a length between a first end and a second end. The first end includes a second joint portion, and the second end includes a catching portion. The configuration joint is adapted to configure the door securing device in the disengaged configuration, is adapted to configure the door securing device in the engaged configuration, and is adapted to configure the door securing device in the armed configuration. The configuration joint includes the first joint portion of the base member and the second joint portion of the deformable member. The catch member includes a base end and a catch. The catch is adapted to engage the catching portion of the deformable member, at least when the opening of the door is beyond the predetermined opening of the door. The deformable member is adapted to hyperelastically deform and thereby increase the length of the deformable member when resisting the opening of the door beyond the predetermined opening of the door.

In certain embodiments, the door securing device further includes a keeper that is adapted to retain the door securing device in the engaged configuration when the door is exposed to alternating loads. The keeper may or may not retain the door securing device in the armed configuration. The catching portion may include an end loop that may be trapped by the keeper when the door securing device automatically transitions from the armed configuration to the engaged configuration, upon the opening of the door reaching the predetermined opening. The door securing device may be manually transitioned to the disengaged configuration from the engaged configuration by the operator manipulation of the keeper.

Still other aspects of the present disclosure are directed to a door securing device that is adapted to resist significant opening of a door when set to an engaged configuration and that is also adapted to allow opening of the door when set to a disengaged configuration. The door securing device includes a base member, a deformable member, a rotatable joint, and a catch member. The base member includes a base end and a first joint portion. The deformable member extends along a length between a first end and a second end. The first end includes a second joint portion, and the second end includes a catching portion. The rotatable joint is adapted to configure the door securing device in the engaged configuration and also is adapted to configure the door securing device in the disengaged configuration. The rotatable joint includes the first joint portion of the base member and the second joint portion of the deformable member. The catch member includes a base end and a catch. The catch is adapted to engage the catching portion of the deformable member, at least when the door securing device is resisting the significant opening of the door. The deformable member is adapted to deform and thereby increase the length of the deformable member when resisting the significant opening of the door.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

FIG. 13 is a partial front elevation view of the deformable latch system of FIG. 1, shown in the disengaged configuration of FIG. 3 and installed on a door system;

FIG. 14 is a partial cross-sectional plan view of the deformable latch system, shown in the disengaged configuration of FIG. 3, and the door system of FIG. 13, as called out at FIG. 13;

FIG. 15 is the partial front elevation view of FIG. 13, but with the deformable latch system shown in the armed configuration of FIG. 2;

FIG. 16 is the partial cross-sectional plan view of FIG. 14, as called out at FIG. 15, with the deformable latch system shown in the armed configuration of FIG. 2;

FIG. 19 is the partial front elevation view of FIG. 13, but with the deformable latch system shown in an energy absorbing configuration;

FIG. 20 is the partial cross-sectional plan view of FIG. 14, as called out at FIG. 19, with the deformable latch system shown in the energy absorbing configuration of FIG. 19;

FIG. 23 is a partial front elevation view of still another deformable latch system according to the principles of the present disclosure, the deformable latch system illustrated with a covering shield in phantom line;

FIG. 24 is a partial cross-sectional plan view of the deformable latch system of FIG. 23, as called out at FIG. 23;

FIG. 36 is a perspective view of the deformable latch system of FIG. 30 in the disengaged configuration of FIG. 33;

FIG. 37 is a perspective view of the deformable latch system of FIG. 28 in the disengaged configuration of FIG. 33;

FIG. 39 is a partial front elevation view of the deformable latch system of FIG. 38 shown in an armed configuration, the deformable latch system illustrated with a covering shield in phantom line;

FIG. 40 is a partial plan view of the deformable latch system of FIG. 38 with the covering shield of FIG. 39 in phantom line;

FIG. 41 is a partial front elevation view of the deformable latch system of FIG. 38 illustrated without a shielding cover;

FIG. 42 is a partial cross-sectional plan view of the deformable latch system of FIG. 38, as called out at FIG. 39;

FIG. 68 is another front elevation view of the deformable latch system of FIG. 1 illustrating a detent in a disengaged configuration and a button head of a pin depressed, the deformable latch system shown in the armed configuration of FIG. 2;

FIG. 69 is a cross-sectional bottom plan view of the deformable latch system of FIG. 1, as called out at FIG. 68, illustrating a male member of the detent of FIG. 68 withdrawn from a female member of the detent;

FIG. 70 is a cross-sectional end elevation view of the deformable latch system of FIG. 1, as called out at FIG. 68, illustrating the male member of the detent of FIG. 68 withdrawn from the female member of the detent;

FIG. 71 is the front elevation view of FIG. 68, but with the detent in an engaged configuration and the button head of the pin un-depressed, the deformable latch system shown in the disengaged configuration of FIG. 3;

FIG. 72 is the cross-sectional bottom plan view of FIG. 69, as called out at FIG. 71, but illustrating the male member of FIG. 69 caught in the female member of FIG. 69;

FIG. 73 is a cross-sectional view, similar to the cross-sectional end elevation view of FIG. 70, as called out at FIG. 71, but illustrating the male member of FIG. 69 caught in the female member of FIG. 69;

FIG. 74 is an end elevation view of a base of the deformable latch system of FIG. 1;

FIG. 75 is a front elevation view of the base of FIG. 74;

FIG. 76 is a cross-sectional bottom plan view of the base of FIG. 74, as called out at FIG. 75;

FIG. 77 is a cross-sectional end elevation view of the base of FIG. 74, as called out at FIG. 75;

FIG. 78 is a top plan view of the base of FIG. 74;

FIG. 79 is a bottom plan view of the base of FIG. 74;

FIG. 80 is a perspective view of the base of FIG. 74;

FIG. 85 is a rotated front elevation view of a deformable member of the deformable latch system of FIG. 1;

FIG. 86 is a cross-sectional plan view of the deformable member of FIG. 85, as called out at FIG. 85;

FIG. 87 is a rotated plan view of the deformable member of FIG. 85;

FIG. 88 is a rotated end view of the deformable member of FIG. 85;

FIG. 89 is a perspective view of the deformable member of FIG. 85;

FIG. 90 is a plan view of a covering shield of the deformable latch system of FIG. 1;

FIG. 91 is a rotated end elevation view of the covering shield of FIG. 90;

FIG. 92 is a rear elevation view of the covering shield of FIG. 90;

FIG. 93 is a front elevation view of the covering shield of FIG. 90;

FIG. 94 is an opposite plan view of the covering shield of FIG. 90;

DETAILED DESCRIPTION

Figure 1:
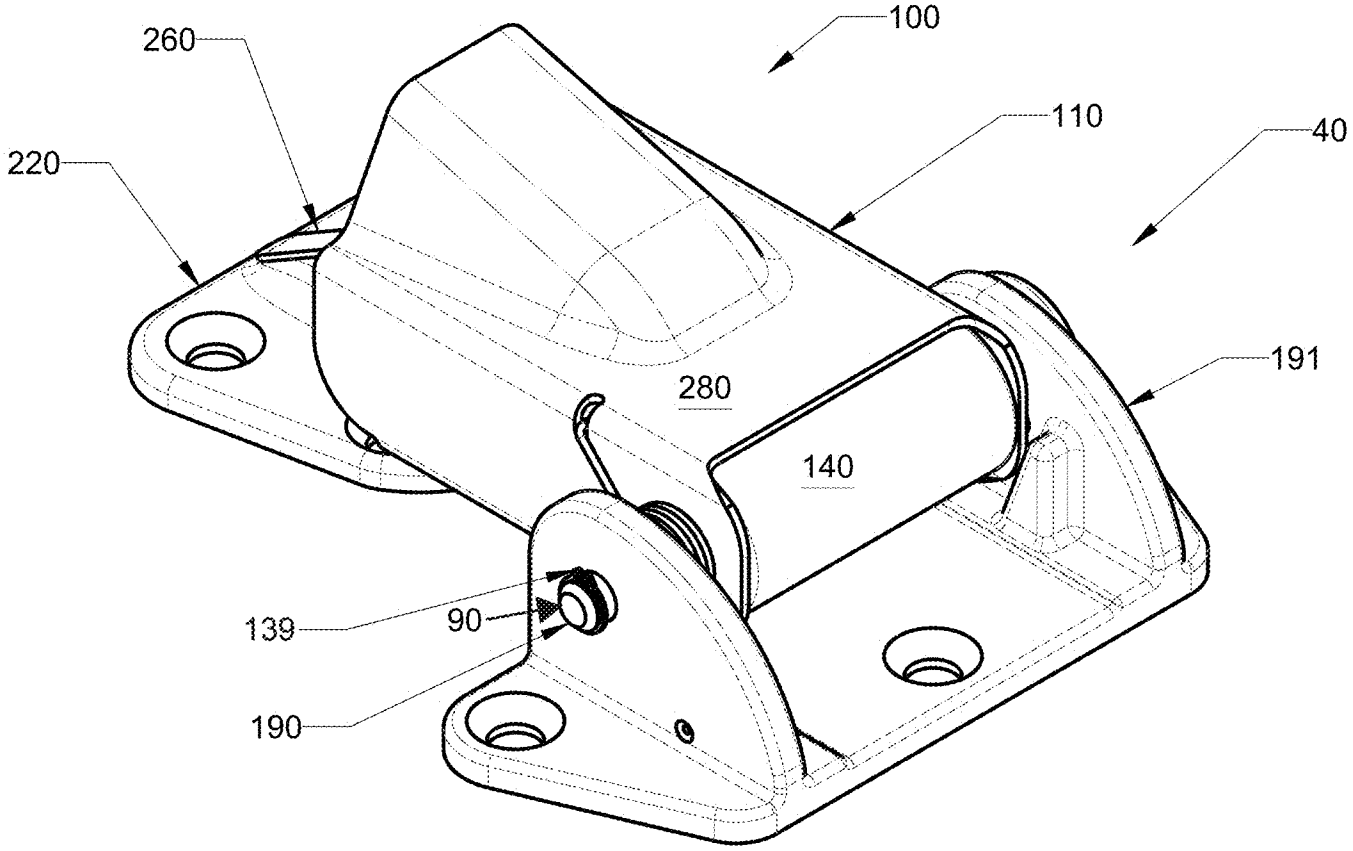
FIG. 1 is a perspective view of a deformable latch system according to the principles of the present disclosure.
Figure 2:
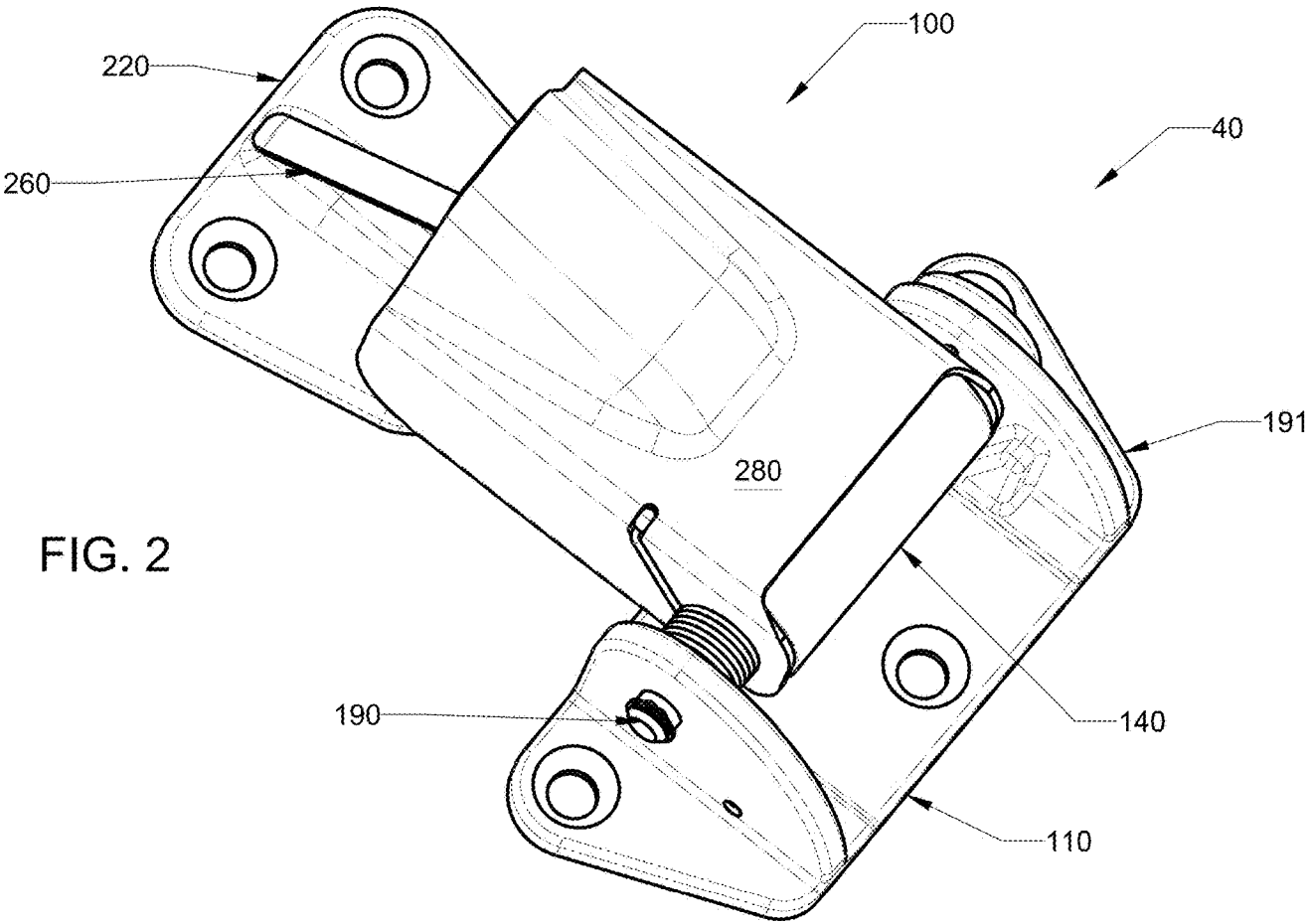
FIG. 2 is another perspective view of the deformable latch system of FIG. 1, shown in an armed configuration.
Figure 3:
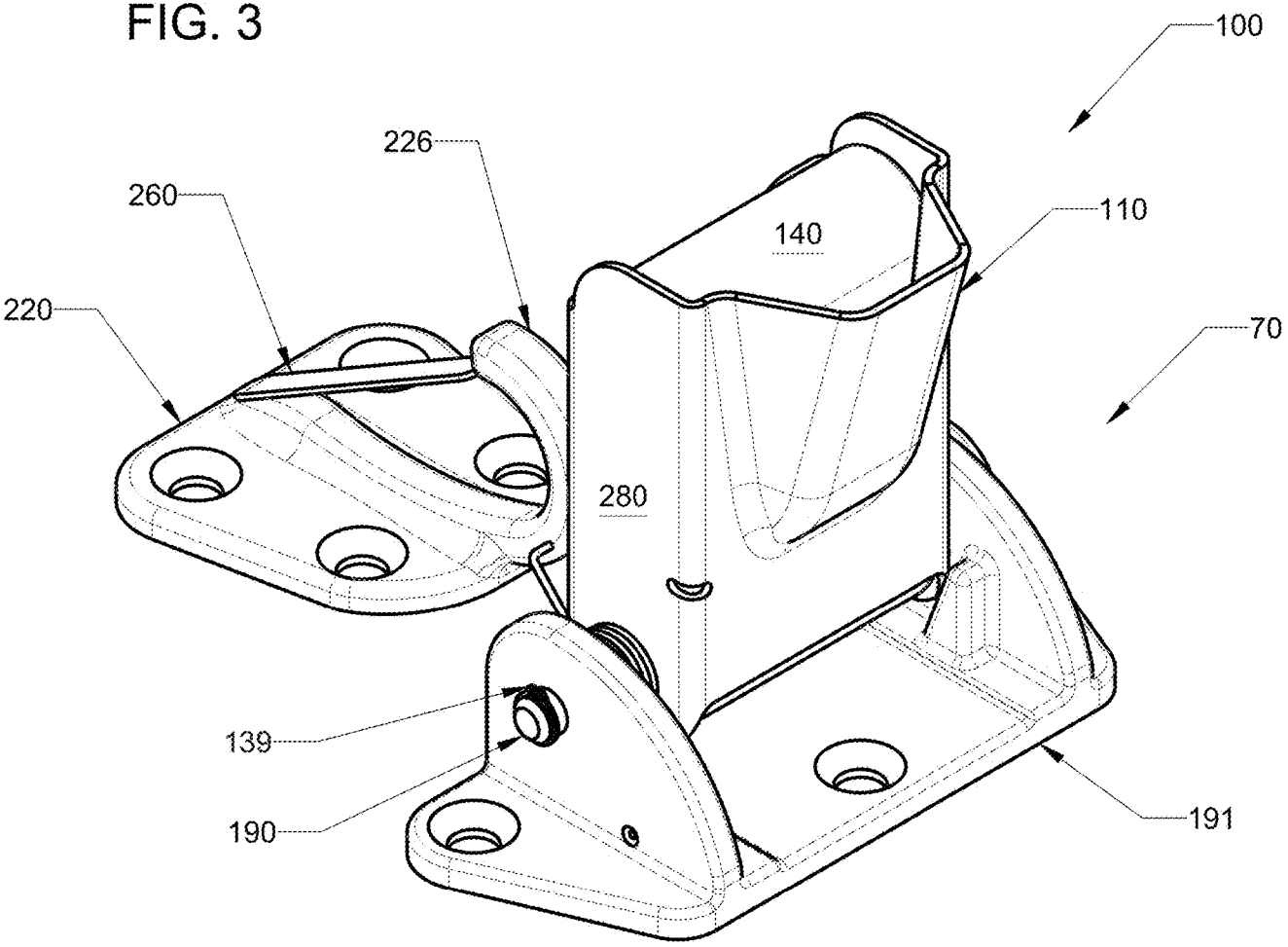
FIG. 3 is a perspective view of the deformable latch system of FIG. 1, shown in a disengaged configuration.

According to the principles of the present disclosure a deformable latch system 100, and in particular, a system including an energy absorbing member 140 (e.g., an energy absorbing loop) is effective at preventing entry through a door 200 by dynamic action that is applied to the door 200. Such dynamic action may include kicking with a foot, shouldering with a shoulder, and ramming with a police-style battering ram. In contrast, typical conventional latch systems and typical conventional bolt-style lock systems are susceptible to failure from application of such dynamic action, thereby allowing entry through the door.

In various embodiments, the energy absorbing member 140 may be made of various energy absorbing materials and/or deformable materials. The energy absorbing materials and/or the deformable materials may include energy absorbing plastics (e.g., polycarbonate, PVC, etc.), energy absorbing rubbers (neoprene, isoprene, etc.), energy absorbing composites, etc. In one embodiment, the energy absorbing member 140 includes 40 durometer EPDM. In another embodiment, the energy absorbing member 140 includes 50 durometer EPDM. In still another embodiment, the energy absorbing member 140 includes 55 durometer natural rubber.

The typical latch systems and the typical bolt-style lock systems are substantially inflexible and have minimal energy absorption qualities. Energy that is applied to the door by the dynamic action is concentrated upon a connection between a latch and a catch in the case of the typical latch system and is concentrated upon a connection between a deadbolt and strikeplate in the case of the typical bolt-style lock system. The typical latch system and the typical bolt-style lock system may be included on the same door and offer a modest amount of improvement in preventing entry as the dynamic action causes failure of both the typical latch system and the typical bolt-style lock system. The failure of the typical latch system and/or the typical bolt-style lock system may or may not occur from failure of the deadbolt and/or the strikeplate, in the case of the typical bolt-style lock system, and/or failure of the latch and/or the catch, in the case of the typical latch system. The failure of the typical latch system and/or the typical bolt-style lock system may or may not occur from failure of connecting structure (e.g. the door, a connection between the door and the bolt-style lock system, a door frame, a connection between the door frame and the bolt-style lock system, a connection between the door and the latch system, a connection between the door frame and the latch system, etc.). As the typical latch system and the typical bolt-style lock system are substantially inflexible, the energy delivered by the dynamic action may result in impact of relatively short time duration and relatively high force levels. The high force levels may cause high stresses to develop in the above-mentioned parts and the high stresses may cause the failure.

In contrast, according to the principles of the present disclosure, the deformable latch system 100 includes the deformable member 140 that is substantially flexible. The energy delivered by the dynamic action may result in impact of relatively long time duration and relatively low force levels. The relatively low force levels may result in lower stresses developing in corresponding parts and the lower stresses may be below a failure point. In addition, the deformable member 140 absorbs the energy delivered by the dynamic action and may dissipate the energy as heat.

The deformable latch system 100 is therefore a device designed to absorb and thwart the concentrated energy of an attempted forced entry through the door 200 or a similar access point. When a perpetrator places a sudden force onto the door, the substantially rigid mechanisms of the typical latch system and/or the typical bolt-style lock system designs often fail due to their inability to absorb the energy. The deformable latch system 100 will, in most cases absorb the energy and return the door 200 to its original position. In cases where there are only substantially rigid mechanisms, repeated blows often weaken (e.g., fatigue, cause crack initiation and crack growth, etc.) the lock/latch assemblies and the door/door frame until a point of failure is reached. The deformable latch system's 100 energy absorption qualities continue to function after repeated blows.

Extensible material is used in the deformable member 140. In certain embodiments, the extensible material is neoprene and/or isoprene. As depicted, the extensible material may be formed into a loop 148 at a distal end 144 of the deformable member 140 (see FIG. 21). A proximal end 142 of the extensible material may be molded (e.g., solidly molded) to a metal (e.g., a steel) pivoting pin 190 secured by a base assembly or a single piece base 191 (e.g., a solid base) including two hinge components 192 (e.g., steel hinge components) that are located on opposing ends 190A, 190B of the pin 190. In certain embodiments, the pivoting pin 190 and the deformable member 140 may rotate and/or translated freely with respect to each other about an axis A (see FIG. 21). A spring 180 may be attached between the hinge components 192 and the deformable member 140 and thereby urge the loop 148 of the deformable member 140 to maintain contact with a catch assembly or a catch member 220 (e.g., a single piece catch) in a closed configuration 40 (i.e., a closed position, an armed configuration, etc.).

The catch member 220 is separate from a latch assembly 110 that contains the deformable member 140. The catch member 220 may be a single piece (e.g., a steel piece, a formed piece, a forged piece, and/or a solid piece, etc.) that includes a shaped catch 226. The catch member 220 may be secured directly to the door 200. The catch member 220 may be secured directly to the door 200 at a point close to an edge 202 (i.e., an end) of the door 200 and/or may be immediately adjacent to the latch assembly 110. The catch 226 may contain an area that is open in a shape of a hook and may be adapted to catch the loop 148 as the door 200 is forced open while the latch assembly 110 is in place. As a force F (see FIGS. 18 and 20) is exerted outward from the latch assembly 110, the flexible loop 148 makes contact with the catch 226 as the door 200 is attempted to be forced open. The energy from the sudden blow is expended, absorbed, and/or dissipated as the deformable material of the deformable member 140 is stretched. The stretching of the deformable material of the deformable member 140 may cause a recoiling effect and urge and/or force the door 200 back to its original position.

A clip 260 (e.g., a thin metal spring clip) may be included on the catch member 220. A function of the clip 260 begins once a first breach attempt occurs and the latch assembly 110 is engaged. The distal end 144 of the loop 148 of the deformable member 140 engages and is secured in the catch 226, and the clip 260 will not allow the loop 148 to be released from the catch 226 until an operator manually releases it. A purpose of retaining the loop 148 in the catch 226 is to thwart perpetrators who repeatedly apply dynamic action after the first breach attempt. The clip 260 allows the device 100 to remain in a securing position (i.e., configuration) and allows full engagement after the first breach attempt.

The deformable member 140 may be enclosed in a housing 280 (e.g. a metal housing, a steel housing, a tempered steel housing, etc.) that protects the deformable member 140 from being cut as the door 200 is forced open. If a perpetrator forces the deformable member 140 of the deformable latch system 100 to stretch and thereby creates a gap G (see FIG. 20) between the door 200 and a door frame 300, the housing 280 (i.e., the shield) will thwart efforts by the perpetrator to cut the deformable member 140 (e.g., with a cutting tool inserted through the gap G).

Turning now to FIGS. 21 and 85-89, the energy absorbing member 140 will be described in detail. The energy absorbing member 140 extends between the proximal end 142 and the distal end 144. A hole 146 may be included at or adjacent the proximal end 142. The hole 146 may pivotally mount on the pivoting pin 190, in certain embodiments. In other embodiments, the proximal end 142 may be molded directly over the pivoting pin 190. The hole 146 and/or the pivoting pin 190 define the axis A about which the energy absorbing member 140 may pivot. As depicted, the energy absorbing member 140 includes a pair of stretch elements 150. As depicted, a first stretch element 150A is at a first side 162 of the deformable member 140, and a second stretch element 150B is at a second side 164 of the deformable member 140. The stretch elements 150, 150A, 150B extend between the proximal end 142 and the distal end 144. At the distal end 144, the stretch elements 150, 150A, 150B may transition to the loop 148. As depicted, a pair of the stretch elements 150, 150A, 150B connect the proximal end 142 to the loop 148. In other embodiments, a single stretch element 150 may be used. In still other embodiments, more than two of the stretch elements 150 may connect the proximal end 142 to the loop 148 or an equivalent structure adapted to engage the catch member 220.

As depicted, the energy absorbing member 140 is made of a molded piece of energy absorbing material. The energy absorbing material of the energy absorbing member 140 may be seamless and/or continuous and/or monolithic. As depicted, the energy absorbing material of the energy absorbing member 140 is molded about the proximal end 142, the stretch elements 150, and the loop 148. In other embodiments, the energy absorbing material of the energy absorbing member 140 may be in the stretch elements 150 and may be distinct from the loop 148 and/or the proximal end 142. In still other embodiments, the energy absorbing material of the energy absorbing member 140 may be in the loop 148, and the loop 148 may connect to the proximal end 142 either directly or via connecting elements. In yet other embodiments, the energy absorbing material of the energy absorbing member 140 may be distinctly positioned at the proximal end 142. As depicted, the stretch elements 150A and 150B are positioned on opposite sides of an opening 149. The loop 148 may bound the opening 149 at a distal end of the opening 149. The opening 149 is adapted to be positioned over the catch 226 of the catch member 220 and thereby allow the energy absorbing member 140 to be freely placed in the closed configuration 40 (i.e., the armed configuration), thereby readying the loop 148 for engagement with the catch 226 of the catch member 220. The energy absorbing member 140 is further bound by a third side 166 and a fourth side 168. As depicted, the third side 166 and the fourth side 168 are substantially parallel to each other. As depicted, an enlarged area 170 may be included around the hole 146. As depicted, the enlarged area 170 is substantially cylindrical and concentric with the hole 146 and/or the pivoting pin 190.

Turning now to FIGS. 21 and 74-80, the base 191 will be described in detail. The base 191 includes a mounting flange 193 adapted to interface with a portion of the door frame 300 upon which the base 191 is mounted. As depicted, the mounting flange 193 includes fastener holes 194 adapted to receive fasteners that secure the base 191 to the portion of the door frame 300. As depicted, the mounting flange 193 includes a central portion 193C between the pair of hinge components 192 (i.e., mounting members). The mounting flange 193 further includes a first extension 193A and a second extension 193B that extend beyond the hinge components 192. As depicted a fastener hole 194 is included in the central portion 193C. A fastener hole 194 is also included on the extensions 193A and 193B of the mounting flange 193. The fastener holes 194 are staggered to provide structural stability to the base 191 and to distribute loads from the base 191 to the portion of the door frame 300.

The central portion 193C of the mounting flange 193 and the pair of hinge support components 192 may define a channel 195. The channel 195 may be adapted to receive the proximal end 142 of the energy absorbing member 140. In particular the first side 162 of the energy absorbing member 140 may engage a first side 192A of the hinge components 192, and a second side 192B of the hinge components 192 may engage the second side 164 of the energy absorbing member 140. As depicted, the channel 195 contains the energy absorbing member 140 between the first side 162 and the second side 164. Additional room may be provided between the first hinge component 192A and the second hinge component 192B to allow mounting of the spring 180, mounting of the housing 280, and/or operation of a detent 187 (described in detail below).

The base 191 further includes pivoting holes 196. In particular, a pair of the pivoting holes 196 are provided with a first pivoting hole 196 on the first hinge component 192A and a second pivoting hole 196 positioned on the second hinge component 192B. The pair of the pivoting holes 196 are substantially coaxial with each other and coaxial with the axis A, when the latch assembly 110 is assembled. As depicted, the pivoting pin 190 mounts within the pivoting holes 196. In certain embodiments, the pivoting pin 190 may rotate within the pivoting holes 196. In other embodiments, the pivoting pin 190 may be substantially rotationally fixed within the pivoting holes 196 and may instead rotate within the hole 146 of the energy absorbing member 140. In certain embodiments, the pivoting pin 190 may translate relative to the pivoting holes 196 about the axis A. In certain embodiments, the pivoting holes 196 may be substantially the same size. In other embodiments, the pivoting holes 196 may be of different sizes. For example, FIGS. 70 and 80 illustrate an embodiment where the first side 192A of the hinge components 192 includes a larger hole 196L as the hole 196, and where the second side 192B of the hinge components 192 includes a smaller hole 196S as the hole 196.

Figure 17:
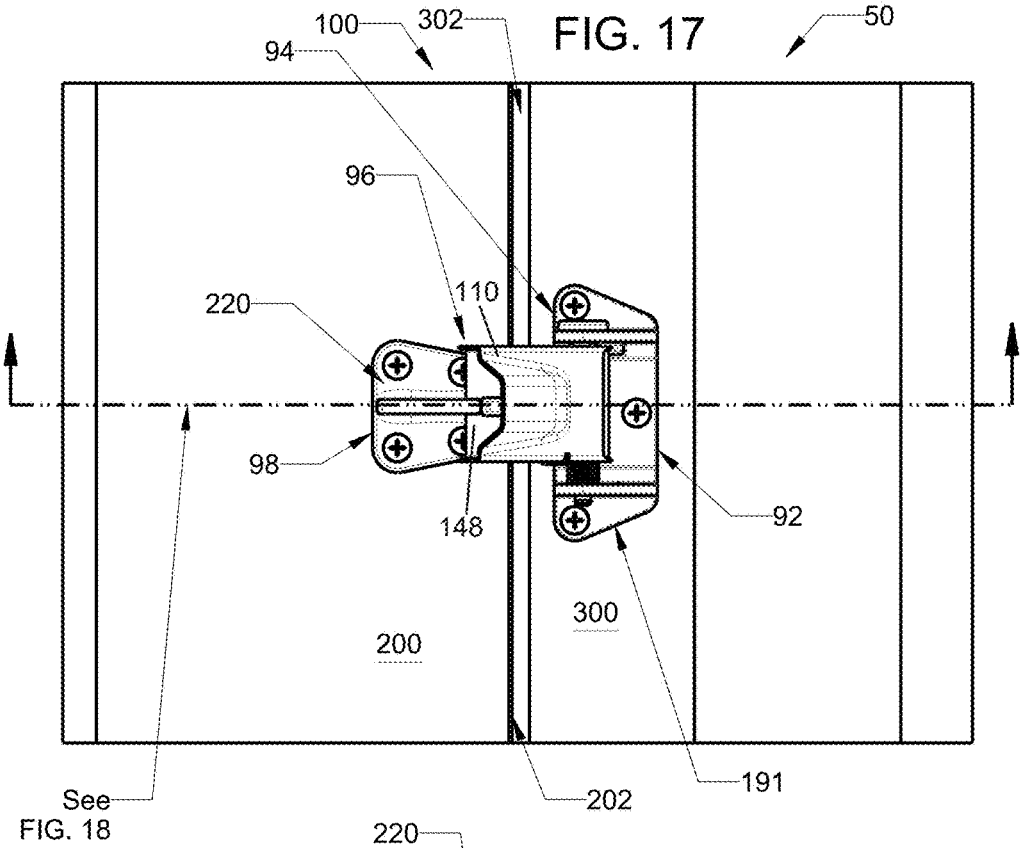
FIG. 17 is the partial front elevation view of FIG. 13, but with the deformable latch system shown in an engaged configuration.

As depicted, the hinge components 192 include a contour 197 opposite the mounting flange 193. The contour 197 may be provided for stylizing the deformable latch system 100. The contour 197 may further evenly distribute loads from the pivoting holes 196 to the mounting flange 193. The contour 197 may also serve to reduce snagging that may otherwise occur if someone's clothes brush up against the base 191. The extensions 193A, 193B may include a contour 198 and thereby define sides of the base 191. The contour 198 may promote even distribution of loads within the base 191. The base 191 may extend between a first station 92 and a second station 94. The first station 92 may thereby define a first end of the base 191 and the second station 94 may thereby define a second end of the base 191. As illustrated at FIG. 17, the station 94 of the base 191 may be positioned adjacent an edge 302 of the door frame 300. The station 92 of the base 191 may be positioned away from the edge 302 of the door frame 300.

Turning now to FIGS. 4, 21, and 90-97, the housing 280 will be described in detail. The housing 280 extends between a proximal end 282 and a distal end 284. A passage 286 extends between the proximal end 282 and the distal end 284 of the housing 280. The passage 286 may be adapted to allow a substantial portion of the energy absorbing member 140 to reside therein. The passage 286 allows the energy absorbing member 140 to deform and/or stretch therein. The housing 280 further defines a first side 288 and a second side 290 that may generally extend between the proximal end 282 and the distal end 284. The housing 280 further includes a third side 292 and a fourth side 294 that also generally extend between the proximal end 282 and the distal end 284. The first side 288 generally defines a first wall 289. The second side 290 generally defines a second wall 291. The third side 292 generally defines a third wall 293. And, the fourth side 294 generally defines a fourth wall 295. The passage 286 is formed by the walls 289, 291, 293, and 295. The walls 289, 291, 293, 295 may be seamlessly formed into a tubular structure. As depicted at FIGS. 21, 91, 92, and 95-97, a seam may be included at one or more of the walls 289, 291, 293, 295 (e.g., the wall 291, as shown). By including a seam, the housing 280 may be formed of sheet material (e.g., sheet metal). The seam may be left free or may be welded to form the tubular structure.

Figure 4:
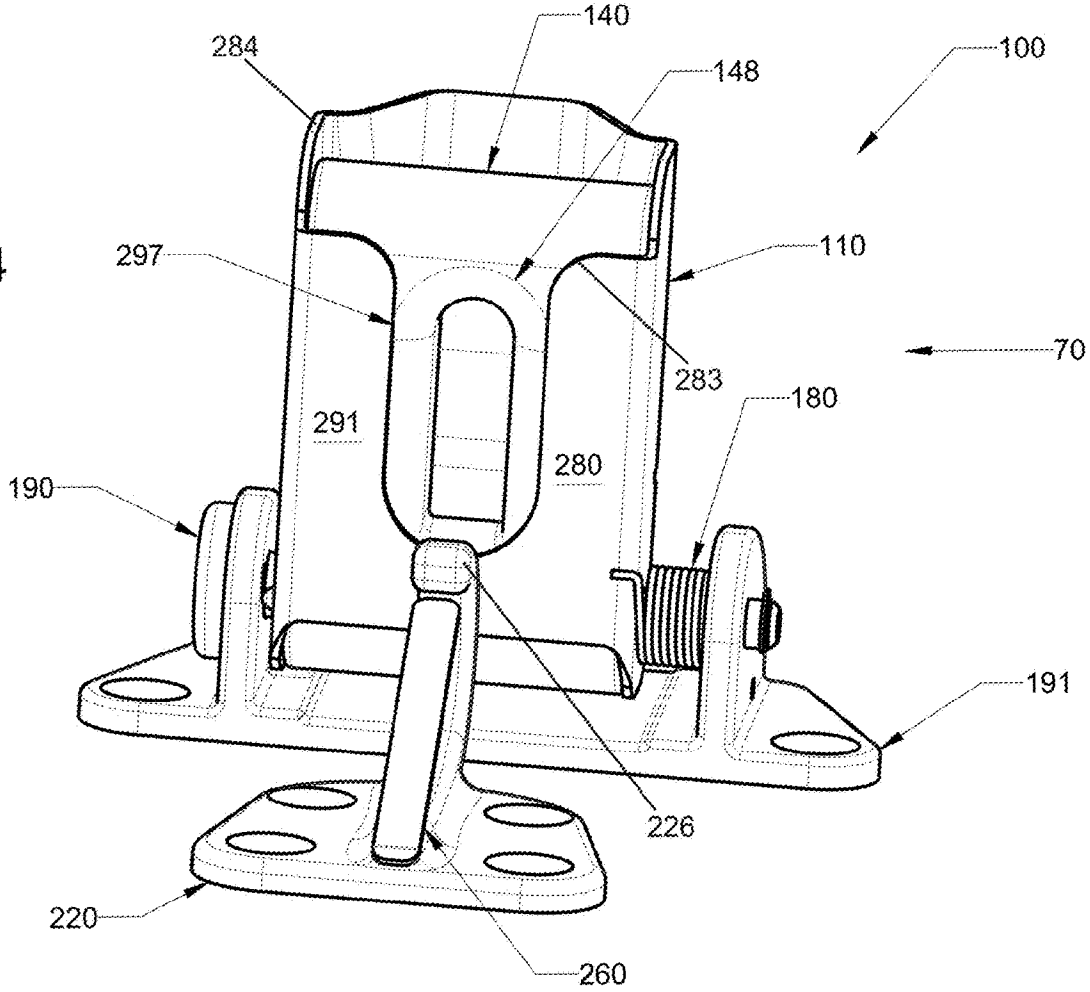
FIG. 4 is another perspective view of the deformable latch system of FIG. 1, shown in the disengaged configuration of FIG. 3.
Figure 7:
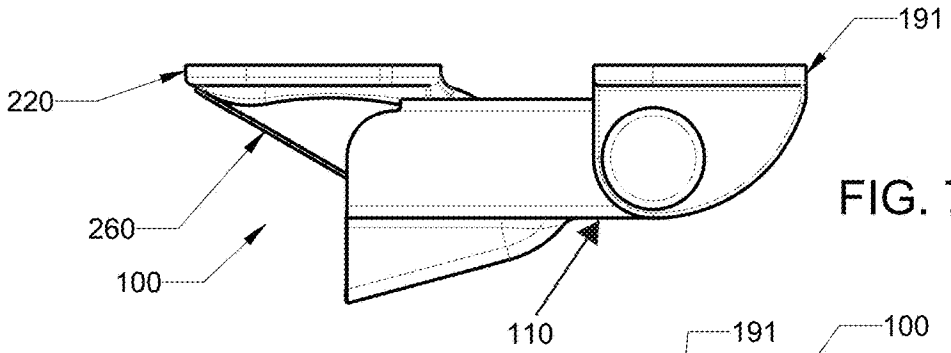
FIG. 7 is a top plan view of the deformable latch system of FIG. 1.
Figure 9:
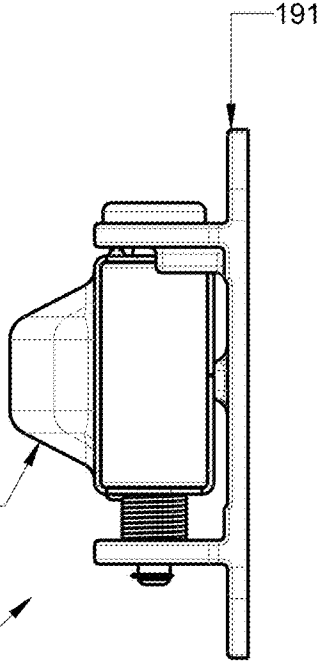
FIG. 9 is an end elevation view of the deformable latch system of FIG. 1.
Figure 5:
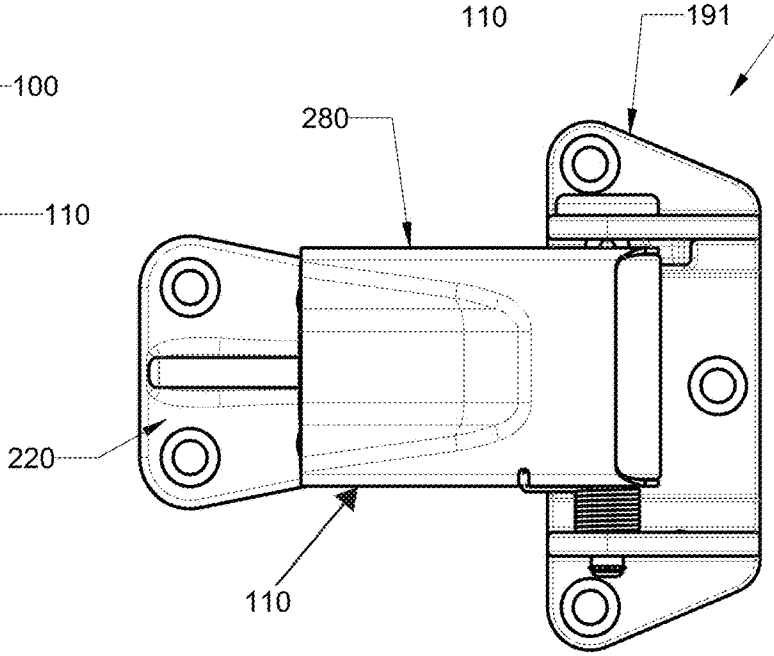
FIG. 5 is a front elevation view of the deformable latch system of FIG. 1.
Figure 11:
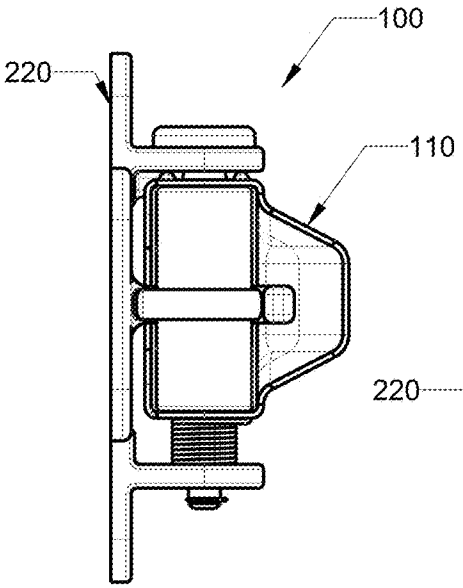
FIG. 11 is an opposite end elevation view of the deformable latch system of FIG. 1.
Figure 6:
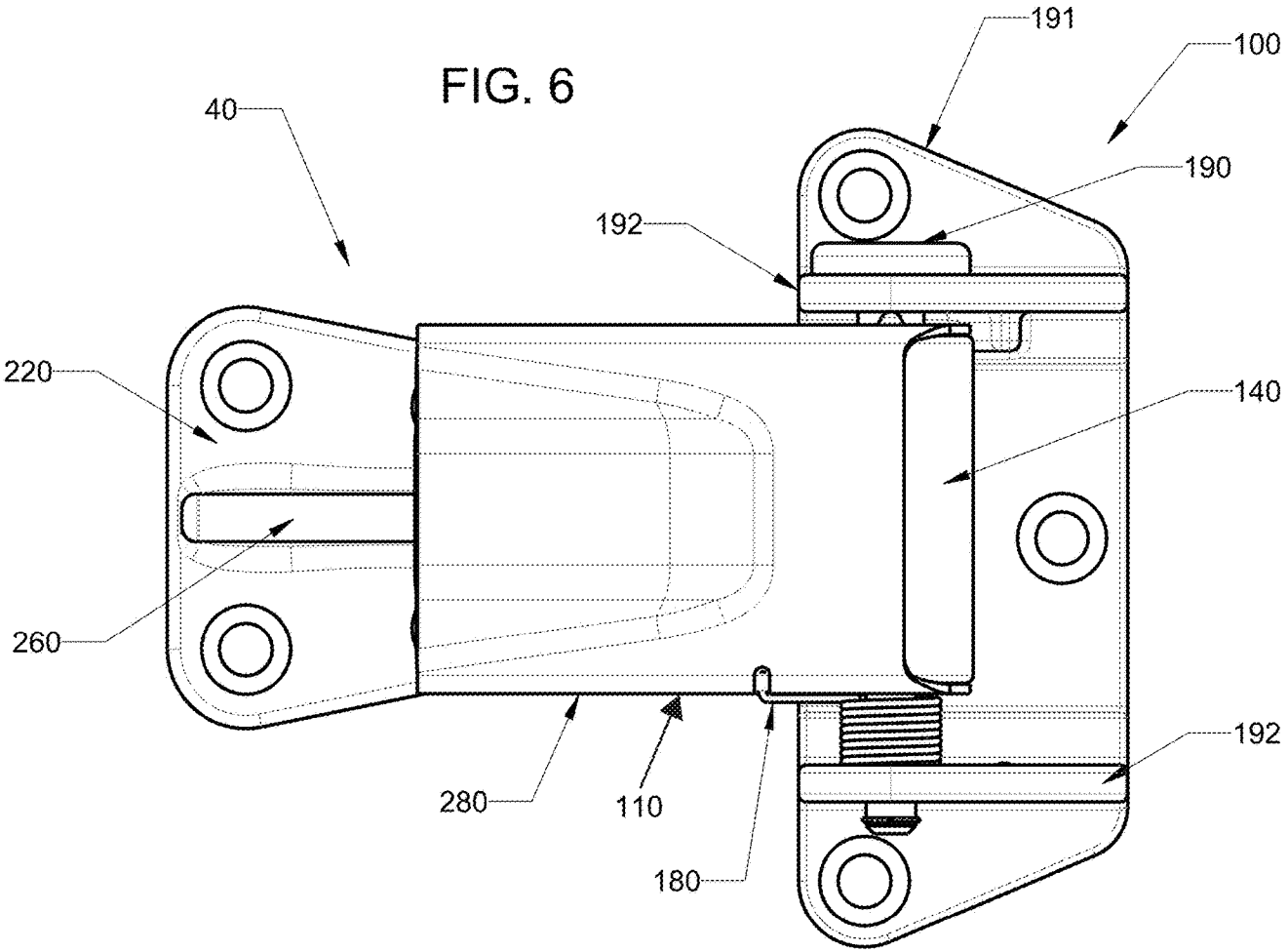
FIG. 6 is an enlarged view of FIG. 5.
Figure 8:
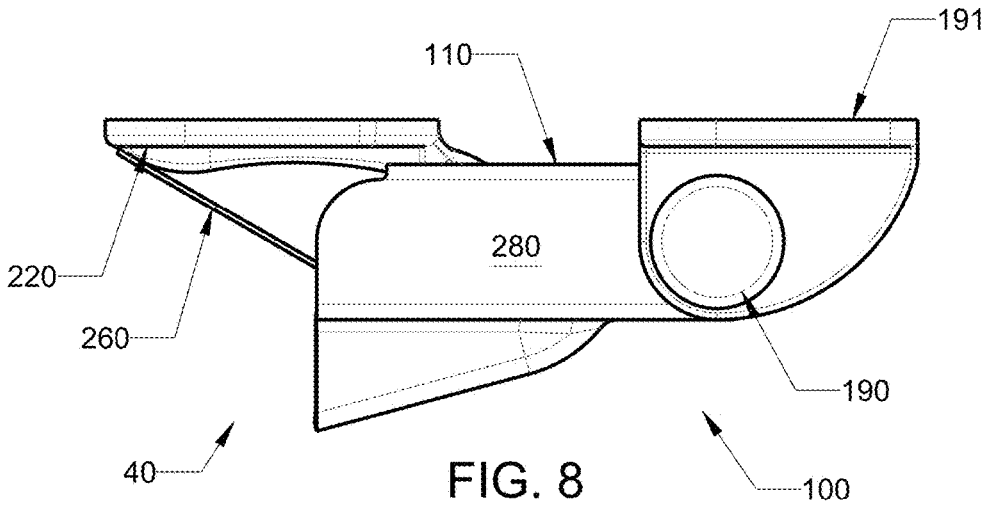
FIG. 8 is an enlarged view of FIG. 7.
Figure 12:
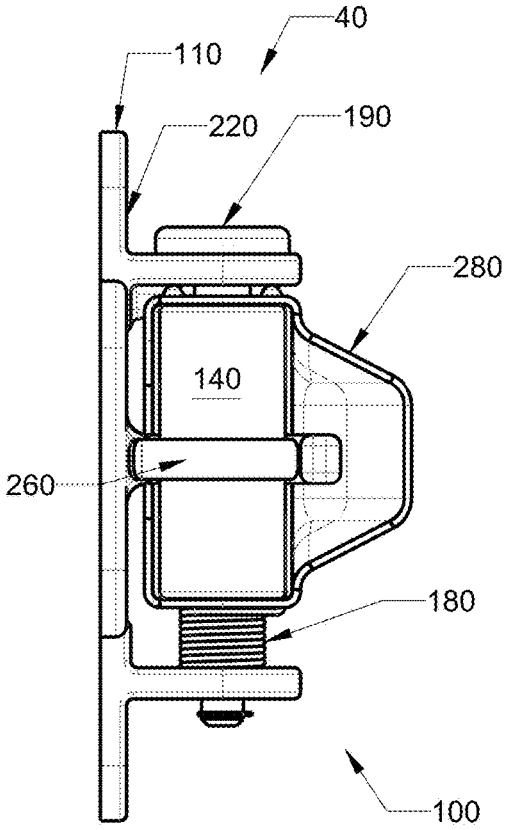
FIG. 12 is an enlarged view of FIG. 11.
Figure 10:
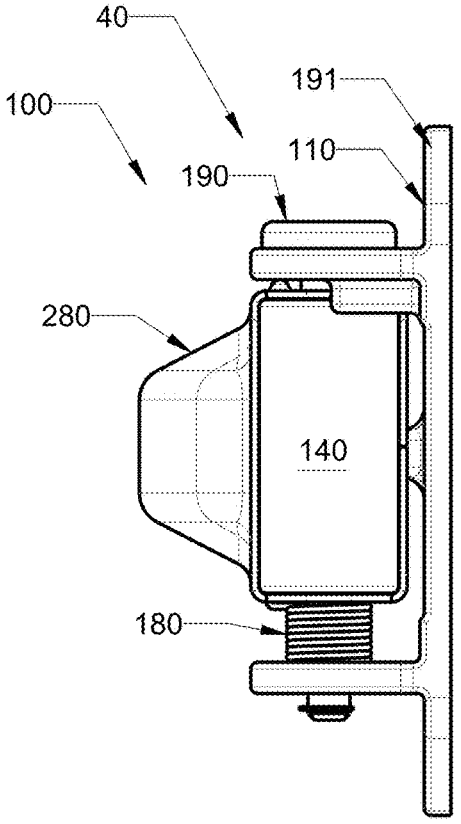
FIG. 10 is an enlarged view of FIG. 9.

The first wall 289 may include a finger catch 296. The finger catch 296 may allow an operator's finger to lift the housing 280 and thereby rotate the housing 280 about the axis A. By rotating the housing 280 about the axis A, the energy absorbing member 140 may also rotate about the axis A. As illustrated at FIGS. 4 and 92, the second wall 291 includes a relief 297 (e.g., a slot 281, an opening, etc.). The relief 297 may allow access to the loop 148 of the energy absorbing member 140 and thereby allow the catch 226 to engage the loop 148 as the energy absorbing member 140 and the housing 280 are rotated together from an open configuration 70 (i.e., a disengaged configuration) to the closed configuration 40 (i.e., the armed configuration). The relief 297 may smoothly blend with the distal end 284 and thereby minimize potential for snagging. In addition, a funnel 283 (e.g., a chamfer, a round, a taper, etc.) may be included between the distal end 284 and the relief 297. As illustrated at FIG. 92, the funnel 283 may include a first part 283A and a second part 283B positioned opposite the relief 297 from each other. The first part 283A may smoothly transition to a first side 281A of the slot 281, and the second part 283B may smoothly transition to a second side 281B of the slot 281. The slot 281 and/or the relief 297 may include a bottom 285 opposite the funnel 283. The bottom 285 may include a semi-circular shape. The funnel 283 may serve to guide the catch 226 back into the relief 297 after an intrusion load F temporarily stretches the loop 148 such that the catch 226, or a portion of the catch 226, becomes positioned outside of the relief 297. The funnel 283 thereby prevents the catch 226 from becoming caught on the distal end 284 of the housing 280 or on other surfaces of the housing 280 (see FIG. 20).

As depicted at FIGS. 16, 18, 22, 24, 38, 40, 42, 46, 53, 55, 60, 62, and 69, a portion of the catch 226, 3226, 6228 (e.g., a portion of the hook 228) may be positioned within a portion of the finger catch 296, at least when the deformable latch system 100 is set to the closed configuration 40. The portion of the catch 226 may rest upon the portion of the finger catch 296 when the latch assembly 110 is in the closed configuration 40. The spring 180 may urge the portion of the catch 226 to rest upon the portion of the finger catch 296. The portions of the catch 226 and the finger catch 296 that interface with each other may be arc shaped and may define a radius. When the latch assembly 110 is moved from the closed configuration 40 (see FIG. 16) to the engaged configuration 50 (see FIG. 18) by the intrusion load F or other load, the portion of the catch 226 may actuate the portion of the finger catch 296 and thereby move the latch assembly 110 from the closed configuration 40 toward the engaged configuration 50.

As illustrated at FIGS. 21, 90, and 94-97, holes 298 are included at the third wall 293 and the fourth wall 295. The holes 298 are generally aligned with the axis A. A spring attachment 299 is further provided on the housing 280. The spring attachment 299 may engage the spring 180 and thereby connect the spring 180 to the housing 280. As depicted, the spring attachment 299 is positioned at the fourth side 294 on the fourth wall 295 adjacent the first wall 289. As depicted at FIGS. 68-70, 72, 73, 91, and 94-97, a pair of protrusions 189' (e.g., latches) are positioned at the third wall 293. In the depicted embodiment, the pair of protrusions 189' are positioned opposite the hole 298 from each other and oriented transverse to the passage 286. In certain embodiments, the pair of protrusions 189' may serve as portions of the detent 187 (described in detail below).

To assemble the latch assembly 110, the energy absorbing member 140 may be positioned within the passage 286 of the housing 280. In particular, the distal end 144 may be inserted within the passage 286 at the proximal end 282 of the housing 280. The energy absorbing member 140 may then be slid through the passage 286 until the hole 146 of the energy absorbing member 140 aligns with the holes 298 of the housing 280. The housing 280, with the energy absorbing member 140 within, may then be positioned within the channel 195 of the base 191. The spring 180 may further be positioned alongside the fourth side 294 of the housing 280 and adjacent the second hinge component 192B of the base 191. A first end 182 of the spring 180 may be engaged with the spring attachment 299 (see FIGS. 21, 90, 93, 96, and 97) and a second end 184 of the spring 180 may be engaged with a spring attachment 199 (see FIGS. 77, 79, and 80) of the base 191. A passage 186 through the spring 180 may be aligned with the axis A. Upon alignment and positioning of the energy absorbing member 140, the housing 280, and the base 191, the pivoting pin 190 may be inserted through the pivoting holes 196 of the base 191, the passage 186 of the spring 180, and the hole 146 of the energy absorbing member 140. The pivoting pin 190 may be slid through the holes 196, 186, 298 until a head 130 at the first end 190A of the pivoting pin 190 abuts the first hinge component 192A of the base 191. The pivoting pin 190 may then be secured to the latch assembly 110 by a retaining ring 139 (e.g., a snap ring, a circlip, etc.). In the embodiment depicted at FIGS. 21 and 81-84, the pivoting pin 190 includes a retaining groove 136 that may hold the retaining ring 139.

The pivoting pin 190 and the associated holes 146, 196, 186, 298 may define a configuration joint 90. The configuration joint 90 may configure the deformable latch system 100 in the closed configuration 40 (i.e., the armed configuration) and the open configuration 70 (i.e., the disengaged configuration). The closed configuration 40 is illustrated at FIGS. 15 and 16, and the open configuration 70 is illustrated at FIGS. 13 and 14. When the deformable latch system 100 is set to the closed configuration 40 (i.e., the armed configuration) and an attempt is made to open the door 200, the configuration joint 90 may automatically configure the deformable latch system 100 at an engaged configuration 50 (see FIGS. 17 and 18) by allowing rotation across the configuration joint 90. The engaged configuration 50 resists opening of the door 200 beyond a predetermined amount. Furthermore, the configuration joint 90 may allow rotation across the configuration joint 90 as the energy absorbing member 140 stretches into an energy absorbing configuration 60 (see FIGS. 19 and 20). The spring 180 may urge the latch assembly 110 toward the engaged configuration 50 and/or the closed configuration 40 (i.e., the armed configuration).

Figure 21:
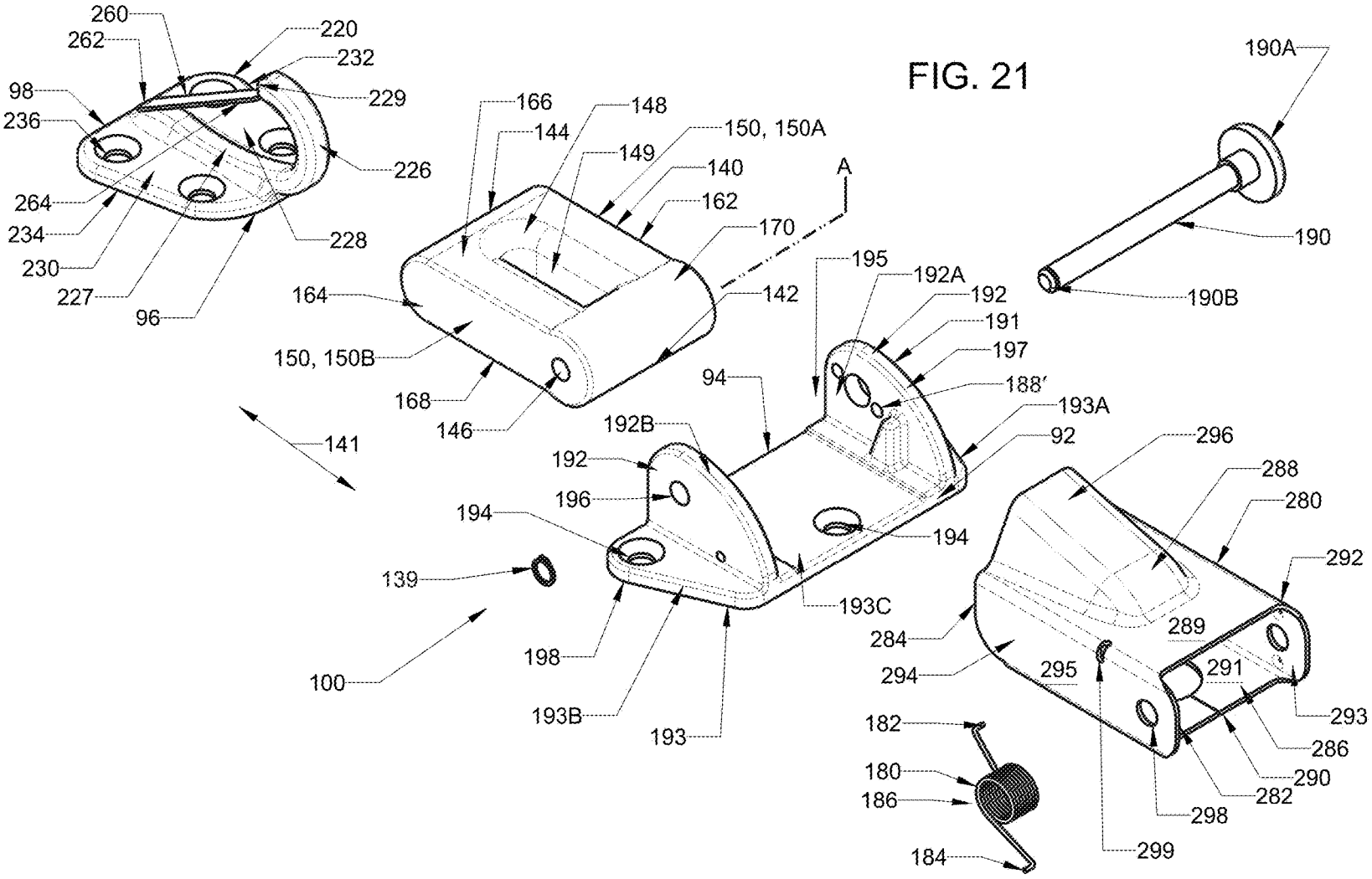
FIG. 21 is an exploded perspective view of the deformable latch system of FIG. 1.
Figure 99:
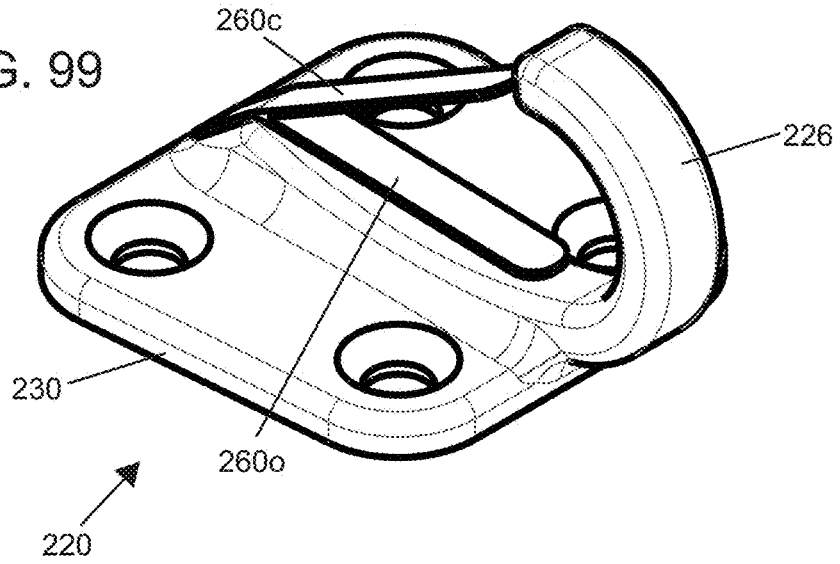
FIG. 99 is a perspective view of the catch member of FIG. 98.
Figure 98:
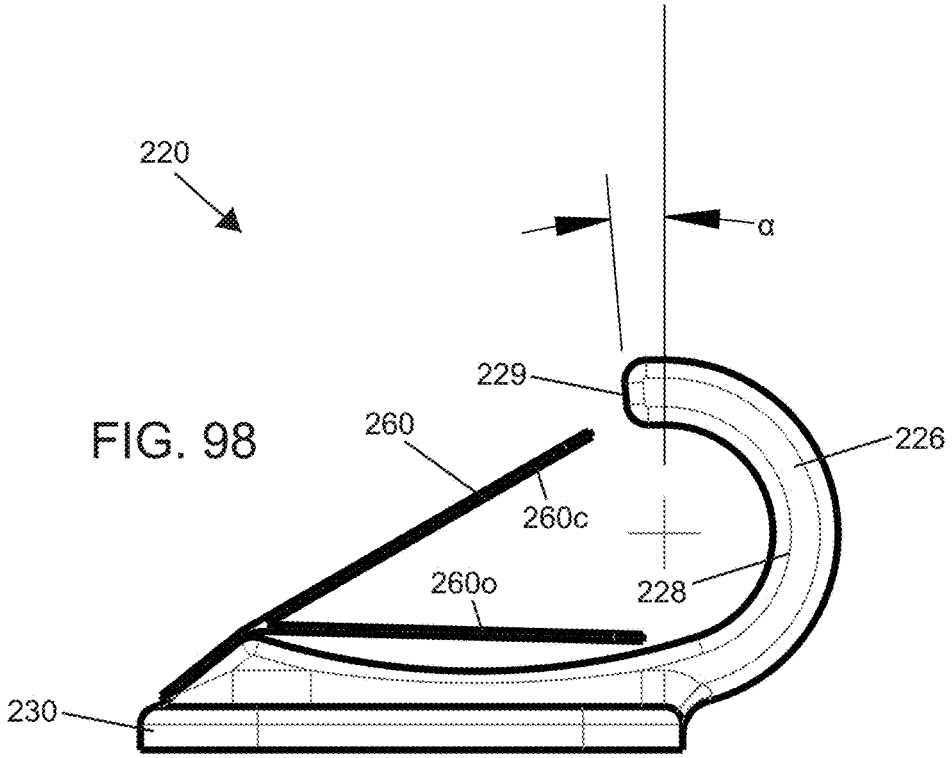
FIG. 98 is a plan view of a catch member of the deformable latch system of FIG. 1.
Figure 102:
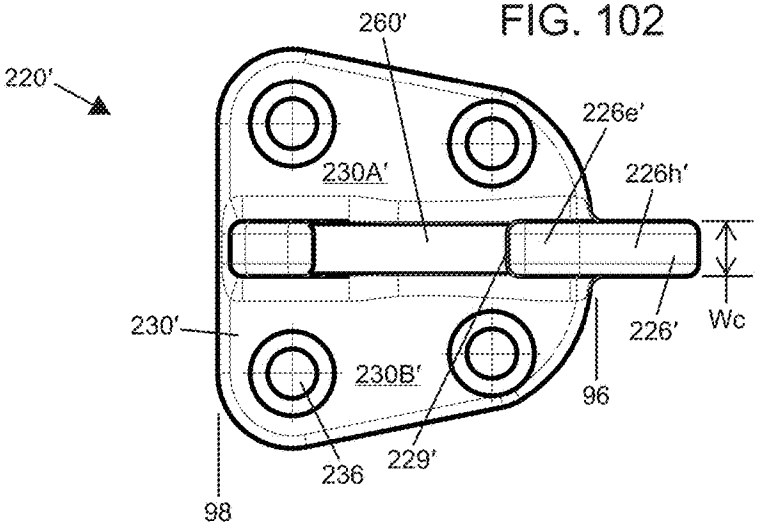
FIG. 102 is a front elevation view of the catch member of FIG. 100.

Turning now to FIGS. 21, 98, and 99, the catch member 220 will be described in detail. The catch member 220 includes a base 230 that is adapted to be mounted to the door 200. The base 230 extends between a first station 96 and a second station 98. As depicted at FIG. 17, the first station 96 is adjacent or at the edge 202 of the door 200. The second station 98 is spaced away from the edge 202 of the door 200. As depicted, the station 96 defines a first end of the base 230, and the second station 98 defines a second end of the base 230. As depicted, the first station 96 and the second station 98 are substantially parallel to each other. The base 230 may extend between a first side 232 and a second side 234. The base 230 may include a plurality of mounting holes 236. Fasteners may be inserted through the mounting holes 236 and thereby attach the catch member 220 to the door 200. As depicted, the holes 236 are spaced from each other at four corners of the base 230 and thereby provide structural stability to the catch member 220.

The catch 226 extends from the base 230 at or near a center of the base 230 between the first side 232 and the second side 234. As depicted, the catch 226 includes a hook 228 adapted to engage the loop 148 of the energy absorbing member 140. As depicted, the catch 226 extends from a first end 227, integral with the base 230, to a second end 229. The hook 228 may open inwardly toward the second station 98. As the hook 228 extends from the first end 227, the hook 228 may arch over and beyond the first station 96. In certain embodiments, the hook 228 arches around an angle of about 180 degrees. The hook 228 may thereby include a shape of a semi-circle. As illustrated at FIG. 98, the hook 228 may extend back inwardly beyond a central axis of the hook 228 (e.g., beyond 180 degrees of wrap) by an angle $\alpha$. The angle $\alpha$ may be greater than about 5 degrees, in certain embodiments. In other embodiments, the angle $\alpha$ may be greater than about 1 degree.

As mentioned above, the catch member 220 may further include a clip 260. As illustrated at FIG. 21, the clip 260 extends between a first end 262, mounted to the base 230, and a second end 264. The second end 264 may slightly overlap the end 229 of the hook 228, in certain embodiments. In other embodiments, the second end 264 may be spaced from the end 229 of the hook 228 (see FIG. 98). The clip 260 may be made of a spring material (e.g., a spring steel). The clip 260 may apply a slight preload between the end 264 of the clip 260 and the end 229 of the catch 226. The catch 226 and/or the clip 260 may extend across a width narrower than the opening 149 of the energy absorbing member 140. As described above, when the loop 148 moves toward the engaged configuration 50, the clip 260 is depressed to an open position 260*o* and thereby allows the loop 148 to enter the hook 228 (see FIGS. 98 and 99). Upon entering the hook 228, the energy absorbing member 140 may transfer tensile loads between the base 191 and the catch member 220. In transferring the tensile loads, the energy absorbing member 140 stretches along a length 141 of the energy absorbing member 140 and thereby absorbs energy (see FIG. 21). Upon entrance of the energy absorbing member 140 into the hook 228, the clip 260 may return to a closed position 260*c* (i.e., a blocking position), with the end 264 of the clip 260 abutting or adjacent to the end 229 of the hook 228. By returning, the clip 260 may trap the loop 148 and thereby prevent unhooking of the loop 148 from the hook 228 until an operator depresses (i.e., manipulates) the clip 260.

Turning now to FIGS. 100-103, a catch assembly 220' is illustrated according to the principles of the present disclosure. The catch assembly 220' is similar to the catch member 220 (i.e., the catch assembly 220) described in detail above. As with the catch member 220, the catch assembly 220' may be secured directly to the door 200 by inserting fasteners through mounting holes 236 at a base 230' of the catch assembly 220'. The catch assembly 220' similarly includes a catch 226' that is adapted to catch the loop 148 of the deformable member 140. The catch assembly 220' may be used with the deformable latch systems 100, 600, 1200, 1400, 1500, 1600, 1700, 1800, and 1900, described herein. As described above, with regard to the catch member 220, the catch assembly 220' extends between a first station 96 and a second station 98 at the base 230'. Likewise, the catch 226' may extend beyond the first station 96. In the depicted embodiments, the catch assembly 220' mounts on the door 200, and the latch assembly 110 mounts on the door frame 300. In alternative embodiments, the catch assembly 220' may mount on the door frame 300, and the latch assembly 110 may mount on the door 200. As with the catch 226 of the catch member 220, a portion of the catch 226' may be positioned in the finger catch 296 of the housing 280, when the deformable latch system 100 is set to the closed configuration 40 (see FIG. 16).

Figure 103:
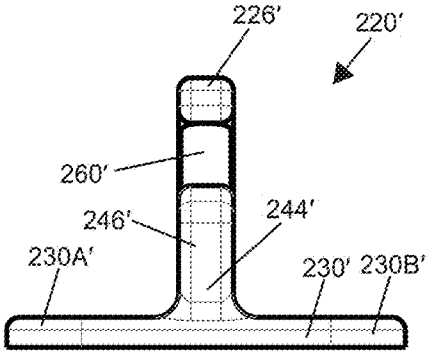
FIG. 103 is an end view of the catch member of FIG. 100.

As depicted at FIG. 103, the catch assembly 220' defines a T shape 244'. The T shape 244' is formed by an intersection of a catch leg 246' of the catch assembly 220' with the base 230'. The base 230' is thereby divided by the catch leg 246'. The base 230' thereby includes a first extension 230A' and a second extension 230B'. As depicted, the extensions 230A' and 230B' are substantially symmetric to each other about the catch leg 246'. As depicted, a pair of the mounting holes 236 is positioned at the first extension 230A' and another pair of the mounting holes 236 is positioned at the second extension 230B'. Fillets may be included between the catch leg 246' and the extensions 230A' and 230B' for added strength and aesthetics.

Figure 101:
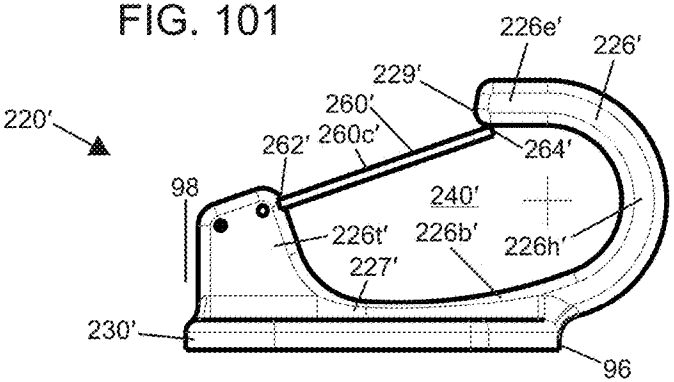
FIG. 101 is a plan view of the catch member of FIG. 100.

The catch leg 246' substantially defines the catch 226'. The catch leg 246' and the catch 226' define a width Wc. The width Wc is sized to fit within the opening 149 of the energy absorbing member 140. Turning now to FIG. 101, the catch 226' includes an end 229'. The end 229' terminates an extension portion 226*e'* of the catch 226'. As depicted, the extension portion 226*e'* extends substantially parallel to the base 230'. As will be described hereinafter, the extension portion 226*e'* allows additional movement of the loop 148 when captured by the catch assembly 220'. As depicted, the extension portion 226*e'* tangentially blends with a hook portion 226*h'* of the catch 226'. The hook portion 226*h'* is similar to the hook 228 of the catch 226, described above. As depicted, the hook portion 226*h'* may extend around a center of the hook portion 226*h'* about an arc of approximately 180 degrees. In the depicted embodiment, the arc is approximately 5 to 10 degrees less than 180 degrees. The hook portion 226*h'* tangentially blends with a base portion 226*b'* of the catch 226'. The base portion 226*b'* includes a gently curved portion that tangentially blends with an interior of the hook portion 226*h'*. The base portion 226*b'* extends above the base 230' and thereby provides the base 230' with a stiffening spine. The base portion 226*b'* further smoothly transfers loads applied to the hook portion 226*h'* to the base 230'. The smooth transitioning between the hook portion 226*h'*, the base portion 226*b'*, and the base 230' relieves certain stress concentrations that would otherwise develop and/or allows for efficient use of material giving a sleek and aesthetic look. Opposite the hook portion 226*h'*, the base portion 226*b'* continues and tangentially blends with a tail portion 226*t'*. The tail portion 226*t'* extends substantially above the base 230'. In the depicted embodiment, the tail portion 226*t'* extends beyond the center of the hook portion 226*h'* above the base 230'. As depicted, the base portion 226*b'* and the tail portion 226*t'* form an integral connection 227' with the base 230'. As depicted, the hook portion 226*h'* is integrally joined to and continues from the base portion 226*b'*. As depicted, the catch 226', including the base portion 226*b'*, the extension portion 226*e'*, the hook portion 226*h'*, and the tail portion 226*t'*, are formed of a single monolithic piece of material. In other embodiments, one or more of the base portion 226*b'*, the extension portion 226*e'*, the hook portion 226*h'*, and/or the tail portion 226*t'* may be formed of separate piece(s). The material used in the catch 226' may be steel, brass, stainless steel, aluminum, composite, plastic, and/or other suitably strong material.

Figure 100:
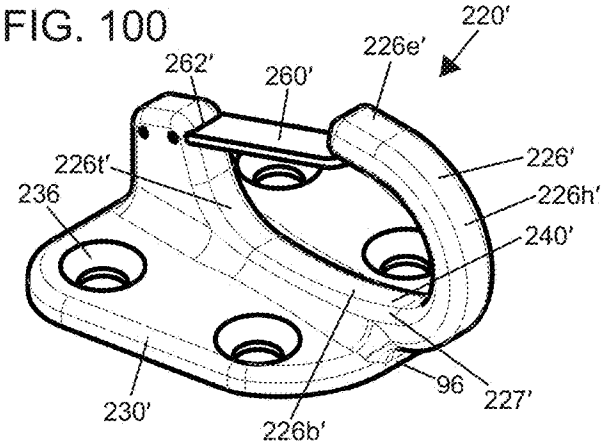
FIG. 100 is a perspective view of a catch member adapted for use with the deformable latch system of FIG. 1 according to the principles of the present disclosure.

As illustrated at FIGS. 100 and 101, the catch assembly 220' further includes a clip 260'. The clip 260' extends between a first end 262' and a second end 264'. As depicted, the first end 262' of the clip 260' is attached to an elevated portion of the tail portion 226*t'* of the catch 226'. The clip 260' extends as a cantilever from the first end 262' to the second end 264'. As depicted, the second end 264' of the clip 260' contacts the extension portion 226*e'* of the catch 226' at or near the end 229' of the catch 226'. As depicted, the second end 264' of the clip 260' is positioned at an inside of the extension portion 226*e'*. The second end 264' of the clip 260' therefore receives bearing support from the catch 226' when loaded outwardly. In certain embodiments, the bearing support may keep the clip 260' from bending out of the catch 226'. As depicted, the clip 260' is made of a thin material that allows the second end 264' of the clip 260' to be elastically deformed toward the base portion 226*b'* of the catch 226'. As the clip 260' is elastically deformed, removing the deforming load from the clip 260' restores the clip 260' to a closed position 260*c'*, illustrated at FIG. 101. In certain embodiments, the second end 264' of the clip 260' may preload against the extension portion 226*e'* of the catch 226'.

The catch assembly 220' forms a closed loop 240' when the second end 264' of the clip 260' contacts the extension portion 226*e'*. The closed loop 240' may capture the loop 148 of the energy absorbing member 140. The loop 148 may enter the closed loop 240' when the second end 264' of the clip 260' is bent downwardly toward the base portion 226*b'* thereby opening the closed loop 240'. Likewise, the loop 148 may be removed from the closed loop 240' by bending the second end 264' downwardly.

Operation of the catch assembly 220' will now be described in the context of the catch member 220 and the clip 260. In particular, FIGS. 13-20 show a sequence of configurations of the door 200, the catch member 220, the clip 260, the latch assembly 110, and the door frame 300. In the description that follows, the catch member 220 and the clip 260 are replaced by the catch assembly 220'. The open configuration 70 (i.e., the disengaged configuration) is illustrated at FIGS. 13 and 14. In this configuration, the deformable latch system 100 does not interfere with conventional operation of the door 200. As further described below, the detent 187 may hold the latch assembly 110 at the open configuration 70. Holding the latch assembly 110 at the open configuration 70 prevents the door 200 from closing on top of the latch assembly 110 by keeping the latch assembly 110 out of an opening of the door frame 300.

Upon desiring the door 200 to remain securely closed, an occupant may depress the head 130 of the pin 190 and thereby release the detent 187. The occupant may also release the detent 187 by other means. Upon the detent 187 being released, the latch assembly 110 is automatically reconfigured to the closed configuration 40 (i.e., the armed configuration) as illustrated at FIGS. 15 and 16. The spring 180 rotates the energy absorbing member 140 about the axis A and thereby positions the extension portion 226*e'* and the hook portion 226*h'* through the opening 149 of the energy absorbing member 140. As depicted, the spring 180 may be sized such that as the loop 148 rotates toward the door 200, the loop 148 overpowers the clip 260' and thereby allows the loop 148 to enter the catch 226'. As illustrated at FIG. 16, the clip 260 is bent toward the door 200 by the loop 148 powered by the spring 180. Likewise, the clip 260' and, in particular, the second end 264' of the clip 260' may be moved toward the door 200 and thereby allow the latch assembly 110 to be configured in the armed configuration 40. If no opening of the door 200 subsequently occurs, the latch assembly 110 may be reconfigured from the armed configuration 40 to the open configuration 70 of FIG. 14 by merely rotating the housing 280 into position and thereby allowing the detent 187 to reengage. The finger catch 296 may be used to rotate the housing 280 and thereby position the latch assembly 110 at the open configuration 70.

Figure 18:
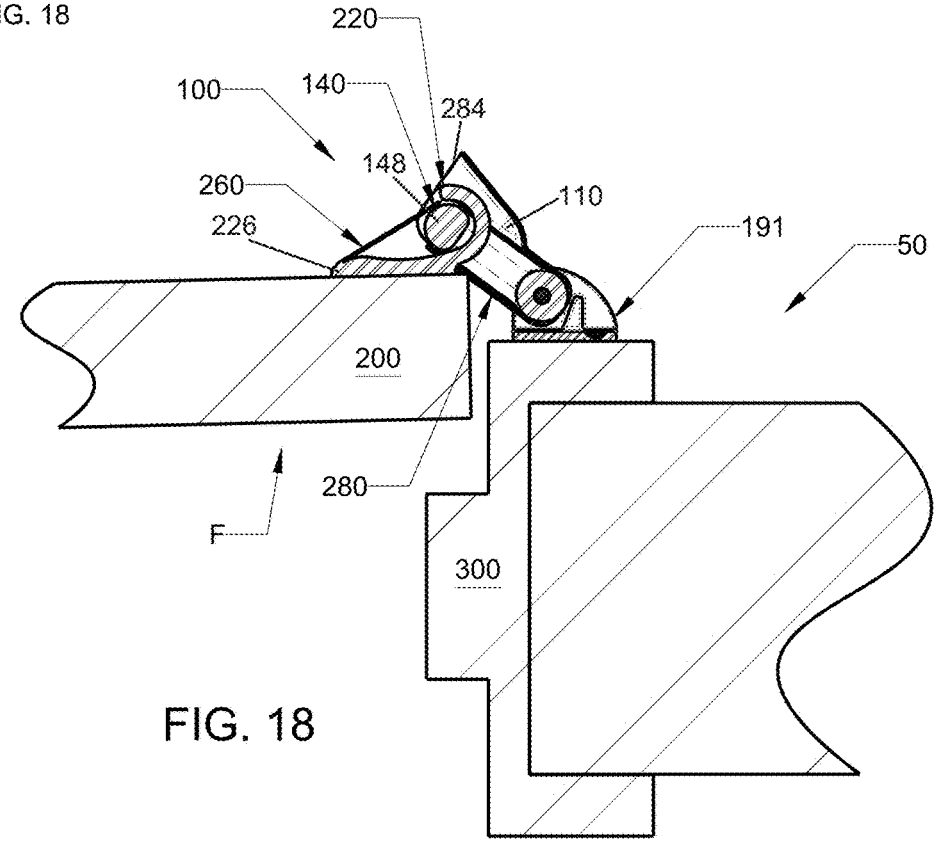
FIG. 18 is the partial cross-sectional plan view of FIG. 14, as called out at FIG. 17, with the deformable latch system shown in the engaged configuration of FIG. 17.

However, if an attempt is made to open the door 200 with the latch assembly 110 in the armed configuration 40, the latch assembly 110 moves to the engaged configuration 50, as illustrated at FIGS. 17 and 18. By moving to the engaged configuration 50, the clip 260, 260' may move away from the door 200 and sit on top of the loop 148. Likewise, upon the latch assembly 110 moving to the engaged configuration 50, the loop 148 is pulled deep into the hook portion **226*h'* of the catch assembly 220'. The loop 148 is thereby moved out of the way of the second end 264' of the clip 260', and the clip 260' moves away from the door 200 with the second end 264' of the clip 260' contacting the extension portion 226*e'* of the catch 226'. Thus, in the engaged configuration 50, the closed loop 240' is formed with the loop 148 of the energy absorbing member 140** trapped inside.

A perpetrator may attempt to untrap the loop 148 from the loop 240' by repeatedly shaking the door 200. However, this merely results in the latch assembly 110 staying in the engaged configuration 50 with the clip 260' continuing to trap the loop 148 within the closed loop 240'. If the intrusion load F is applied to the door 200, the latch assembly 110 may move to the energy absorbing configuration 60, as illustrated at FIGS. 19 and 20. However, the energy absorbing configuration 60 and the engaged configuration 50 are related in that the loop 148 continues to be trapped within the closed loop 240'. The energy absorbing configuration 60 may be a subset of the engaged configuration 50. If the door 200 is brought into contact with the door frame 300 (i.e., if the door 200 is closed), the loop 148 merely moves between the hook portion **226*h'* and the tail portion 226*t'* of the catch 226' with the clip 260' blocking removal of the loop 148 from the catch 226'**.

Upon the intrusion attack on the door 200 ceasing, or upon inadvertent opening of the door 200 with the latch assembly 110 set to the armed configuration 40, the latch assembly 110 may be returned to the open configuration 70 by the occupant manually releasing the loop 148 from the closed loop 240'. In particular, the door 200 may be opened slightly to the engaged configuration 50, as illustrated at FIG. 18. This positions the loop 148 into contact with the hook portion **226*h'*. As the loop 148 is deep within the hook portion 226*h'* and the extension portion 226*e'*, the clip 260' may be bent toward the door 200 forming an opening between the second end 264' of the clip 260' and the end 229' of the catch 226'. By closing the door 200 while continuing to depress the clip 260', the loop 148 will exit the opening and may further exit the catch 226'. The occupant may further fully rotate the latch assembly 110 toward the open configuration 70 and allow the detent 187 to maintain that position. The occupant may manipulate the clip 260' by pressing a finger on a medial portion of the clip 260' between the first end 262' and the second end 264' of the clip 260'**.

Figure 22:
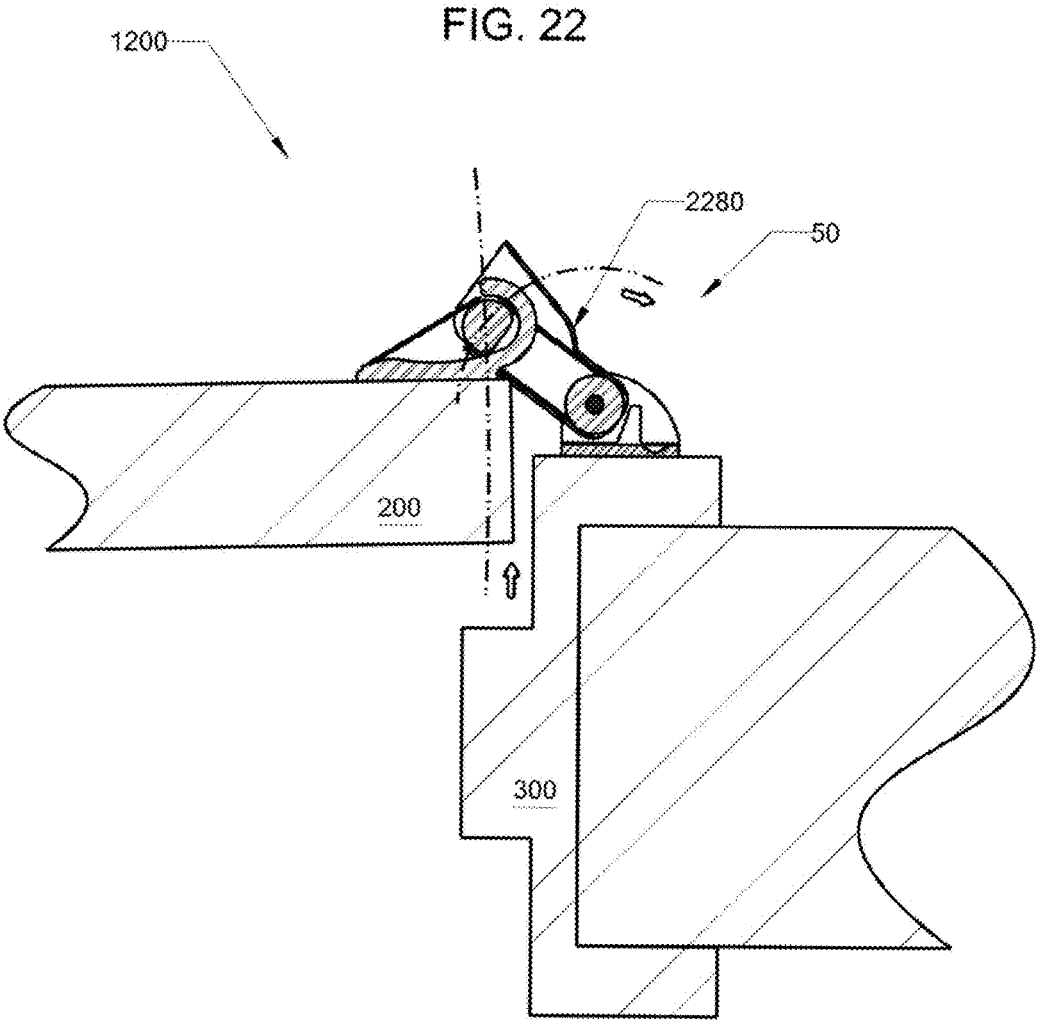
FIG. 22 is a partial cross-sectional plan view of another deformable latch system according to the principles of the present disclosure.
Figure 25:
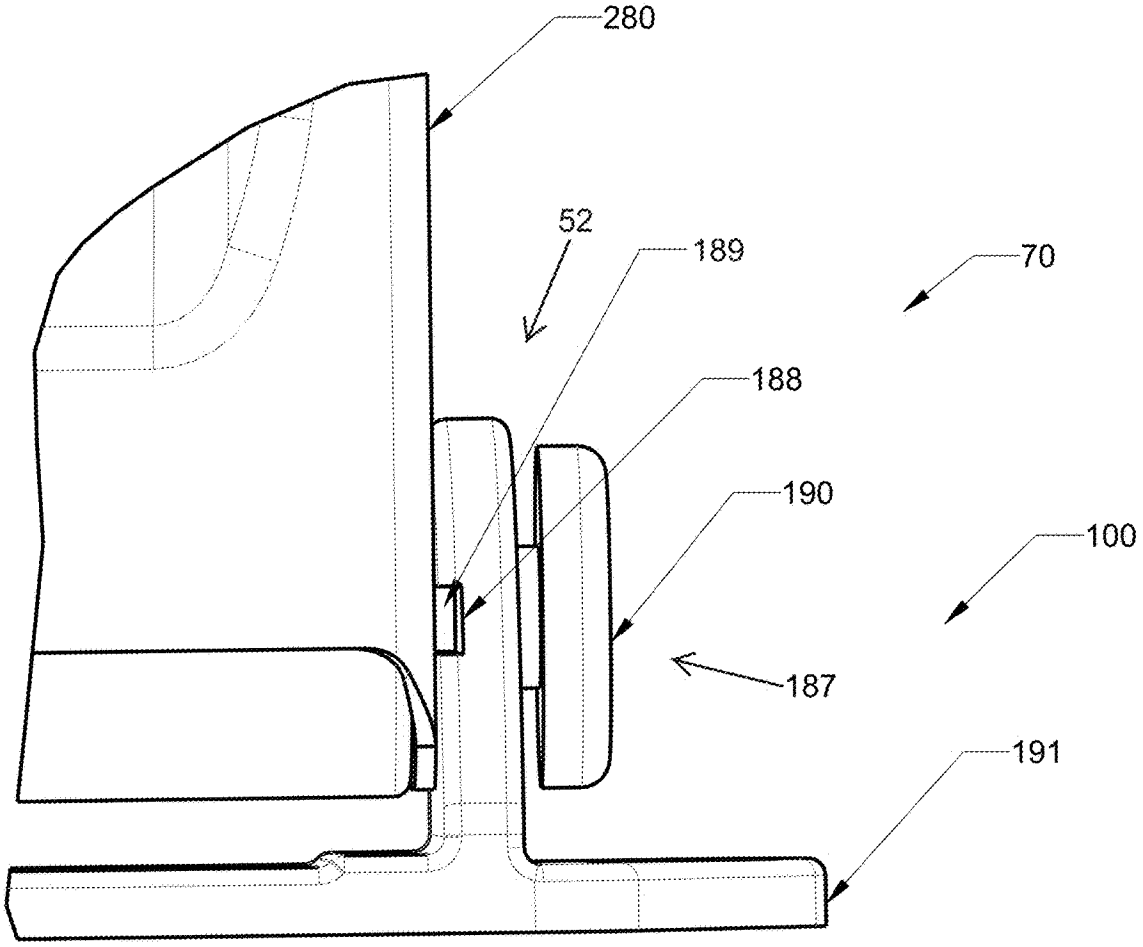
FIG. 25 is an enlarged partial perspective view of a pin and a detent feature of a deformable latch system according to the principles of the present disclosure, the pin shown in an un-depressed configuration and the detent feature shown in an engaged configuration.
Figure 26:
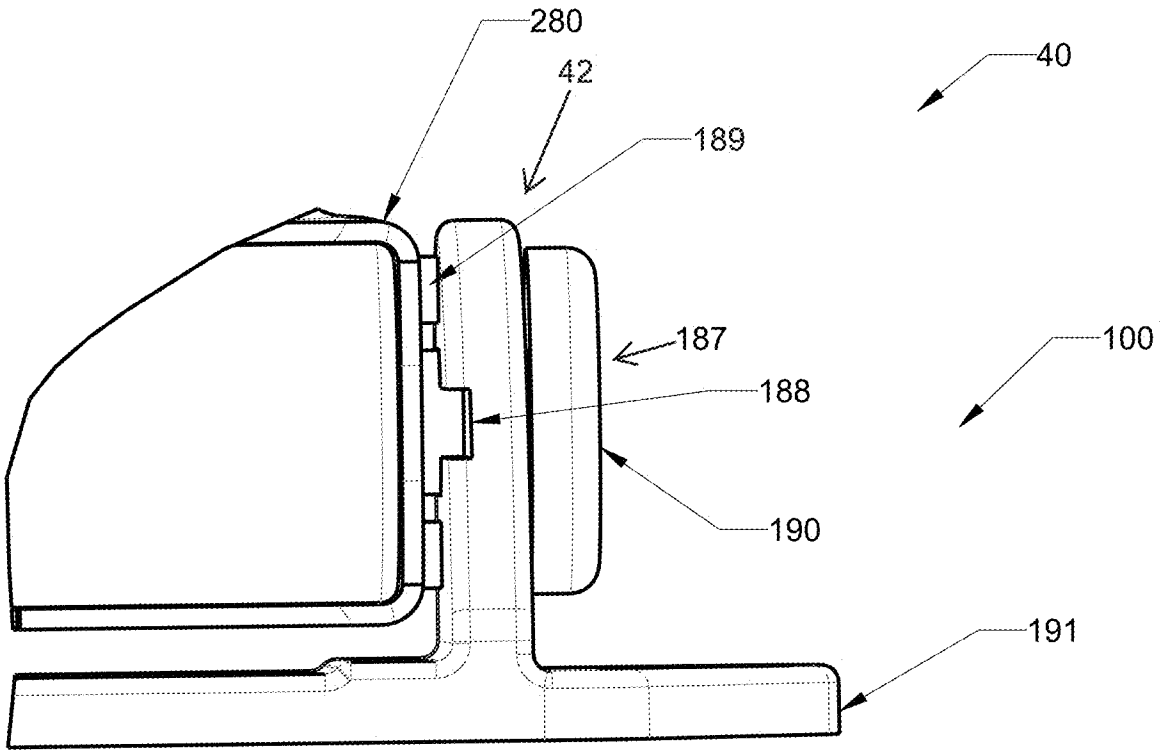
FIG. 26 is the enlarged partial perspective view of FIG. 25, but with the pin shown in a depressed configuration and the detent feature shown in a disengaged configuration.
Figure 27:
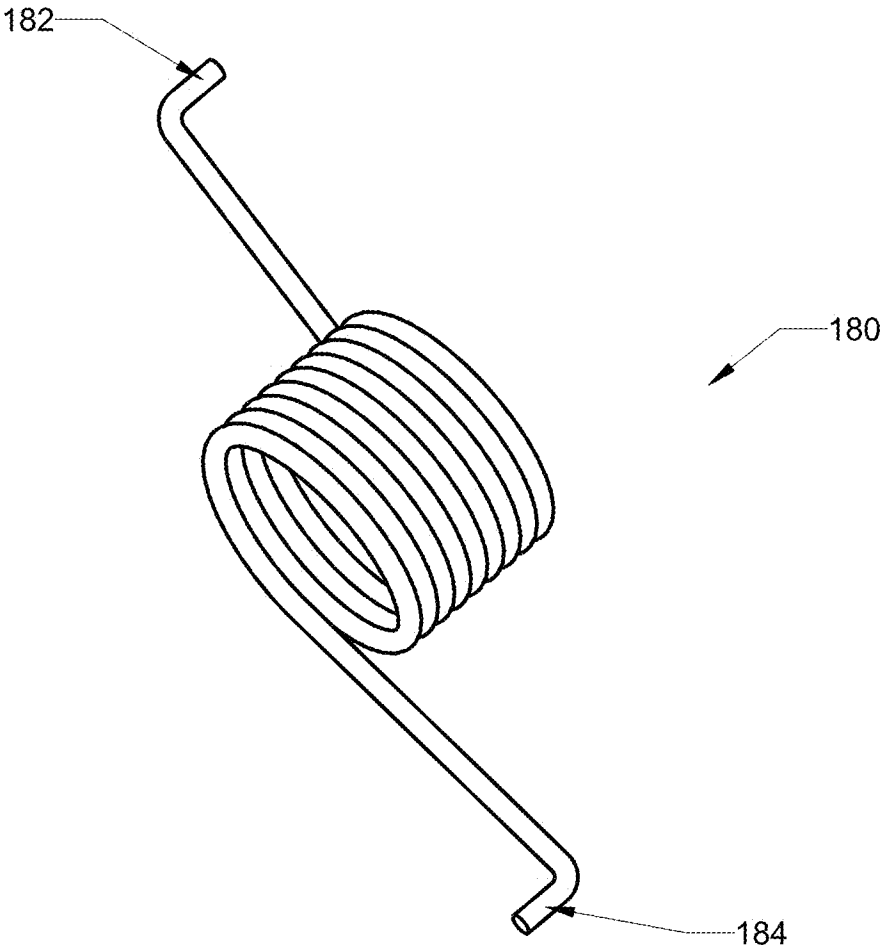
FIG. 27 is an enlarged perspective view of a spring suitable for use in various deformable latch systems of the present disclosure.

Turning now to FIG. 22, another embodiment of a deformable latch system 1200 is illustrated according to the principles of the present disclosure. The deformable latch system 1200 is substantially similar to the deformable latch system 100, described above. However, an alternative cover 2280 (i.e., an alternative housing) replaces the housing 280 of the deformable latch system 100. Thus, deformable latch systems, according to the principles of the present disclosure, may include a variety of styles. The variety of styles may include ornamental differences to match various decors.

Turning now to FIGS. 23 and 24, another embodiment of a deformable latch system 1300 is illustrated according to the principles of the present disclosure. The deformable latch system 1300 also includes many elements and features similar to the deformable latch system 100. However, a catch 3226 replaces the catch 226 of the deformable latch system 100. As illustrated, the catch 3226 includes a ball structure 3228 that traps a loop 3148. In addition, clipping features 3260 are included on an energy absorbing member 3140 that may retain the energy absorbing member 3140 on the catch member 3220. The clipping members 3260 may resist disengagement of a catch member 3220 and the energy absorbing member 3140 when the door 200 is shaken or otherwise cyclically loaded.

Turning now to FIGS. 25, 26, and 68-73, the deformable latch system 100 (i.e., the door securing device) may further include the detent 187 that is adapted to resist the spring 180 (e.g., the torsion spring) and thereby retain the deformable latch system 100 in the open configuration 70 (i.e., the disengaged configuration) when the detent 187 is engaged (e.g., in a latched configuration 52). FIGS. 25 and 71-73 illustrate the detent 187 engaged and in the latched configuration 52 (with the deformable latch system 100 in the open configuration 70), and FIGS. 26 and 68-70 illustrate the detent 187 disengaged in an unlatched configuration 42 (with the deformable latch system 100 in the closed configuration 40). In the depicted embodiment of FIGS. 25 and 26, the base 191 includes a catch 188, and the housing 280 includes a latch 189. In the depicted embodiment of FIGS. 68-73, the base 191 includes a catch 188' (e.g., a pair of holes), and the housing 280 includes the latch 189'. The catch 188' may be oriented relative to the mounting flange 193 by an angle β (see FIG. 78) and thereby retain the deformable latch system 100 at a desired rotational orientation when at the open configuration 70.

The deformable latch system 100 may include stop features to locate the housing 280 and the energy absorbing member 140 when the deformable latch system 100 is at the open configuration 70. The stop features may position the housing 280 about the axis A at or near a rotational position that aligns the latch 189, 189' and the catch 188, 188'. The stop features may thereby aid the engagement of the detent 187. In the depicted embodiment, the base 191 includes a stop 185 with a stop surface **185*s* (see FIGS. 69, 72, 74-77, and 80). The stop surface 185*s* is spaced from the axis A by a distance Ds (see FIG. 76). The stop surface 185*s* may be substantially perpendicular to the angle β (see FIG. 78) as defined by the catch 188'. The stop surface 185*s* may be substantially perpendicular to the catch 188, 188'. The stop 185 may be joined to the first side 192A of the hinge components 192 and to the mounting flange 193. As the housing 280 is rotated about the axis A as the deformable latch system 100 is moved toward the open configuration 70, the stop surface 185*s* contacts a portion of the first wall 289 of the housing 280** and stops further movement.

The spring 180 may urge the latch 189, 189' toward the catch 188, 188' along a direction parallel to the axis A (see FIG. 21). The spring 180 may carry a compression load that urges the latch 189, 189' toward the catch 188, 188'. When the latch 189, 189' and the catch 188, 188' align (e.g., when the deformable latch system 100 is manually moved to the open configuration 70), the spring 180 may move and/or hold the latch 189, 189' into the catch 188, 188'. The latch 189, 189' may be moved out of the catch 188, 188' by overpowering the spring 180. When the deformable latch system 100 is held in the open configuration 70 by the detent 187, the deformable latch system 100 may be deactivated (i.e., may not secure the door 200 until reactivate by releasing the detent 187).

In the depicted embodiments, the detent 187 may be released and the deformable latch system 100 may be reactivated by pressing the head 130 (i.e., a button) of the pin 190. In particular, the head 130 of the pin 190 is at the first end 190A of the pin 190. By pressing the head 130, the latch 189, 189' may be moved away from and disengaged from the catch 188, 188'. Upon the latch 189, 189' disengaging the catch 188, 188', the spring 180 may rotationally move the deformable latch system 100 from the open configuration 70 to the closed configuration 40.

Figure 81:
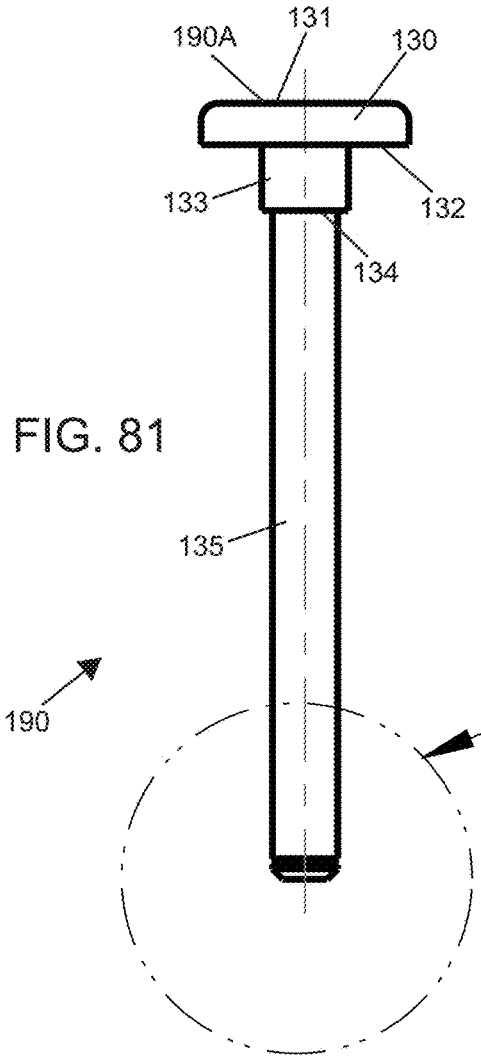
FIG. 81 is a side elevation view of the pin of FIG. 68.
Figure 82:
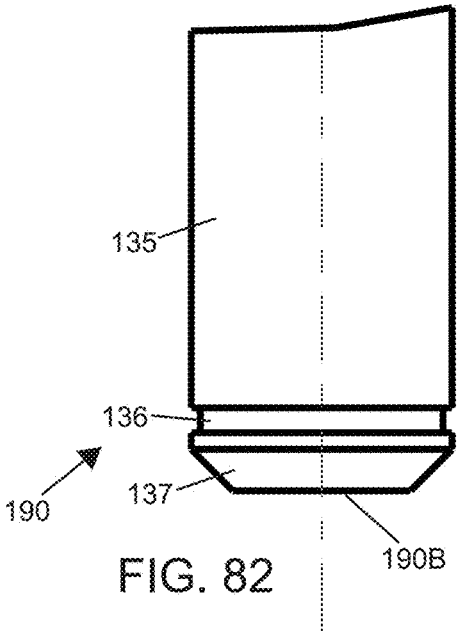
FIG. 82 is an enlarged portion of FIG. 81, as called out at FIG. 81.
Figure 83:
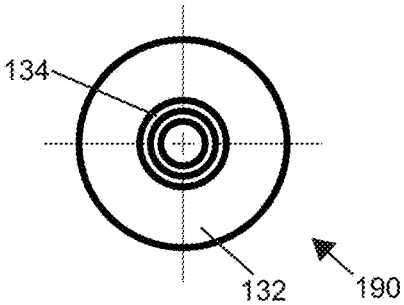
FIG. 83 is a bottom plan view of the pin of FIG. 81.
Figure 84:
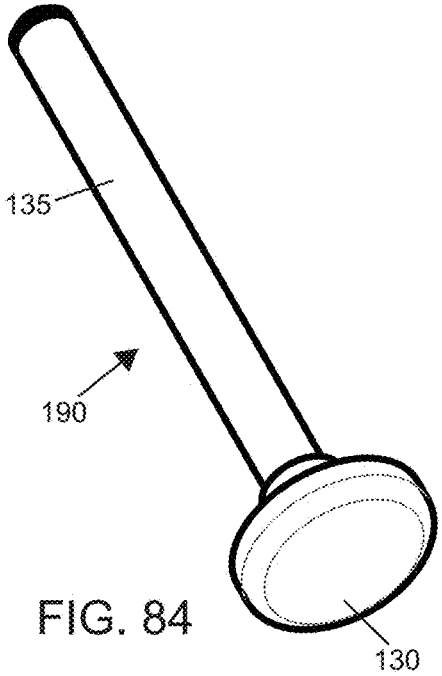
FIG. 84 is a perspective view of the pin of FIG. 81.
Figure 97:
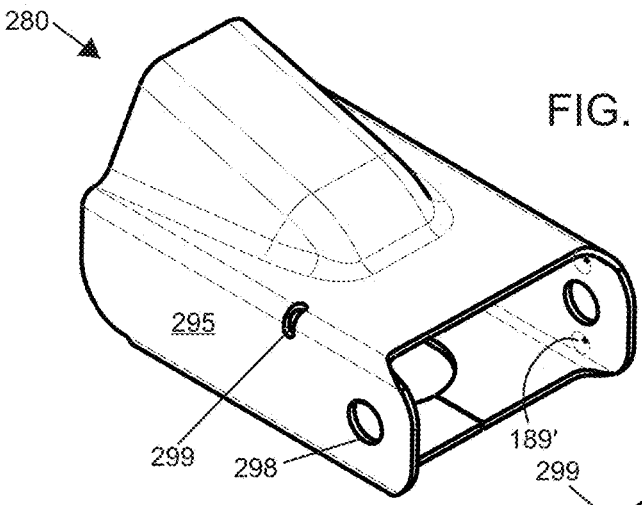
FIG. 97 is another enlarged perspective view of the covering shield of FIG. 90.
Figure 96:
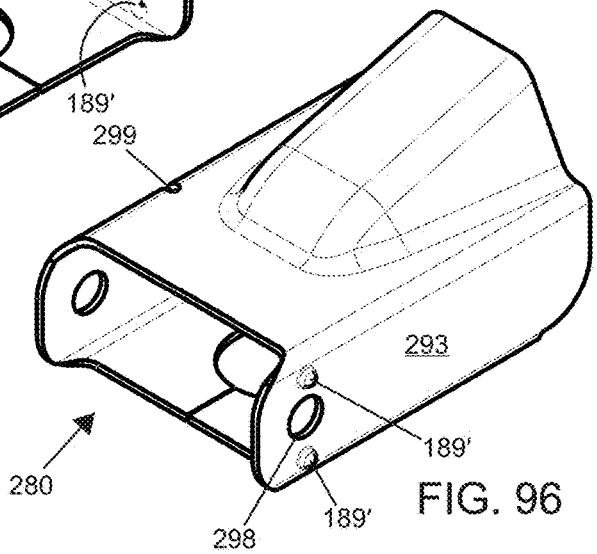
FIG. 96 is an enlarged perspective view of the covering shield of FIG. 90.
Figure 95:
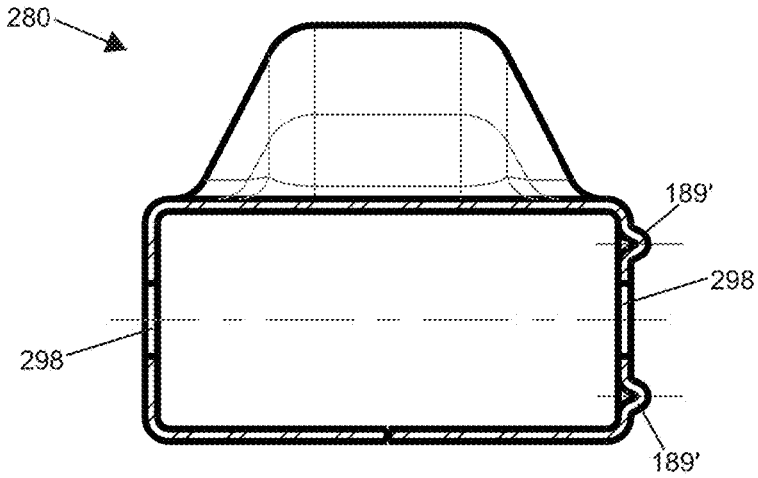
FIG. 95 is an enlarged cross-sectional end view of the covering shield of FIG. 90, as called out at FIG. 90.

In the depicted embodiments, the head 130 is button shaped and extends from an outer surface 131 to an inner surface 132 (see FIGS. 81 and 82). As depicted, a first diameter portion 133 of the pin 190 may extend from the inner surface 132 of the head 130 to a shoulder 134 of the pin 190. The first diameter portion 133 may be sized for the hole 196L. As depicted, a second diameter portion 135 of the pin 190 may extend from the shoulder 134 to the retaining groove 136 of the pin 190 and again from the retaining groove 136 to an alignment chamfer 137 at the second end 190B of the pin 190. The second diameter portion 135 may be sized for the hole 196S.

In the depicted embodiments, the spring 180 is in compression and thereby urges the fourth wall 295 away from the second side 192B of the hinge components 192. The urging of the fourth wall 295 away from the second side 192B correspondingly urges the third wall 293 toward the first side 192A of the hinge components 192. As the latch 189, 189' is positioned at the third wall 293 and the catch 188, 188' is positioned at the first side 192A, the urging together of the third wall 293 toward the first side 192A also urges together the latch 189, 189' and the catch 188, 188'. The protrusion of the latch 189, 189' may rest against the first side 192A when not engaged with the catch 188, 188'. Upon the latch 189, 189' and the catch 188, 188' aligning (e.g., see FIGS. 72 and 73), the spring 180 extends, the latch 189, 189' enters the catch 188, 188', and the third wall 293 moves toward the first side 192A. Thus, when the operator rotationally moves the deformable latch system 100 to the open configuration 70, the detent 187 automatically engages and holds the deformable latch system 100 at the open configuration 70.

As depicted, the shoulder 134 of the pin 190 bears against the third wall 293. Thus, when the spring 180 extends, the shoulder 134 (and thereby the pin 190) may also move with the third wall 293. As illustrated at FIGS. 71 and 73, with the spring 180 extended and the latch 189, 189' positioned within the catch 188, 188', the head 130 of the pin 190 is spaced away from the first side 192A.

By pressing the head 130 of the pin 190 toward the first side 192A, the spring 180 may be overpowered in compression and the detent 187 released. In particular, pressing the pin 190 toward the first side 192A causes the shoulder 134 of the pin 190 to press against the third wall 293. The fourth wall 295 correspondingly compresses the spring 180 against the second side 192B of the hinge components 192. By pressing the head 130 of the pin 190 toward the first side 192A, the third wall 293 is moved away from the first side 192A, and the latch 189, 189' disengages from the catch 188, 188'. As the spring 180 is in torsion, the spring 180 urges the deformable latch system 100 from the open configuration 70 to the closed configuration 40. Thus, when the operator presses the head 130 of the pin 190 toward the first side 192A, the deformable latch system 100 automatically moves from the open configuration 70 to the closed configuration 40.

In the depicted embodiment, the spring 180 both biases the housing 280 and/or the latch assembly 110 toward the closed configuration 40 and toward the catch 188, 188'. The spring 180 biases the housing 280 and/or the latch assembly 110 linearly along the axis A (see FIG. 21) toward the catch 188, 188'. The housing 280 and/or the latch assembly 110 may linearly slide on the pin 190 along the axis A to and from the catch 188, 188'. The spring 180 may be overpowered by manually urging the housing 280 and/or the latch assembly 110 away from the catch 188, 188' (e.g., linearly away from the catch 188, 188'). The spring 180 may therefore both urge the latch assembly 110 and/or the housing 280 toward the engaged configuration 50 and/or the closed configuration 40 (e.g., rotationally) and the latch 189, 189' toward the catch 188, 188' (e.g., linearly). In other embodiments, separate springs may be used to urge the latch assembly 110 and/or the housing 280 toward the engaged configuration 50 and/or the closed configuration 40 (e.g., rotationally) and the latch 189, 189' toward the catch 188, 188' (e.g., linearly).

The detent 187 and/or a similar detent may be implemented with the various latch systems 100, 400, 500, 600, 1200, 1300, 1400, 1500, 1600, 1700, 1800, and/or 1900 described herein.

Figure 28:
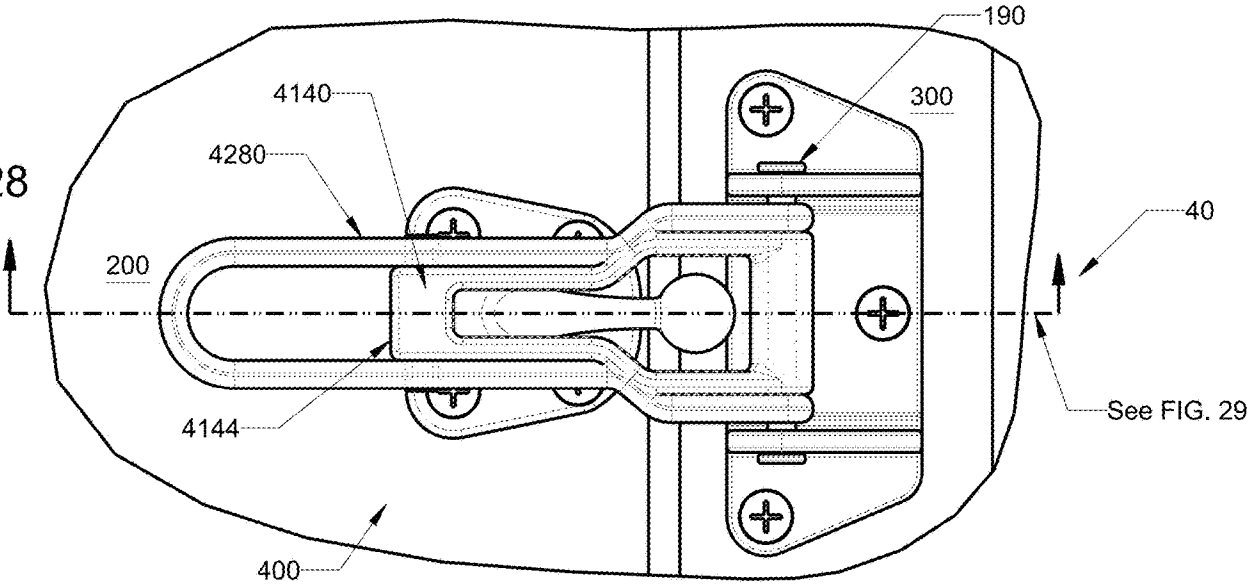
FIG. 28 is a partial front elevation view of yet another deformable latch system according to the principles of the present disclosure.
Figure 29:
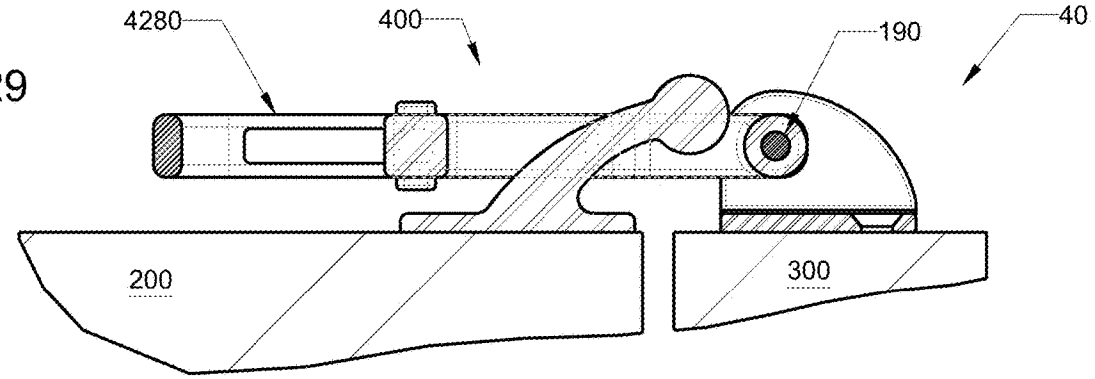
FIG. 29 is a partial cross-sectional plan view of the deformable latch system of FIG. 28, as called out at FIG. 28.
Figure 32:
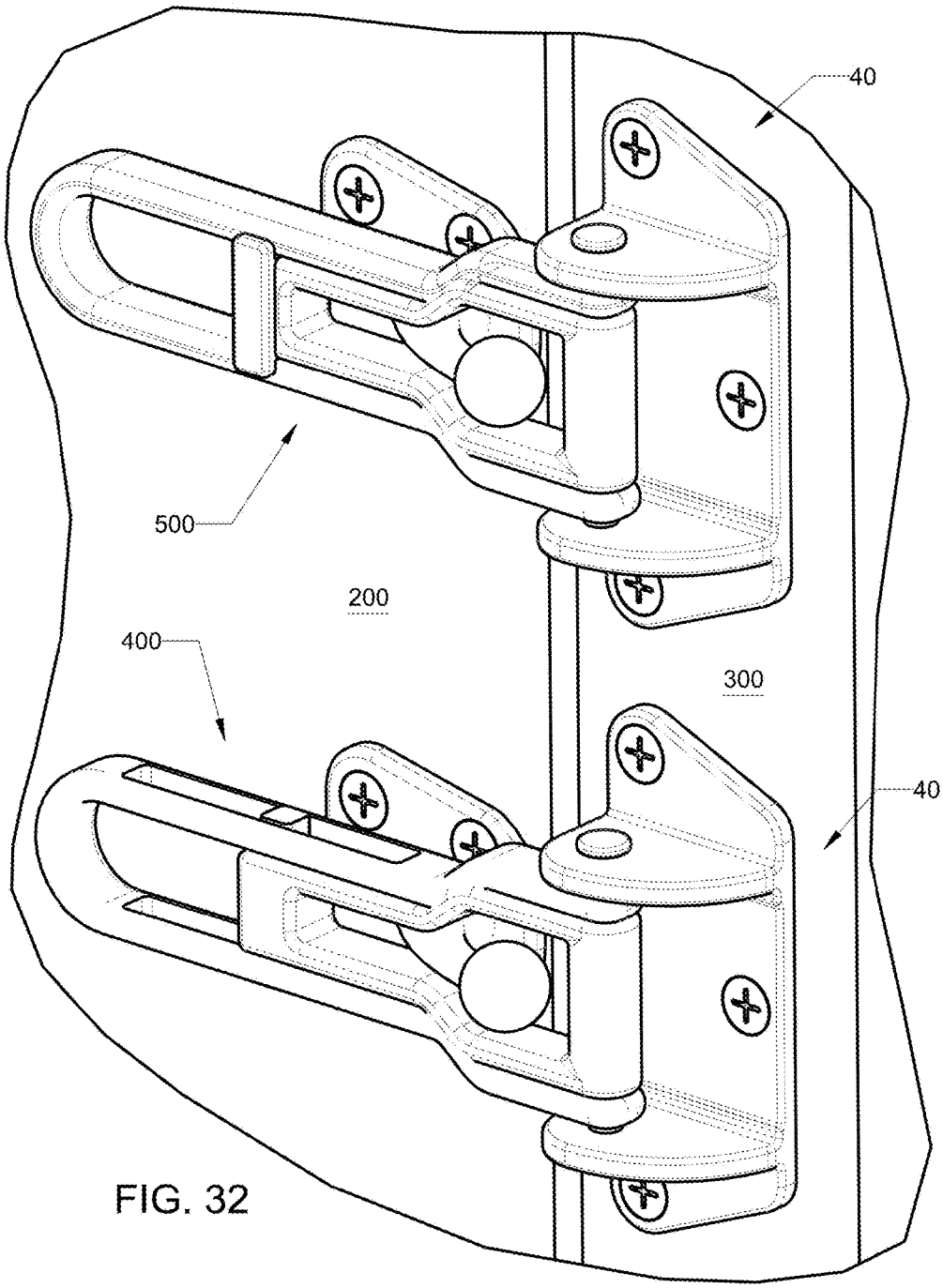
FIG. 32 is a partial perspective view illustrating the deformable latch system of FIG. 28 and the deformable latch system of FIG. 30 installed on the same door system, the deformable latch systems each shown in an armed configuration.
Figure 33:
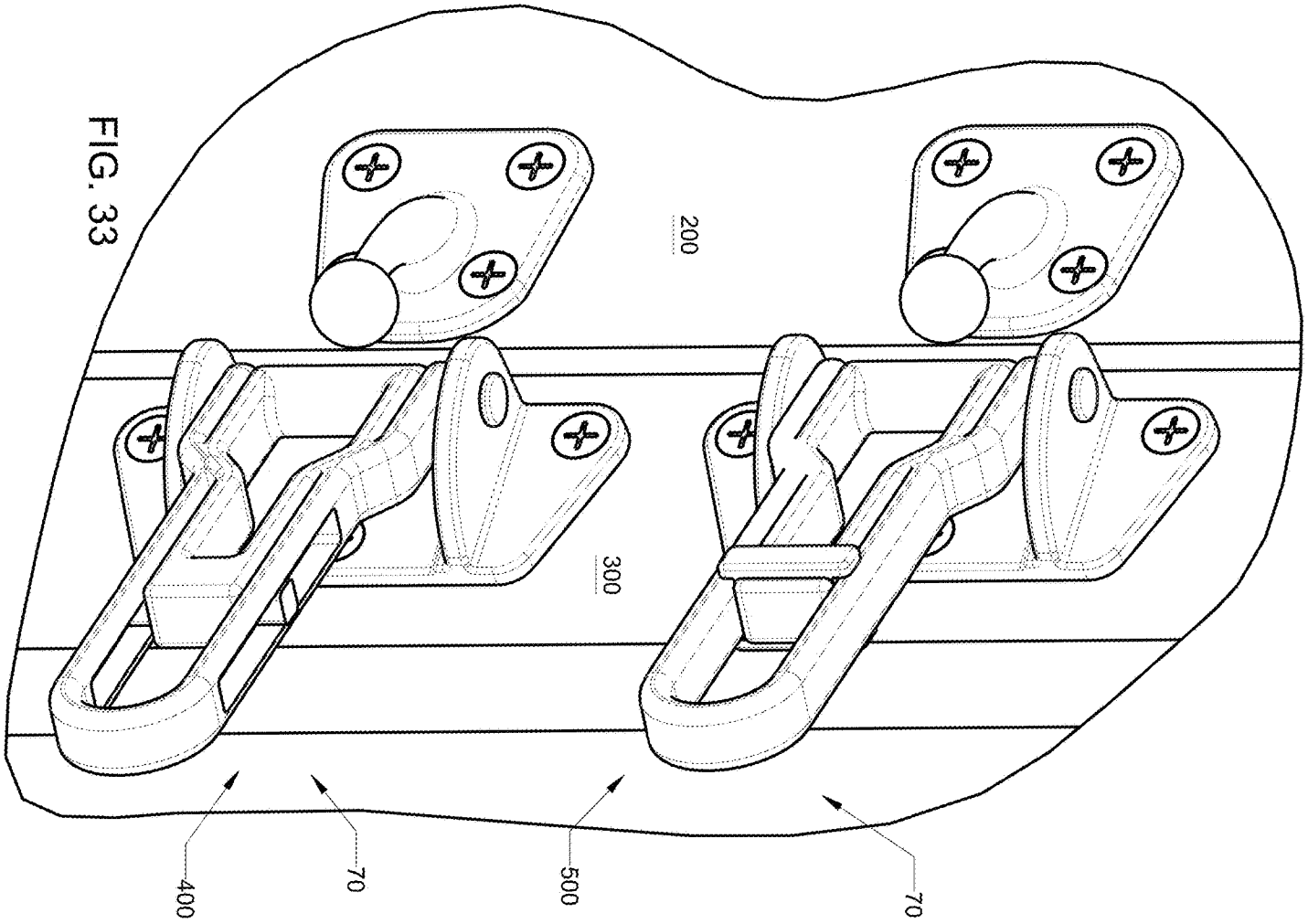
FIG. 33 is a partial perspective view of the deformable latch system of FIG. 28 and the deformable latch system of FIG. 30 each installed on the same door system of FIG. 32, the deformable latch systems each shown in a disengaged configuration.
Figure 34:
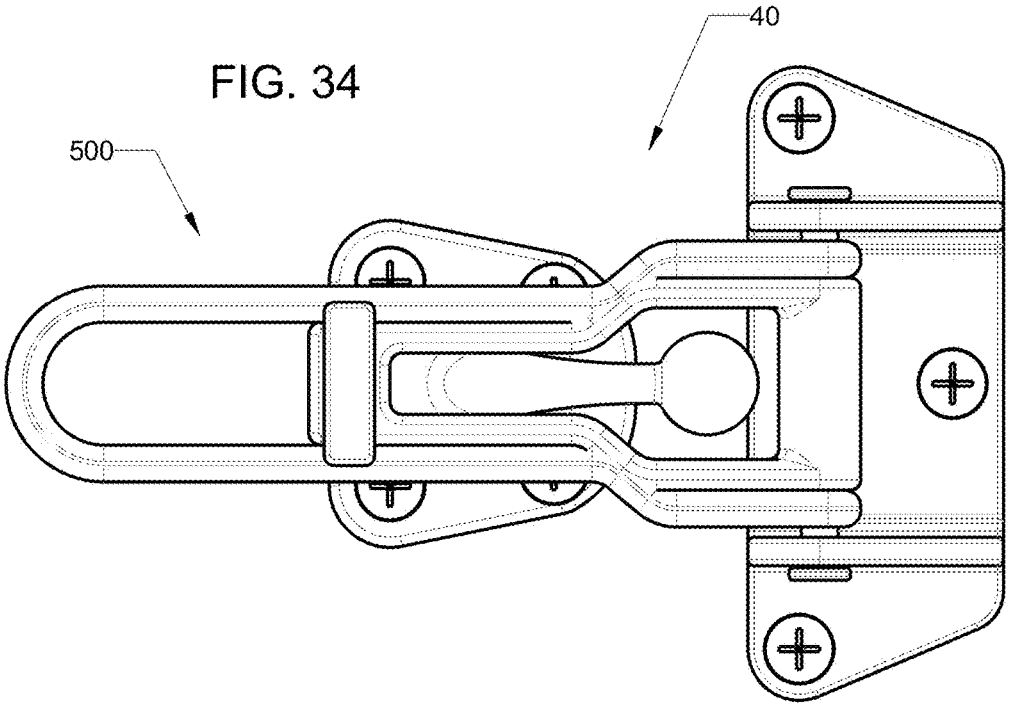
FIG. 34 is a front elevation view of the deformable latch system of FIG. 30, in the armed configuration of FIG. 32.
Figure 35:
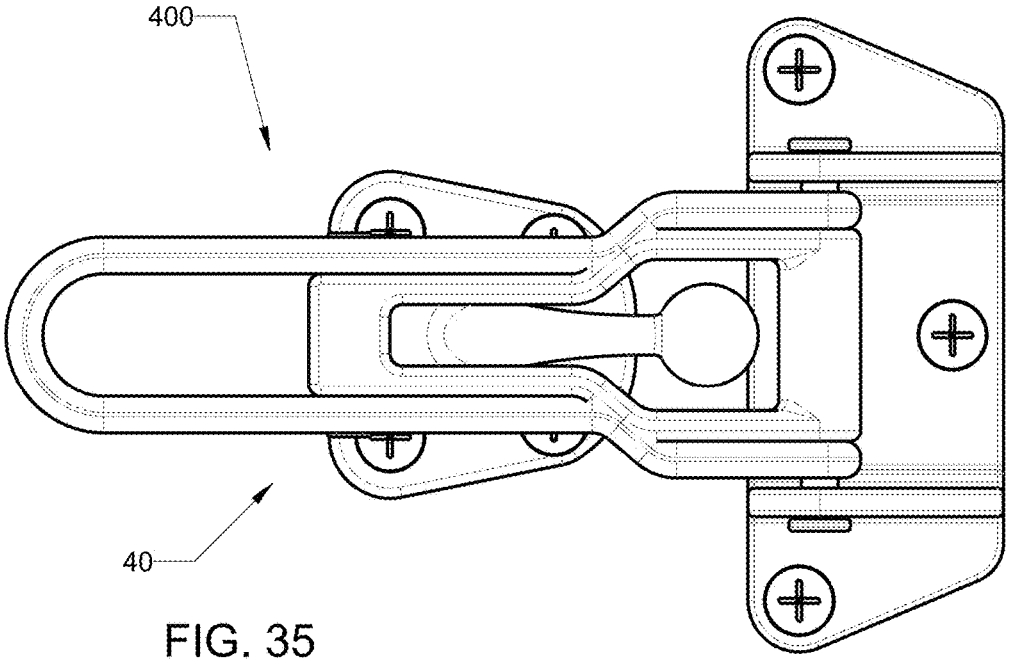
FIG. 35 is a front elevation view of the deformable latch system of FIG. 28, in the armed configuration of FIG. 32.
Figure 38:
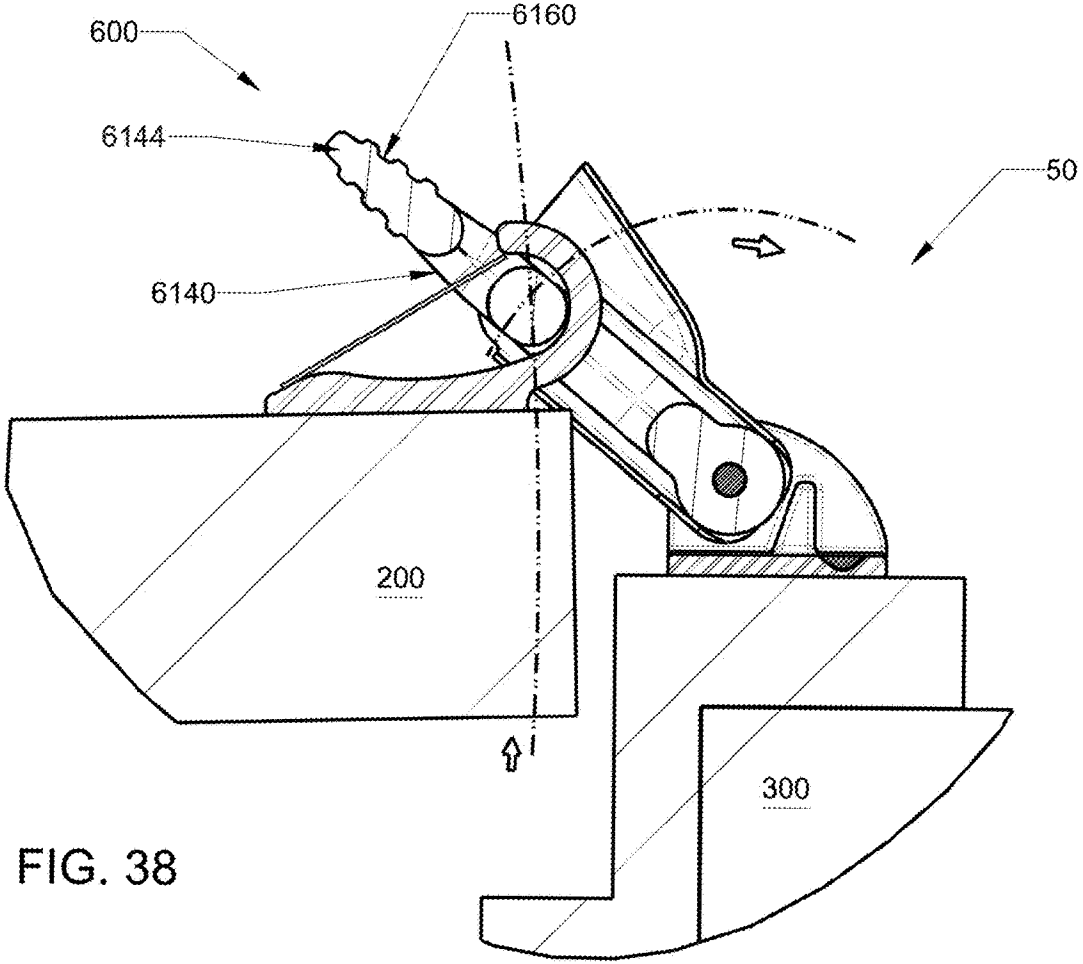
FIG. 38 is a partial cross-sectional plan view of yet another deformable latch system according to the principles of the present disclosure, the deformable latch system shown in an engaged configuration.

Turning now to FIGS. 28 and 29, still another embodiment of a deformable latch system 400 according to the principles of the present disclosure is illustrated. The deformable latch system 400 is similar to the deformable latch system 100. However, the housing 280 is replaced with a slide rail 4280 that guides and protects an energy absorbing member 4140. The deformable latch system 400 further includes a ball engagement structure similar to the ball structure 3228 of the deformable latch system 1300. FIGS. 32 and 33 illustrate the deformable latch system 400 in the closed configuration 40 and in the open configuration 70. As the rail 4280 is rotated between the closed configuration 40 and the open configuration 70, the energy absorbing member 4140 is also moved about the pivoting pin 190. Upon an intrusion load F being placed upon the door 200, a distal end 4144 slides along the rail 4280 and is guided by the rail 4280. Energy is absorbed as the deformable member 4140 is stretched. The rail 4280 may further provide protection from cutting of the energy absorbing member 4140.

Figure 30:
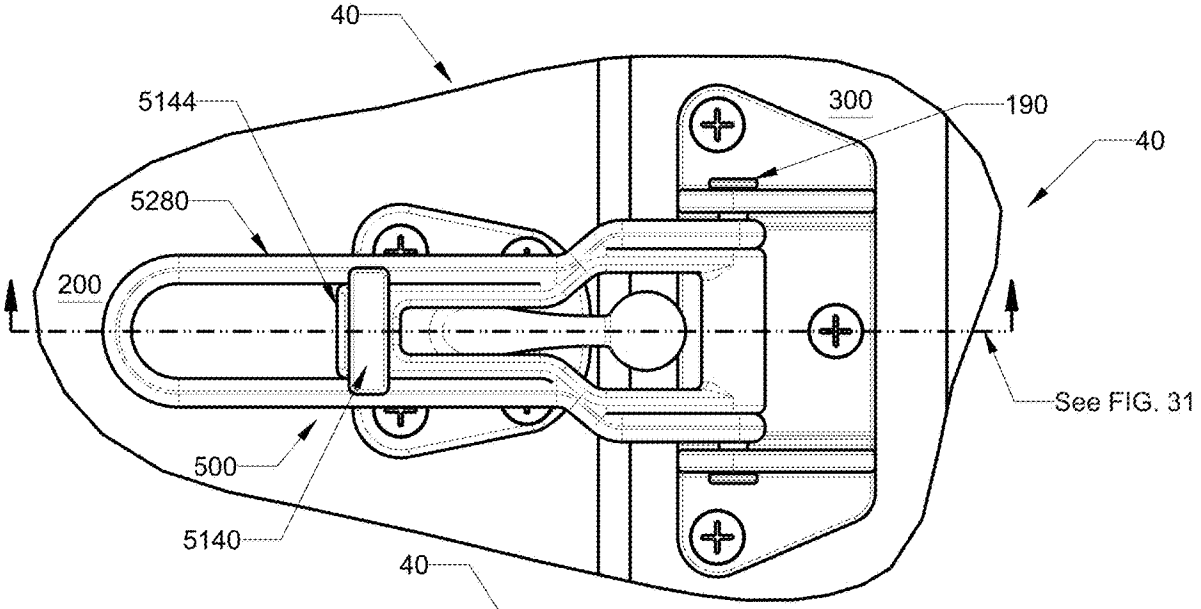
FIG. 30 is a partial front elevation view of still another deformable latch system according to the principles of the present disclosure.
Figure 31:
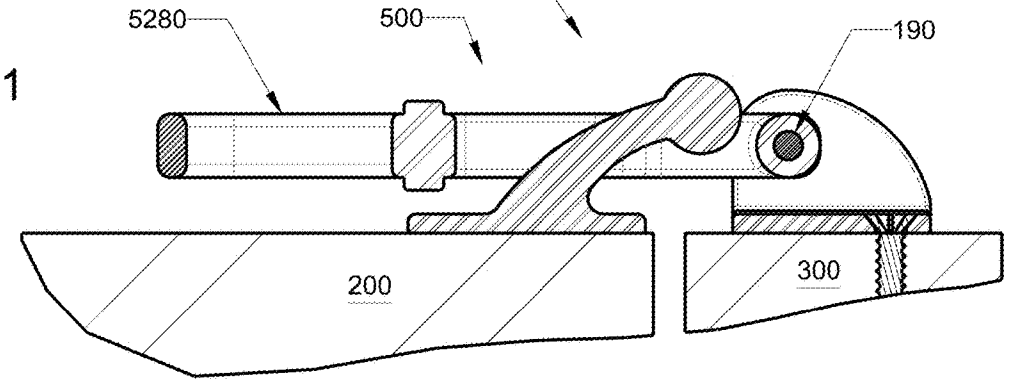
FIG. 31 is a partial cross-sectional plan view of the deformable latch system of FIG. 30, as called out at FIG. 30.

Turning now to FIGS. 30 and 31, yet another embodiment of a deformable latch system 500 is illustrated according to the principles of the present disclosure. The deformable latch system 500 is similar to the deformable latch system 400 except that a distal end 5144 of an energy absorbing member 5140 includes guiding features that are external to a rail 5280. The rail 5280 therefor may omit internal guiding features found on the rail 4280.

Turning now to FIGS. 38-42, still another embodiment of a deformable latch system 600 is illustrated according to the principles of the present disclosure. The deformable latch system 600 is similar to the deformable latch system 100. However, the energy absorbing member 6140 further includes a gripping portion 6160 at a distal end 6144 of the energy absorbing member 6140. The gripping portion 6160 may be used to assist in removing the energy absorbing member 6140 from the catch member 220. A hook 6228 of the deformable latch system 600 may extend around an angle greater than 180 degrees and thereby form a cusp that traps a loop 6148 within the hook 6228. An operator may release the loop 6148 from the cusp of the hook 6228 by pulling on the grip 6160. In addition, a housing 6280 (i.e., a cover) may include a slot that allows the hook 6228 to protrude through the cover 6280.

The energy absorbing member 140, 3140, 4140, 5140, 6140 may further include the following materials, either alone or in combination with other material or materials.

Viton Extreme from DuPont
Tetrafluoroethylene Propylene, FEPM
Silicone Rubber, VMQ/PVMQ
Polyurethane Elastomer, AU or EU
Polysulphide Rubber, TR
Perfluoroelastomer, FFKM—known as the DuPont product Kalrez
Hydrogenated Nitrile Rubber, HNBR
Nitrile Butadiene Rubber, NBR
Fluorosilicone, FVMQ
Fluorelastomere, FKM/FPM, also known as Viton Elastomer by DuPont
Ethylene Propylene Copolymer EPM or EPDM
Epichlorhydrin (CO)
Chlorosulphonated Polyethylene (CSM)
Chloronated Polyethylene (CPE)
Ethylene Acrylic, AEM
Alkyl Acrylic copolymer, ACM
Polychloroprene, CR
Chlorobutyl Rubber (CIIR)
Isobutylene-isopropene copolymere (IIR)
Polybutadiene (BR)
Stryrene Butadiene (SBR)
Synthetic cis-polyisoprene (IR)
Natural Cis-Polyisoprene (NR)

In the embodiments described above, a spring material (e.g., spring steel, spring wire, etc.) may be embedded in the deformable member 140, 3140, 4140, 5140, and/or 6140. In certain embodiments, the spring material may be a wire-form. In certain embodiments, the spring material may be a coil spring. In certain embodiments, the coil spring may operate as a tension coil spring when the intrusion load F is placed upon the door 200. In certain embodiments, the coil spring may operate as a compression coil spring when the intrusion load F is placed upon the door 200. By encapsulating (i.e., embedding) the spring material within the deformable member 140, 3140, 4140, 5140, 6140, the deformable member 140, 3140, 4140, 5140, 6140 may provide a smooth and/or aesthetically pleasing appearance, at least when in normal use. Upon the intrusion load F being placed upon the door 200, the spring material may serve as a reinforcing material to the deformable member 140, 3140, 4140, 5140, 6140. In certain embodiments and/or under certain levels of the intrusion load F, the spring material may remain encapsulated in the deformable member 140, 3140, 4140, 5140, 6140. In other embodiments, the intrusion load F may result in separation of the spring material from the deformable member 140, 3140, 4140, 5140, 6140 and energy may be absorbed by the action of the spring material separating from the deformable member 140, 3140, 4140, 5140, 6140.

FIGS. 43-67 illustrate additional embodiments of a deformable latch system 1400, 1500, 1600, 1700, 1800, and 1900 that are further described below. The deformable latch systems 1400, 1500, 1600, 1700, 1800, and/or 1900 are suitable for encapsulation in the various materials listed above.

Figure 43:
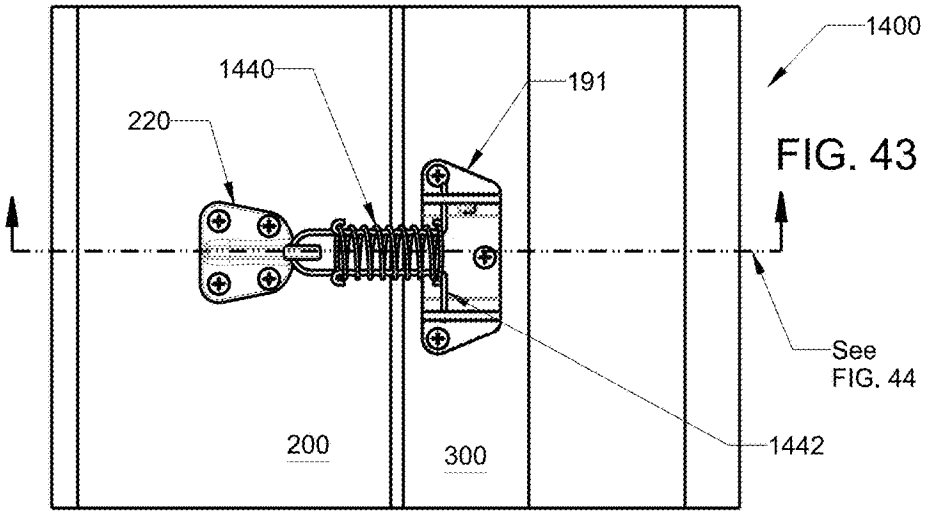
FIG. 43 is a partial front elevation view of still another deformable latch system according to the principles of the present disclosure, the deformable latch system shown in an armed configuration.
Figure 44:
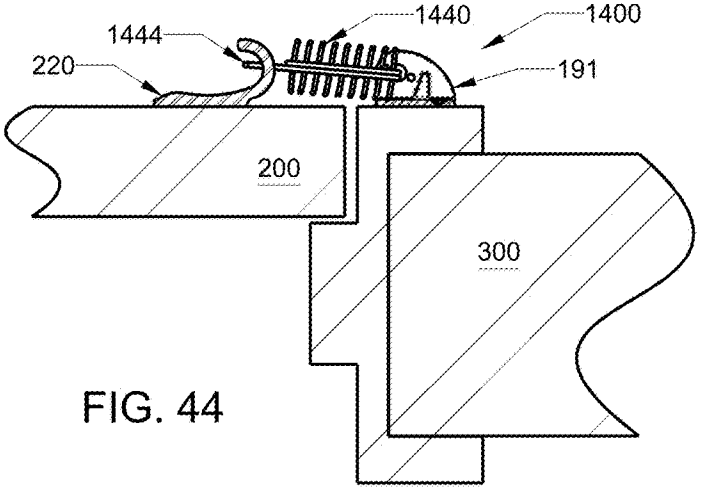
FIG. 44 is a partial cross-sectional plan view of the deformable latch system of FIG. 43, as called out at FIG. 43.
Figure 45:
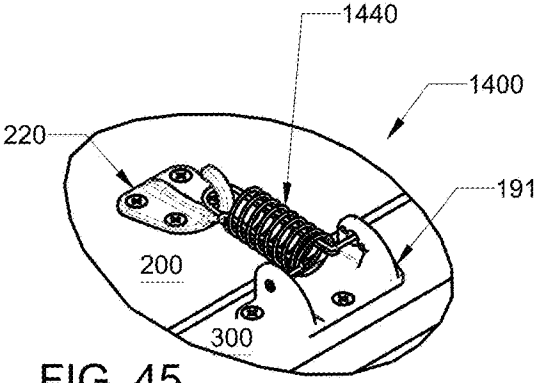
FIG. 45 is a perspective view illustrating the deformable latch system of FIG. 43 shown in the armed configuration of FIG. 43.
Figure 46:
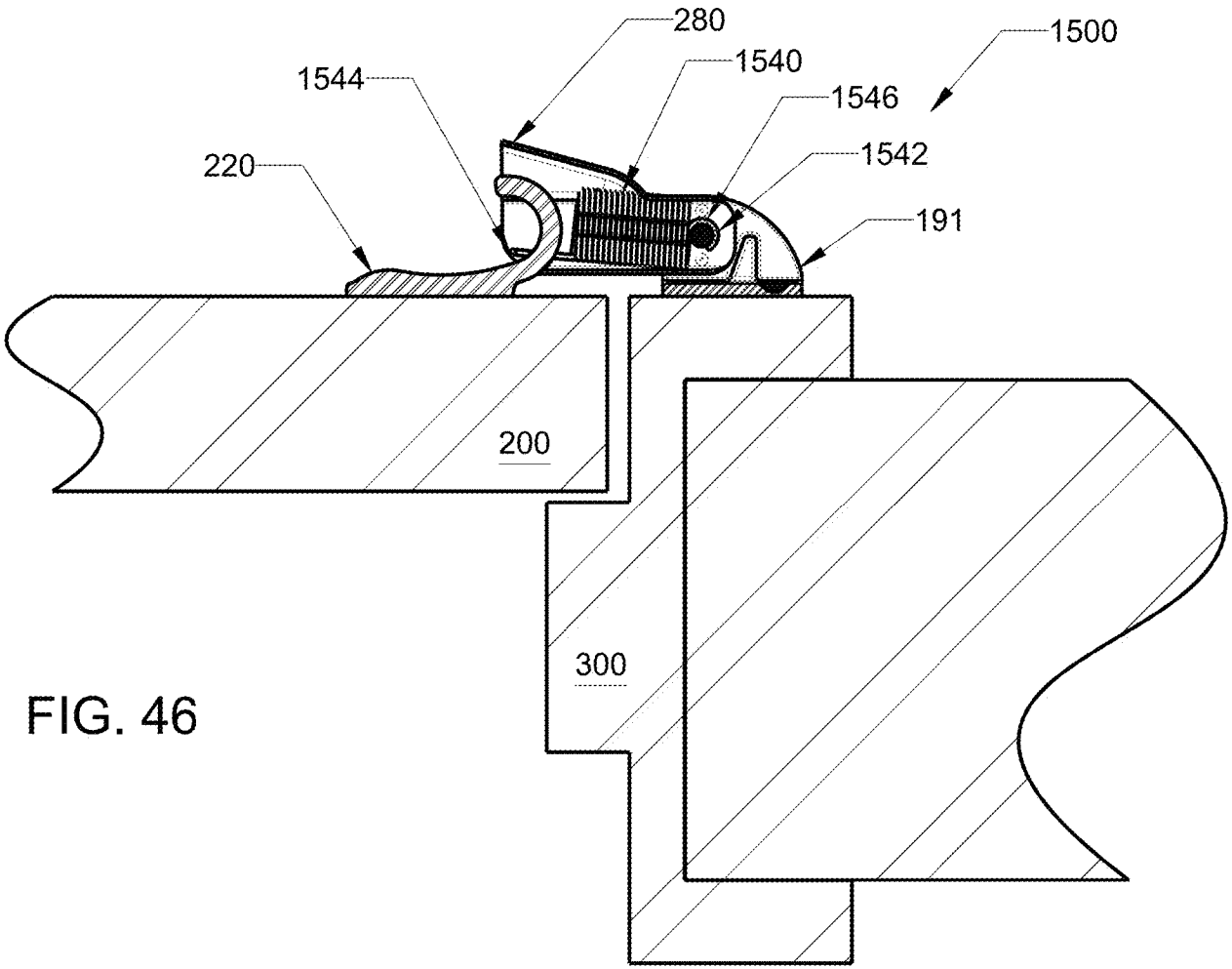
FIG. 46 is a partial cross-sectional plan view of yet another deformable latch system according to the principles of the present disclosure, the deformable latch system shown in an armed configuration.
Figure 47:
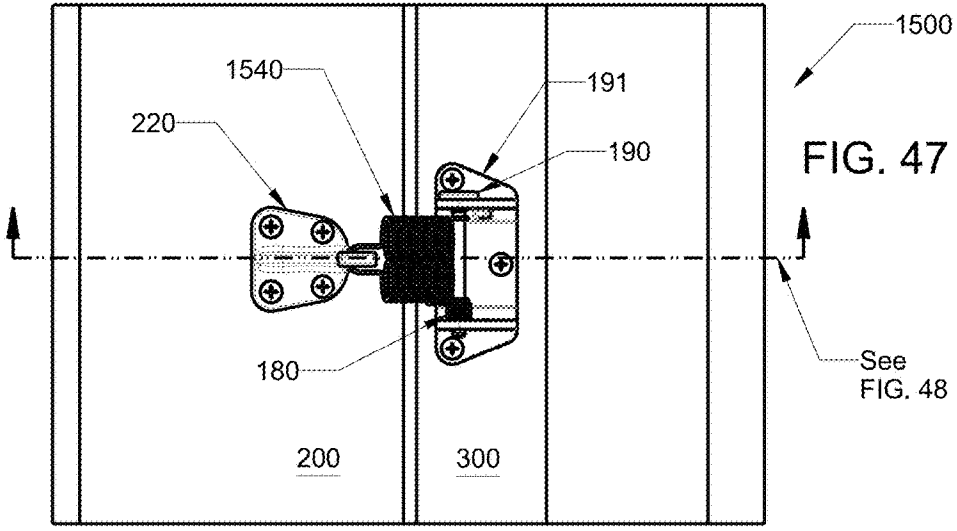
FIG. 47 is a partial front elevation view of the deformable latch system of FIG. 46 shown in the armed configuration of FIG. 46 and without a shielding cover.
Figure 48:
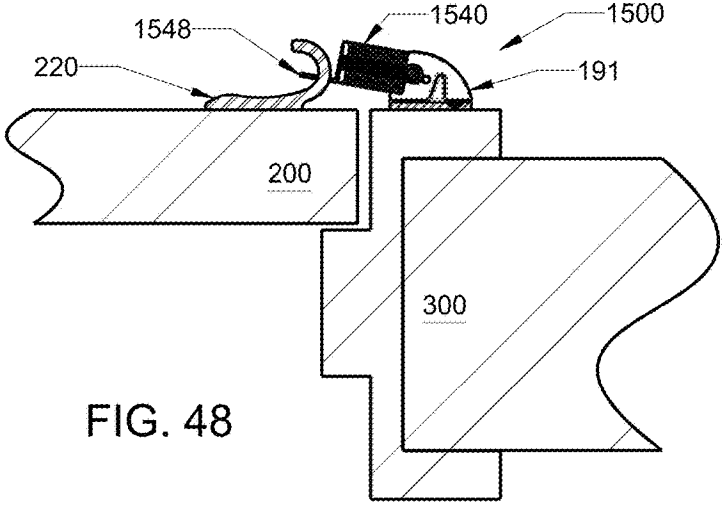
FIG. 48 is a partial cross-sectional plan view of the deformable latch system of FIG. 46, as called out at FIG. 47.
Figure 49:
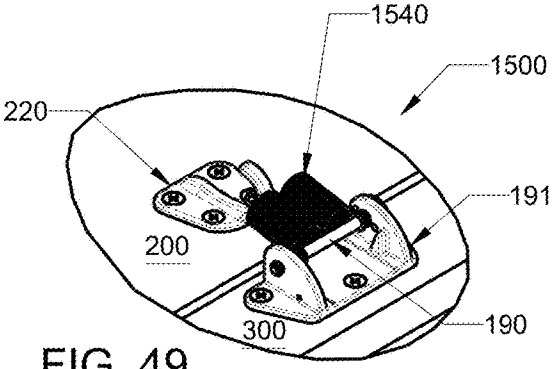
FIG. 49 is a partial perspective view illustrating the deformable latch system of FIG. 46 shown in the armed configuration of FIG. 46 and without a shielding cover.
Figure 50:
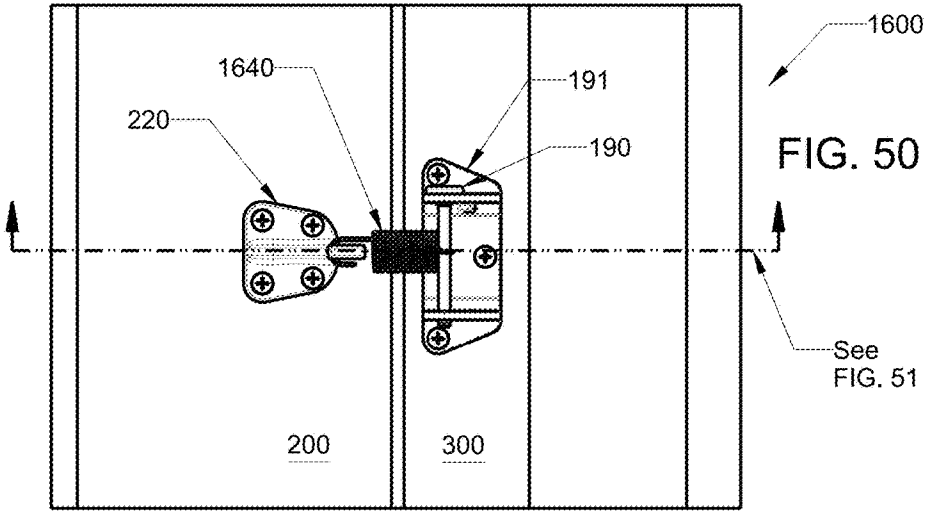
FIG. 50 is a partial front elevation view of still another deformable latch system according to the principles of the present disclosure, the deformable latch system shown in an armed configuration.
Figure 51:
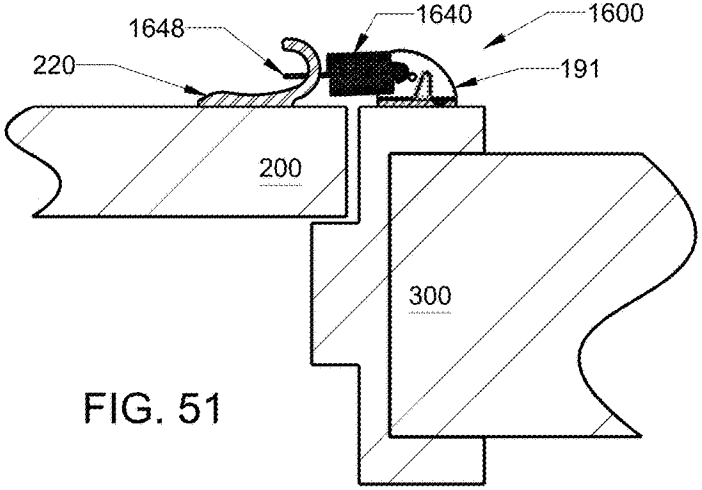
FIG. 51 is a partial cross-sectional plan view of the deformable latch system of FIG. 50, as called out at FIG. 50.
Figure 52:
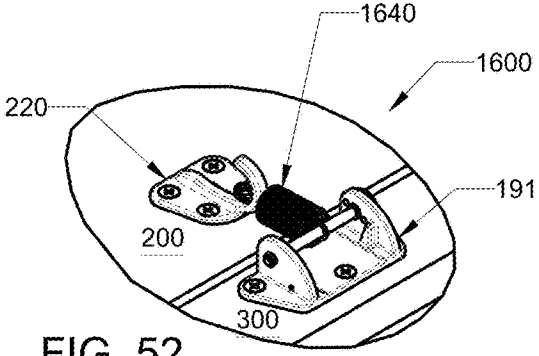
FIG. 52 is a partial perspective view illustrating the deformable latch system of FIG. 50 shown in the armed configuration of FIG. 50.
Figure 53:
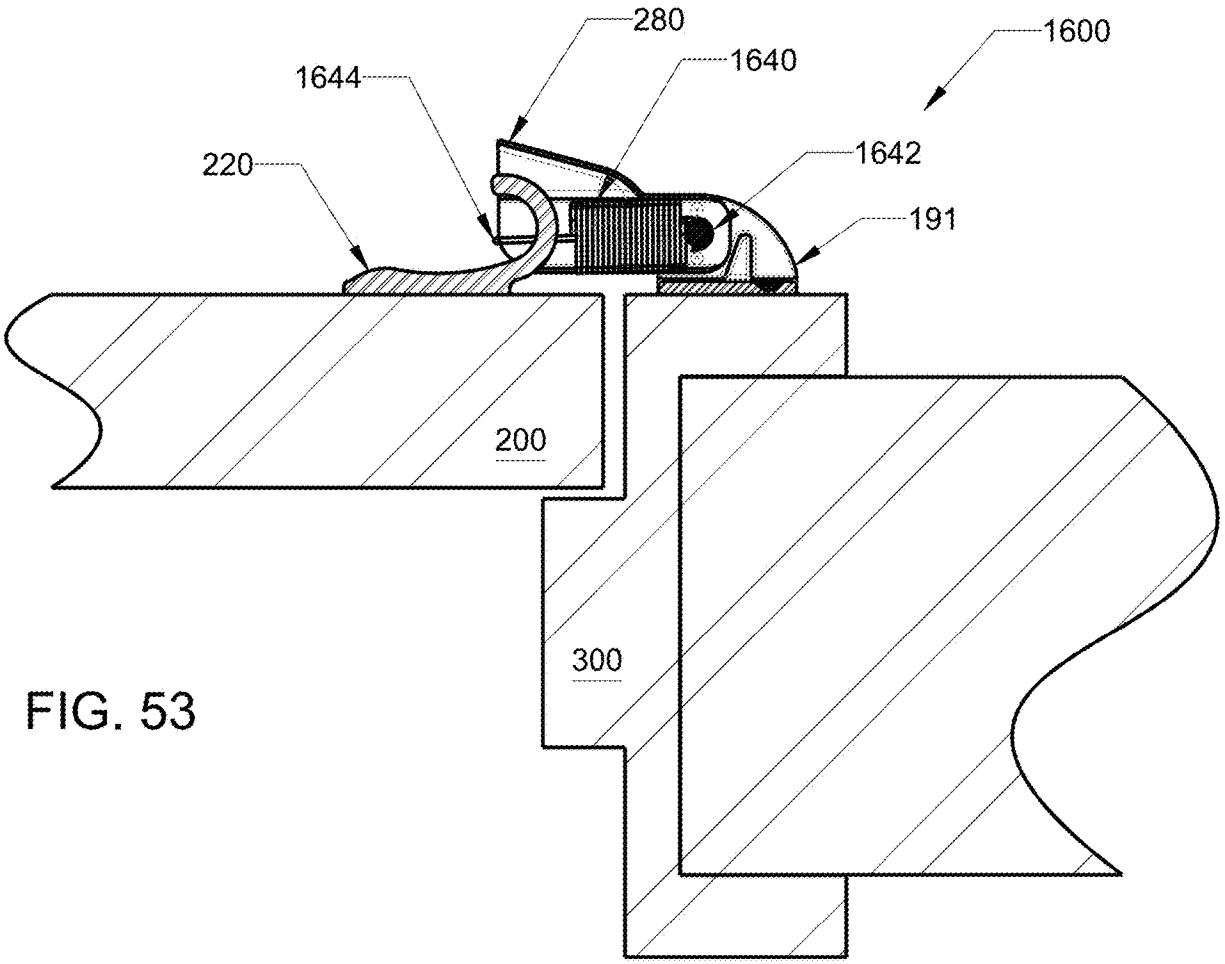
FIG. 53 is a cross-sectional plan view of the deformable latch system of FIG. 50 shown in the armed configuration of FIG. 50 and with a shielding cover.

Turning now to FIGS. 43-45, the deformable latch system 1400 will be described in detail. The deformable latch system 1400 includes a catch member 220, a base 191, and a spring assembly 1440. The catch member 220 and/or the base 191 may be similar to and/or the same as the catch members and/or the bases described above. As mentioned above, the spring assembly 1440 may be encapsulated in one or more of the materials listed above. In other embodiments, the spring assembly 1440 may be used without encapsulation and/or without a housing (e.g., the housing 280).

As depicted, the spring assembly 1440 is a compression spring assembly and is further illustrated at FIGS. 64-67. By being a compression spring assembly, the spring assembly 1440 places a compression spring 1450 in compression when the intrusion load F is placed upon the door 200. In certain embodiments, the compression spring 1450 may bottom out upon a certain extension of the spring assembly 1440 being reached. In certain embodiments, the compression spring 1450 includes a substantially linear spring rate over a range of motion. In other embodiments, the compression spring 1450 may include a variable spring rate as the compression spring 1450 is moved about the range of motion. In certain embodiments, the spring rate of the compression spring 1450 may increase as the spring assembly 1440 is stretched by the intrusion load F being placed upon the door 200. In certain embodiments, the compression spring 1450 may be preloaded (i.e., may include an initial pre-load) when the spring assembly 1440 is at an unloaded (i.e., a minimum extension length) configuration.

As depicted at FIGS. 64-67, the spring assembly 1440 extends between a first end 1442 and a second end 1444. At the first end 1442, the spring assembly 1440 may define a pin-like structure 1446. The pin structure 1446 may function similar to the pivoting pin 190, described above, in relation to the base 191. The second end 1444 of the spring assembly 1440 may define a loop 1448. In certain embodiments, the loop 1448 may be open and thereby have a form of a hook. The loop 1448 may function similar to or the same as the loop 148 and/or the opening 149 of the energy absorbing member 140, described above, in relation to the catch member 220.

The compression spring 1450 extends between a first end 1452 and a second end 1454. In the depicted embodiment, the spring 1450 includes an opening 1456 that extends between the first end 1452 and the second end 1454.

The spring assembly 1440 further includes a base member 1460 and a loop member 1480. As depicted, the base member 1460 includes the pin 1446 of the spring assembly 1440, and the loop member 1480 includes the loop 1448 of the spring assembly 1440. In the depicted embodiment, the base member 1460 and the loop member 1480 each reach through the opening 1456 of the spring 1450 and thereby attach to opposite ends 1452, 1454 of the spring 1450. In particular, the base member 1460 includes a first end 1462 that corresponds with the first end 1442 of the spring assembly 1440. The base member 1460 further includes a second end 1464 that attaches to the second end 1454 of the spring 1450. The loop member 1480 extends between a first end 1482 and a second end 1484. The second end 1484 of the loop member 1480 corresponds with the second end 1444 of the spring assembly 1440. The first end 1482 of the loop member 1480 attaches to the first end 1452 of the spring 1450. As depicted, the base member 1460 and/or the loop member 1480 may be made of a wireform. As depicted, the base member 1460 may include a pair of wireforms.

Turning now to FIGS. 46-49, the deformable latch system 1500 will be described. The deformable latch system 1500 is similar to the deformable latch system 1400, described above, in that it includes the catch member 220 and the base 191. In addition, the deformable latch system 1500 further includes the pivoting pin 190, the spring 180, and a spring 1540. In certain embodiments, the spring 180 and the pivoting pin 190 may also be included on the deformable latch system 1400. The spring 180 and the pivoting pin 190 are described above and serve a similar purpose in the deformable latch system 1500. The deformable latch system 1500 may further include the housing 280, described above. In certain embodiments, the deformable latch system 1400 may also include the housing 280. The housing 280 may serve a similar purpose in the deformable latch systems 1400, 1500, as that described above. In addition, the housing 280 may serve as a guide to the spring 1540 and/or the spring 1450 or the spring assembly 1440.

As depicted, the spring 1540 extends between a first end 1542 and a second end 1544. The first end 1542 of the spring 1540 may define an attachment 1546 to the pivoting pin 190, and the second end 1544 may define a loop 1548. As depicted, the spring 1540 is a tension spring. As the spring 1540 is a tension spring, the spring 1540 stretches (i.e., extends) when the intrusion load F is placed upon the door 200. As depicted, the spring 1540 includes two coils joined by the loop 1548. The spring 1540 may be formed of a single wire wire-form.

Turning now to FIGS. 50-53, the deformable latch system 1600 will be described. The deformable latch system 1600 is similar to the deformable latch system 1500. However, the deformable latch system 1600 includes a spring 1640 with differences from the spring 1540. In particular, the spring 1640 extends between a first end 1642 and a second end 1644. The second end 1644 includes a loop 1648 with an open hook. The spring 1640 is illustrated with a single coil.

Figure 56:
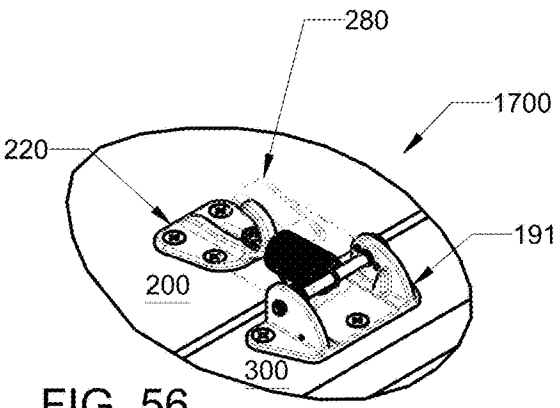
FIG. 56 is a partial perspective view illustrating the deformable latch system of FIG. 54 shown in the armed configuration of FIG. 54 and with the covering shield in phantom line.
Figure 54:
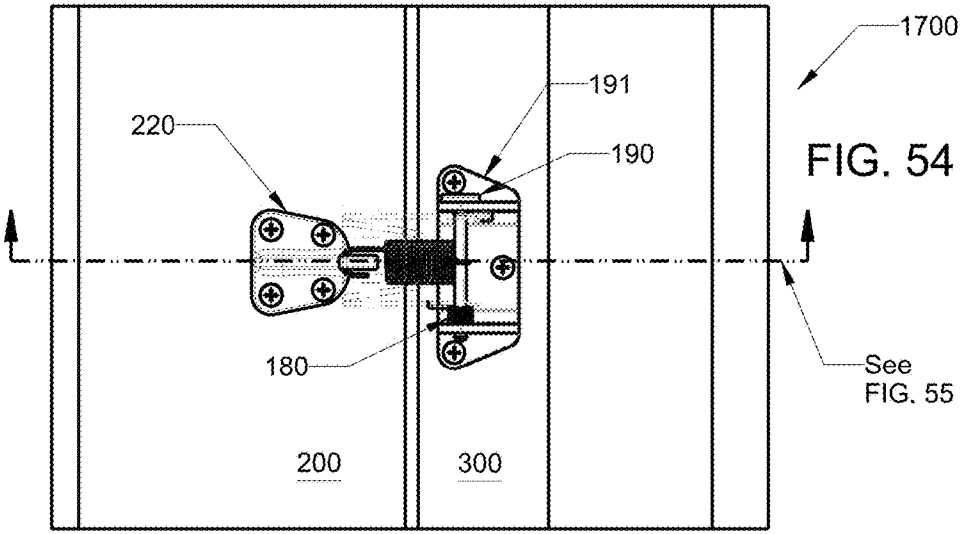
FIG. 54 is a partial front elevation view of yet another deformable latch system according to the principles of the present disclosure, the deformable latch system shown in an armed configuration and with a covering shield in phantom line.
Figure 55:
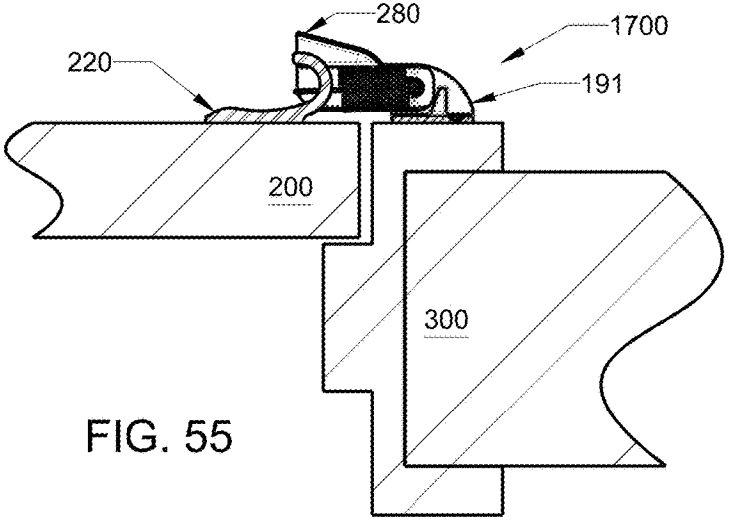
FIG. 55 is a partial cross-sectional plan view of the deformable latch system of FIG. 54, as called out at FIG. 54.
Figure 57:
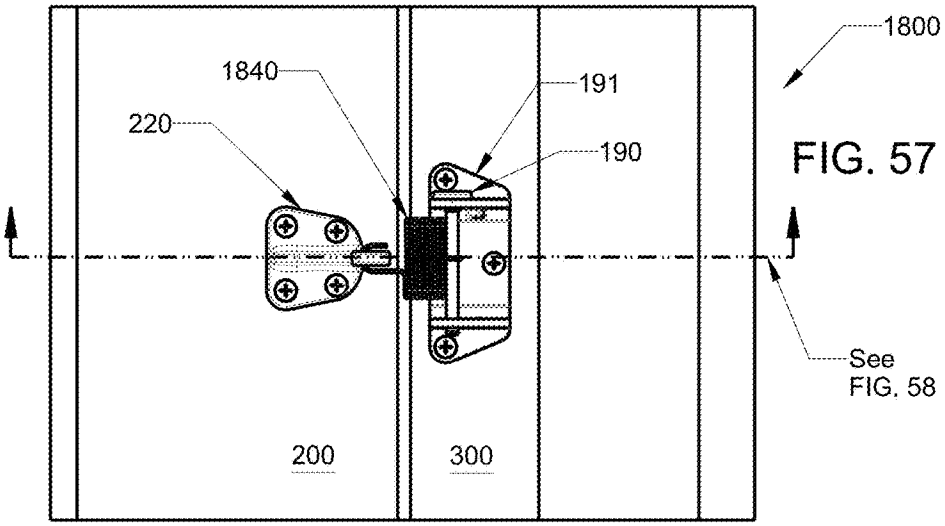
FIG. 57 is a partial front elevation view of still another deformable latch system according to the principles of the present disclosure, the deformable latch system shown in an armed configuration.
Figure 58:
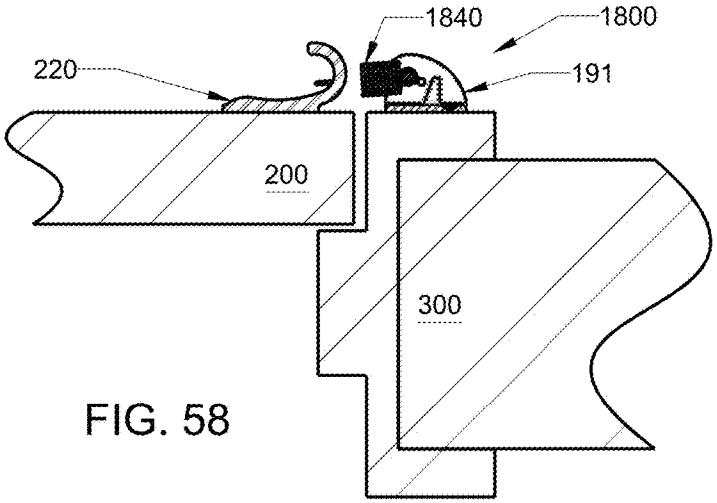
FIG. 58 is a partial cross-sectional plan view of the deformable latch system of FIG. 57, as called out at FIG. 57.
Figure 59:
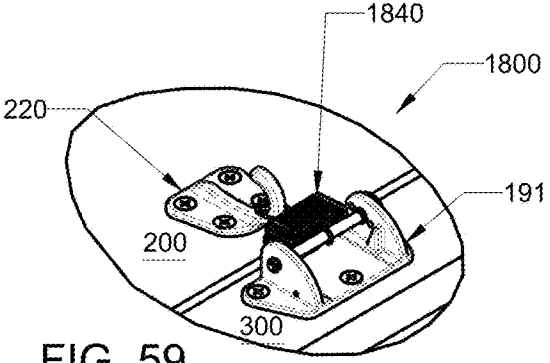
FIG. 59 is a partial perspective view illustrating the deformable latch system of FIG. 57 shown in the armed configuration of FIG. 57.
Figure 60:
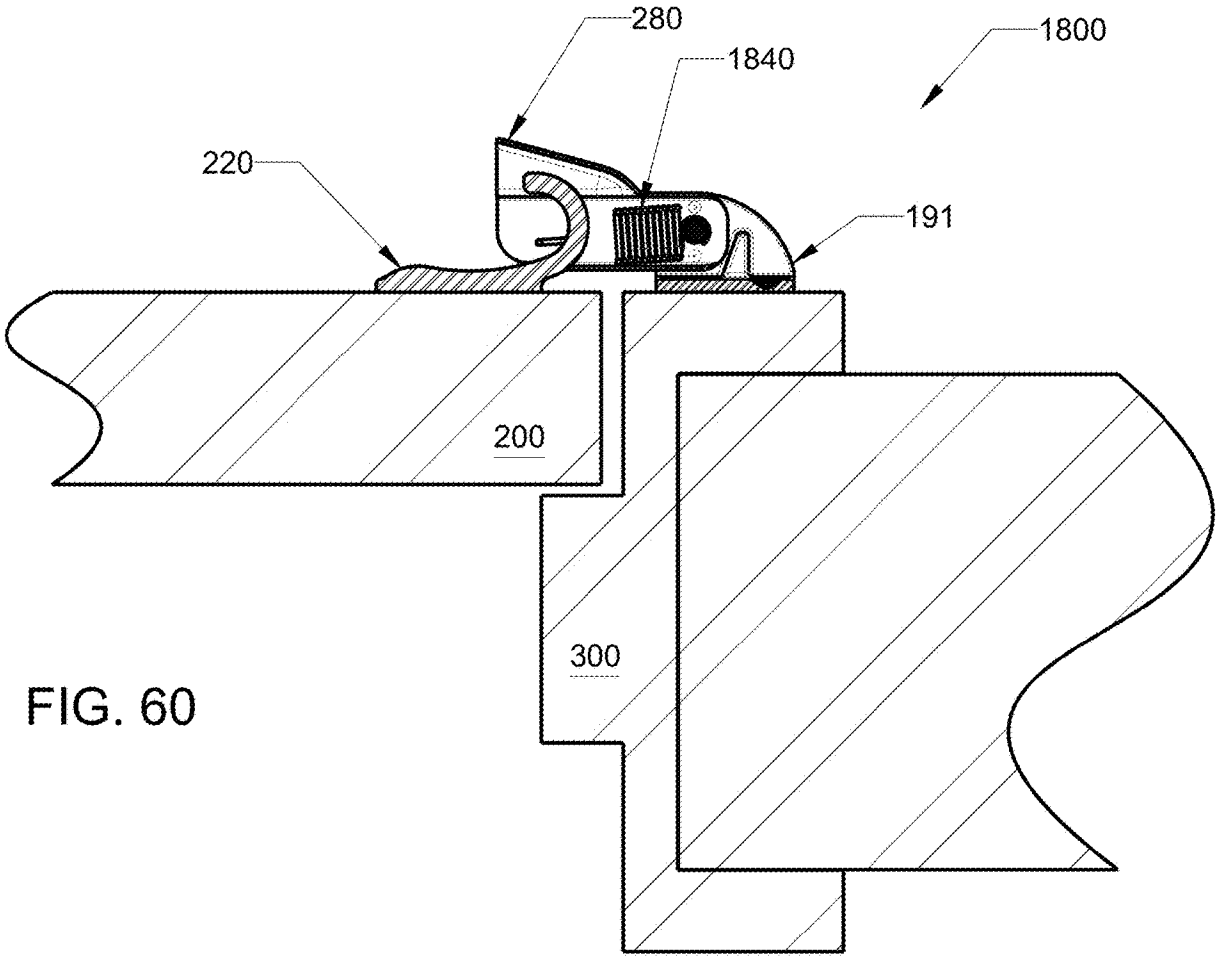
FIG. 60 is a partial cross-sectional plan view of the deformable latch system of FIG. 57 shown in the armed configuration of FIG. 57 and with a shielding cover.

Turning now to FIGS. 54-56, the deformable latch system 1700 is illustrated. The deformable latch system 1700 is similar to the deformable latch system 1600 but further includes the spring 180 and the housing 280.

Turning now to FIGS. 57-60, the deformable latch system 1800 is illustrated. The deformable latch system 1800 is similar to the deformable latch system 1600. However, the deformable latch system 1800 includes a spring 1840 that is different from the spring 1640. In particular, the spring 1840 includes a rectangular coil.

Figure 61:
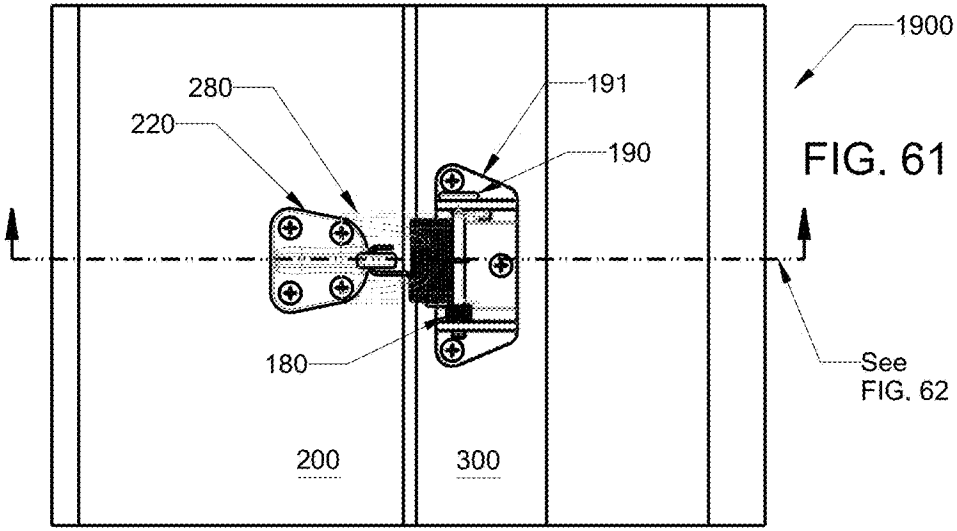
FIG. 61 is a partial front elevation view of yet another deformable latch system according to the principles of the present disclosure, the deformable latch system shown in an armed configuration and with a covering shield in phantom line.
Figure 63:
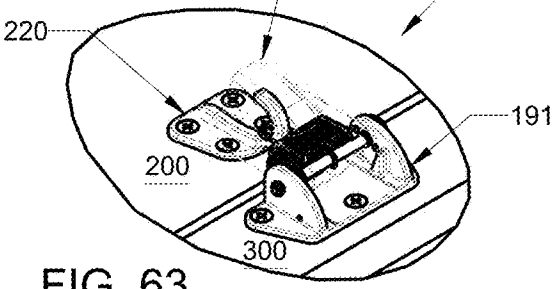
FIG. 63 is a partial perspective view illustrating the deformable latch system of FIG. 61 shown in the armed configuration of FIG. 61 and with the covering shield in phantom line.
Figure 62:
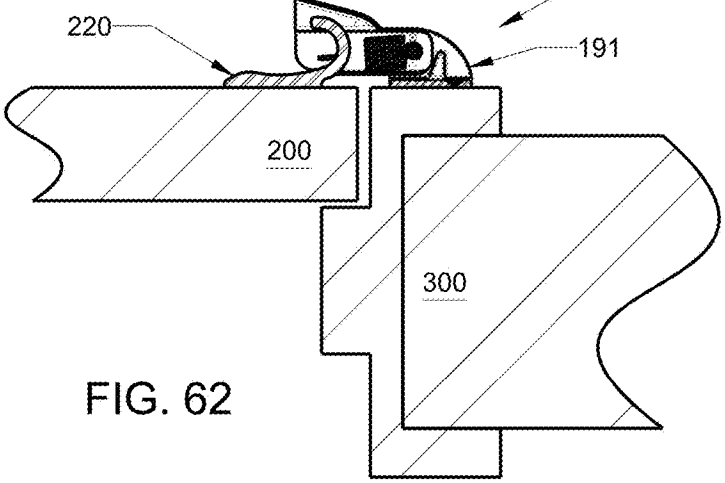
FIG. 62 is a partial cross-sectional plan view of the deformable latch system of FIG. 61, as called out at FIG. 61.
Figure 66:
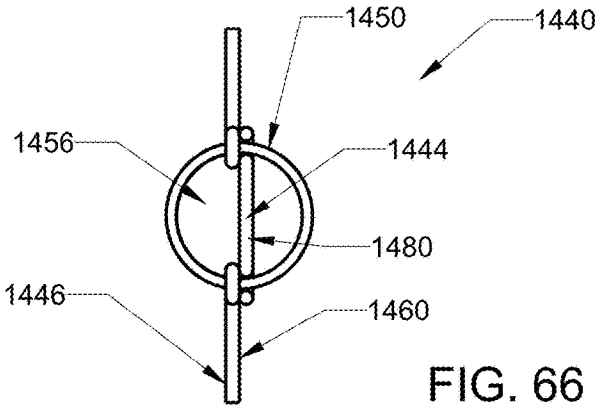
FIG. 66 is a side elevation view of the spring assembly of FIG. 64.
Figure 67:
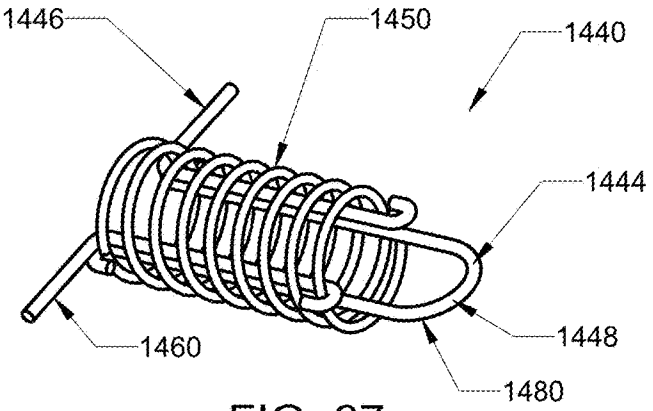
FIG. 67 is a perspective view of the spring assembly of FIG. 64.
Figure 64:
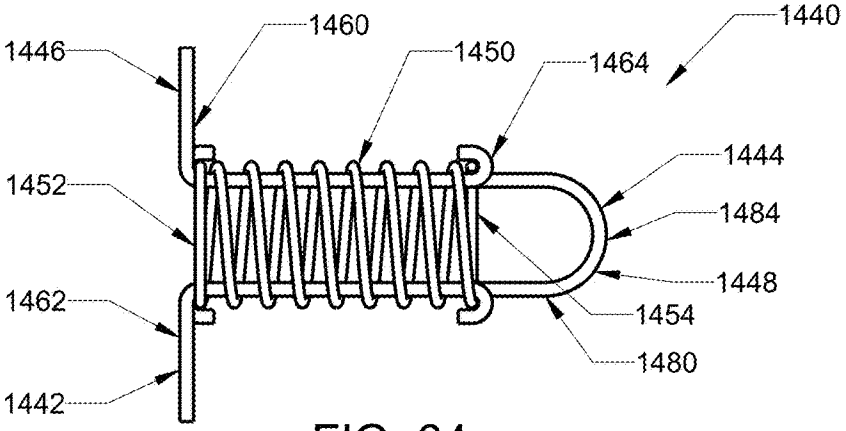
FIG. 64 is an elevation view of a spring assembly adapted for use with the deformable latch system of FIG. 43.
Figure 65:
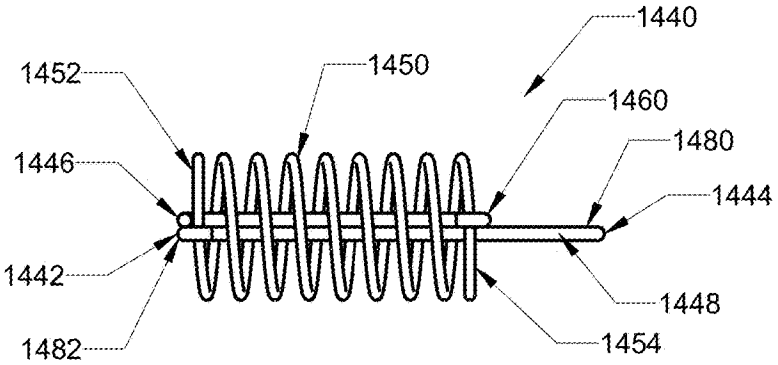
FIG. 65 is a bottom plan view of the spring assembly of FIG. 64.

Turning now to FIGS. 61-63, the deformable latch system 1900 will be described. The deformable latch system 1900 is similar to the deformable latch system 1800. However, the deformable latch system 1900 further includes the housing 280 and the spring 180.

This application is related to U.S. Provisional Patent Application Ser. No. 61/782,542, filed Mar. 14, 2013, and entitled ENERGY ABSORBING LOCK SYSTEMS AND METHODS which is incorporated herein by reference in its entirety. The subject matter of U.S. Provisional Patent Application Ser. No. 61/782,542 and the subject matter of the present patent application may be used on the same door 200 and/or door frame 300.

Features of the various embodiments disclosed herein may be mixed and/or matched to form new embodiments according to the principles of the present disclosure, where appropriate. It is understood that doors come in right hand and left hand varieties. Likewise, the deformable latch systems disclosed herein may be configured for right hand or left hand doors. In certain embodiments, the deformable latch systems may be dedicated to work with either a right hand door or a left hand door. In other embodiments, the deformable latch systems may be reconfigurable for use with a right hand door or a left hand door.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A door securing device adapted to resist significant opening of a door when set to an engaged configuration and adapted to allow opening of the door when set to a disengaged configuration, the door securing device comprising: a base member including a base end and a first joint portion; a monolithic deformable member extending along a length between a first end and a second end, the first end including a second joint portion and the second end including a catching portion; a configuration joint adapted to configure the door securing device in the engaged configuration and also adapted to configure the door securing device in the disengaged configuration, the configuration joint including the first joint portion of the base member and the second joint portion of the monolithic deformable member; a catch member including a base end and a catch, the catch of the catch member adapted to directly engage the catching portion of the monolithic deformable member at least when the door securing device is resisting the significant opening of the door in the engaged configuration; and a shield positioned circumferentially around the monolithic deformable member, the shield adapted to resist cutting and thereby protect the monolithic deformable member from the cutting; wherein the monolithic deformable member is adapted to deform and thereby increase the length of the monolithic deformable member at least five percent when resisting the significant opening of the door.

2. The door securing device of claim 1, wherein the base end of the base member is adapted to mount to a door frame and the base end of the catch member is adapted to mount to the door.

3. The door securing device of claim 2, wherein the base end of the base member includes at least one fastener hole and the base end of the catch member includes at least one fastener hole, wherein the base end of the base member is adapted to be mounted to the door frame with at least one door frame fastener positioned through the at least one fastener hole of the base member, and wherein the base end of the catch member is adapted to be mounted to the door with at least one door fastener positioned through the at least one fastener hole of the catch member.

4. The door securing device of claim 1, wherein the configuration joint is a rotatable joint.

5. The door securing device of claim 4, wherein the rotatable joint includes at least one hole in the first joint portion of the base member, at least one hole in the second joint portion of the monolithic deformable member, and a pin positioned within the holes.

6. The door securing device of claim 5, further comprising a spring urging the monolithic deformable member to rotate about an axis of the pin and thereby urge the door securing device toward an armed configuration.

7. The door securing device of claim 1, wherein the catch member includes a hook.

8. The door securing device of claim 1, wherein the catching portion includes a loop.

9. The door securing device of claim 1, wherein the length of the monolithic deformable member is free to increase with respect to the shield.

10. The door securing device of claim 9, wherein the shield does not substantially resist the significant opening of the door.

11. The door securing device of claim 1, wherein the shield is pivotally mounted to the base member.

12. The door securing device of claim 11, wherein the configuration joint is a rotatable joint with an axis and wherein the shield is pivotally mounted to the base member at a pivoting joint co-axial with the axis of the rotatable joint.

13. The door securing device of claim 12, further comprising a torsion spring adapted to urge the monolithic deformable member and the shield to rotate about the axis of the rotatable joint and thereby urge the door securing device toward an arm configuration.

14. The door securing device of claim 13, wherein the shield includes a finger pocket adapted to facilitate overcoming the torsion spring and thereby positioning the door securing device in the disengaged configuration.

15. The door securing device of claim 13, further comprising a detent adapted to resist the torsion spring and thereby retain the door securing device in the disengaged configuration when the detent is engaged.

16. The door securing device of claim 1, further comprising a keeper adapted to retain the direct engagement between the catch and the catching portion when the door is exposed to alternating loads.

17. A door securing device comprising: a disengaged configuration adapted to allow opening of a door; an engaged configuration adapted to resist the opening of the door beyond a predetermined opening of the door; an armed configuration adapted to automatically transition to the engaged configuration upon the opening of the door reaching the predetermined opening and adapted to manually transition to the disengaged configuration upon operator manipulation; a base member including a base end and a first joint portion; a monolithic deformable member extending along a length between a first end and a second end, the first end including a second joint portion and the second end including a catching portion; a configuration joint adapted to configure the door securing device in the disengaged configuration, adapted to configure the door securing device in the engaged configuration, and adapted to configure the door securing device in the armed configuration, the configuration joint including the first joint portion of the base member and the second joint portion of the monolithic deformable member; a catch member including a base end and a catch, the catch of the catch member adapted to directly engage the catching portion of the monolithic deformable member at least when the opening of the door is beyond the predetermined opening of the door and the door securing device is in the engaged configuration; and a keeper adapted to retain the direct engagement between the catch and the catching portion when the door is exposed to alternating loads; wherein the monolithic deformable member is adapted to hyperelastically deform and thereby increase the length of the monolithic deformable member when resisting the opening of the door beyond the predetermined opening of the door.

18. The door securing device of claim 17, wherein the keeper does not retain the door securing device in the armed configuration.

19. The door securing device of claim 18, wherein the catching portion includes an end loop that is trapped by the keeper when the door securing device automatically transitions from the armed configuration to the engaged configuration upon the opening of the door reaching the predetermined opening.

20. The door securing device of claim 19, wherein the door securing device is manually transitioned to the disengaged configuration from the engaged configuration by the operator manipulation of the keeper.

21. A door securing device adapted to resist significant opening of a door when set to an engaged configuration and adapted to allow opening of the door when set to a disengaged configuration, the door securing device comprising: a base member including a base end and a first joint portion; a monolithic deformable member extending along a length between a first end and a second end, the first end including a second joint portion and the second end including a catching portion; a rotatable joint adapted to configure the door securing device in the engaged configuration and also adapted to configure the door securing device in the disengaged configuration, the rotatable joint including the first joint portion of the base member and the second joint portion of the monolithic deformable member; a catch member including a base end and a catch, the catch of the catch member adapted to directly engage the catching portion of the monolithic deformable member at least when the door securing device is resisting the significant opening of the door in the engaged configuration; and a spring urging the monolithic deformable member to rotate about an axis of a pin and thereby urge the door securing device toward an armed configuration; wherein the monolithic deformable member is adapted to deform and thereby increase the length of the monolithic deformable member when resisting the significant opening of the door; and wherein the rotatable joint includes at least one hole in the first joint portion of the base member, at least one hole in the second joint portion of the monolithic deformable member, and the pin positioned within the holes.

22. The door securing device of claim 21, further comprising a shield positioned circumferentially around the monolithic deformable member, the shield adapted to resist cutting and thereby protect the monolithic deformable member from the cutting.

23. The door securing device of claim 21, further comprising a keeper adapted to retain the direct engagement between the catch and the catching portion when the door is exposed to alternating loads.

* * * * *